US012533721B2

(12) United States Patent
Maksimowski et al.

(10) Patent No.: US 12,533,721 B2
(45) Date of Patent: Jan. 27, 2026

(54) PIPE GROOVER

(71) Applicant: ASC ENGINEERED SOLUTIONS, LLC, Portsmouth, NH (US)

(72) Inventors: Joseph Maksimowski, Guntersville, AL (US); Larry Keith Gunter, Albertville, AL (US)

(73) Assignee: ASC Engineered Solutions, LLC, Oak Brook, IL (US)

( * ) Notice: Subject to any disclaimer, the term of this patent is extended or adjusted under 35 U.S.C. 154(b) by 153 days.

(21) Appl. No.: 17/946,813

(22) Filed: Sep. 16, 2022

(65) Prior Publication Data

US 2023/0090597 A1 Mar. 23, 2023

Related U.S. Application Data

(60) Provisional application No. 63/245,511, filed on Sep. 17, 2021.

(51) Int. Cl.
*B21D 17/04* (2006.01)

(52) U.S. Cl.
CPC ..... *B21D 17/04* (2013.01)

(58) Field of Classification Search
CPC ..... B21D 17/04; B21D 15/06
See application file for complete search history.

(56) References Cited

U.S. PATENT DOCUMENTS 3,260,089 A 7/1966 Hazelton et al.
3,473,359 A * 10/1969 Joslin ..... B23D 21/04 407/7
4,143,535 A * 3/1979 Bouman ..... B21D 17/04 72/119
5,528,919 A 6/1996 McGrady et al.
5,727,411 A * 3/1998 Sakakibara ..... B21D 17/04 72/110
5,778,715 A 7/1998 Lippka et al.
6,196,039 B1 3/2001 Williams et al.
6,244,088 B1 6/2001 Compton
6,272,895 B1 8/2001 Hamm
6,473,981 B2 11/2002 Dole
6,935,152 B2 8/2005 Dole et al.
(Continued)

FOREIGN PATENT DOCUMENTS

CN 204365776 6/2015
CN 206241004 6/2017
(Continued)

OTHER PUBLICATIONS

Maksimowski, Joseph; International Search Report and Written Opinion for PCT Application No. PCT/US2022/043856, filed Sep. 16, 2022, mailed Mar. 6, 2023, 14 pgs.
(Continued)

*Primary Examiner* — Debra M Sullivan
(74) *Attorney, Agent, or Firm* — McAndrews, Held & Malloy, Ltd.

(57) ABSTRACT

A pipe groover can include a base assembly; a spindle plate secured to the base assembly but configured to rotate about an axis with respect to the base assembly; and a plurality of roller assemblies secured to the spindle plate, each of the roller assemblies including a pair of rollers configured to form a groove in a pipe proximate to an end of the pipe.

24 Claims, 59 Drawing Sheets

(56) References Cited

U.S. PATENT DOCUMENTS

| | | | |
|---|---|---|---|
| 6,993,949 | B2 | 2/2006 | Dole |
| 7,116,428 | B2 | 10/2006 | Sauerland et al. |
| 8,091,397 | B1 | 1/2012 | Allen |
| 8,302,514 | B2 | 11/2012 | Dole |
| 9,333,548 | B2 | 5/2016 | Puzio et al. |
| 10,161,547 | B2 | 12/2018 | Novitskey et al. |
| 10,189,070 | B2 | 1/2019 | Olesinska et al. |
| 10,239,140 | B2 | 3/2019 | Kundracik et al. |
| 10,245,631 | B2 | 4/2019 | Dole |
| 10,369,609 | B2 | 8/2019 | Dipierdomenico et al. |
| 10,449,589 | B2 | 10/2019 | Price et al. |
| 10,525,516 | B2 | 1/2020 | Dole |
| 10,668,548 | B2 | 6/2020 | Kundracik et al. |
| 10,960,450 | B2 | 3/2021 | Dole |
| 11,027,381 | B2 | 6/2021 | Onushko et al. |
| 11,110,503 | B2 | 9/2021 | Dole |
| 2002/0134125 | A1 | 9/2002 | Brougham et al. |
| 2003/0226387 | A1 | 12/2003 | Dole et al. |
| 2009/0078017 | A1 | 3/2009 | Allen et al. |
| 2011/0027381 | A1 | 2/2011 | Gradl et al. |
| 2011/0110503 | A1 | 5/2011 | Chapman et al. |
| 2015/0040632 | A1 | 2/2015 | Puzio et al. |
| 2019/0040939 | A1 | 2/2019 | Matsuto et al. |
| 2020/0139418 | A1 | 5/2020 | Larochelle et al. |
| 2021/0053102 | A1 | 2/2021 | Dole |

FOREIGN PATENT DOCUMENTS

| | | | |
|---|---|---|---|
| CN | 208050716 | | 11/2018 |
| DE | 102006062208 | A1 | 6/2008 |
| EP | 0006321 | | 3/1984 |
| EP | 0508541 | A2 | 10/1992 |
| EP | 1952921 | | 8/2008 |
| JP | S6313637 | | 1/1988 |
| KR | 101886113 | | 8/2018 |
| WO | 2023044042 | | 3/2023 |

OTHER PUBLICATIONS

Anvil International; Manual for Gruvlok 3006/3006C Roll Groover Manual, published Jul. 2009, 13 pgs.

Argco; Brochure for Rollverine, publicly available prior to Sep. 17, 2021, 4 pgs.

ASC Engineered Solutions; Manual for Gruvlok Roll Groover 3006 and 3006C Manual, published Feb. 2021, 18 pgs.

Copier Machinery; Article entitled: "Pipe Roll Grooving Machines", located at <https://www.copiermachinery.com/en/products/applications/pipe-roll-grooving/?utm_source=redirects&utm_medium=CPC&utm_campaign=rollgrooving&utm_id=COP09282021&utm_term=groove-machine&utm_content=newlinks>, accessed on Oct. 18, 2021, 5 pgs.

Focus Technology Co., Ltd.; Article entitled: "Automatic Roll Grooving Machine (TWG-IVZ)", located at <https://tuweimachine.en.made-in-china.com/product/bBTxEshvAOkP/China-Automatic-Roll-Grooving-Machine-TWG-IVZ-.html>, accessed on Oct. 18, 2021, 6 pgs.

Victaulic; Article entitled: "Victaulic Unveils Industry's First Intelligent Roll Grooving Tool", located at <https://www.victaulic.com/victaulic-unveils-industrys-first-intelligent-roll-grooving-tool/>, published on Aug. 21, 2016, 5 pgs.

Victaulic; Operating and Maintenance Instruction Manual for RG5200i Pipe Roll Grooving Tool, published 2016, 53 pgs.

Victaulic; Specification Sheet for Victaulic Roll Grooving Tool RG5200i, published 2017, 6 pgs.

Youtube; Video entitled: "Roll Groove 1-1/4" through 6" Pipe in Seconds with the Rollverine Hydraulic Roll Groover", located at <https://www.youtube.com/watch?v=vl0xBKgtvYE>, posted on Aug. 4, 2015, 4 pgs.

Copier Machinery; Youtube video entitled: "Groove Master—Pipe Roll Grooving Machine for Pipes up to 24"—Copier Machinery", available at <https://www.youtube.com/watch?v=upTt8MyNqZc>, published on Oct. 13, 2020, 6 pgs.

Focus Technology Co., Ltd.; Article entitled: "Automatic Roll Grooving Machine (TWG-IVZ)", located at <https://tuweimachine.en.made-in-china.com/product/bBTxEshvAOkP/China-Automatic-Roll-Grooving-Machine-TWG-IVZ-.html>, available on the Wayback Machine as early as Jan. 7, 2021, 3 pgs.

European partial supplementary search report AppIn No. 22870772.5 dated Jun. 6, 2025.

European Office Communication with extended search report Appln No. 22870772.5 dated Oct. 23, 2025.

* cited by examiner

Tool Array Data

| Tool Name | ToolNumber | ToolHomePos | D_upper | Dgr_upper | D_lower | L_tool | x_theoretical | A | B | C | PipeSizeLower Limit | PipeSizeUpper Limit | FindPipe Torque | SensorPos | Schedule | Material | Groove Cycles |
|---|---|---|---|---|---|---|---|---|---|---|---|---|---|---|---|---|---|
| '1" - 1-1/2" Carbon Steel - Standard' | 1 | 4.625 | 0.865 | 0.648 | 4.5 | 0 | 5.422 | -0.15611 | 0.917623 | -0.490378 | 1 | 2.125 | 10 | 0.75 | 'S' | 'S' | 0 |
| '2" - 6" Carbon Steel - Standard' | 2 | 2.875 | 1.844 | 1.524 | 4.826 | 0 | 4.247 | -0.02589 | -0.2286 | 1.439495 | 2.2 | 6.75 | 12 | 1.5 | 'S' | 'S' | 0 |
| '8" - 12" Carbon Steel - Standard' | 3 | 1.25 | 3 | 2.6 | 4.75 | 0 | 3.053 | 0.03603 | -0.59433 | 1.281069 | 8 | 13 | 12 | 1.875 | 'S' | 'S' | 0 |
| '14" - 16" Carbon Steel, Standard' | 4 | 0.948 | 3 | 2.6 | 4.75 | 0 | 3.053 | 0.03603 | -0.59433 | 1.281069 | 13.75 | 16.25 | 12 | 0 | 'S' | 'S' | 0 |
| '18" - 20" Carbon Steel - Standard' | 5 | 0.948 | 3 | 2.6 | 4.75 | 0 | 3.053 | 0.03603 | -0.59433 | 1.281069 | 17.75 | 20.5 | 12 | 0 | 'S' | 'S' | 0 |
| '22" - 24" Carbon Steel - Standard' | 6 | 0.948 | 3 | 2.6 | 4.75 | 0 | 3.053 | 0.03603 | -0.59433 | 1.281069 | 21.75 | 24.25 | 12 | 0 | 'S' | 'S' | 0 |
| '2" - 6" Carbon Steel - Sch 10' | 7 | 2.875 | 1.844 | 1.581 | 4.826 | 0 | 4.14 | -0.02384 | -0.24257 | 1.434765 | 1.9 | 7 | 12 | 1.45 | '10' | 'S' | 0 |
| '8" - 12" Carbon Steel - Sch 10' | 8 | 1.375 | 3 | 2.6 | 4.75 | 0 | 2.7 | 0.03603 | -0.59433 | 1.281069 | 8 | 12.875 | 12 | 1.875 | '10' | 'S' | 0 |
| '2" - 6" Stainless Steel - Sch 10' | 9 | 2.875 | 1.844 | 1.524 | 4.826 | 0 | 4.247 | -0.02384 | -0.24257 | 1.434765 | 2 | 6.75 | 10 | 1.5 | '10' | 'SS' | 0 |
| '8" - 12" Stainless Steel - Sch 10' | 10 | 1.375 | 3 | 2.6 | 4.75 | 0 | 2.7 | 0.03603 | -0.59433 | 1.281069 | 8 | 12.875 | 12 | 1.875 | '10' | 'SS' | 0 |
| '2" - 8" Copper CTS - Standard' | 11 | 2.306 | 1.826 | 1.524 | 4.826 | 0 | 4.247 | -0.02589 | -0.2286 | 1.439495 | 2 | 8.25 | 12 | 0 | 'S' | 'C' | 0 |
| 1" - 1-1/2" Stainless Steel - Sch 10' | 12 | 4.625 | 0.865 | 0.648 | 4.5 | 0 | 5.422 | -0.15611 | 0.917623 | -0.490378 | 1 | 2.125 | 10 | 0.75 | '10' | 'SS' | 0 |

FIG. 28

Pipe Array Data - Carbon Steel

| Pipe Name | Material Number | Pipe Number | MinOD | MaxOD | WallMin | WallMax | Schedule | RamGroovePos | GrooveTorque | GrooveRPM | GrooveVelLimit | FinishRevs |
|---|---|---|---|---|---|---|---|---|---|---|---|---|
| '1" Pipe - Carbon Steel - Schedule 10' | 1 | 3 | 1 | 1.4 | 0.125 | 0.15 | '10' | 5.148 | 25 | 40 | 0.0625 | 1 |
| '1" Pipe - Carbon Steel - Schedule 40' | 1 | 4 | 1 | 1.4 | 0.15 | 0.17 | 'S' | 5.135 | 25 | 40 | 0.0625 | 1 |
| '1-1/4" Pipe - Carbon Steel - Schedule 10' | 1 | 5 | 1.4 | 1.7 | 0.125 | 0.15 | '10' | 5.155 | 25 | 40 | 0.0625 | 1 |
| '1-1/4" Pipe - Carbon Steel - Schedule 40' | 1 | 6 | 1.4 | 1.6 | 0.16 | 0.175 | 'S' | 5.125 | 25 | 40 | 0.0625 | 1 |
| '1-1/2" Pipe - Carbon Steel - Schedule 10' | 1 | 7 | 1.6 | 2.1 | 0.125 | 0.145 | '10' | 5.175 | 25 | 40 | 0.0625 | 1 |
| '1-1/2" Pipe - Carbon Steel - Schedule 40' | 1 | 8 | 1.6 | 2.1 | 0.16 | 0.19 | 'S' | 5.125 | 25 | 40 | 0.0625 | 1 |
| '2" Pipe - Carbon Steel - Schedule 10' | 1 | 9 | 1.75 | 2.5 | 0.07 | 0.12 | '10' | 3.915 | 40 | 40 | 0.0625 | 1 |
| '2" Pipe - Carbon Steel - Schedule 40' | 1 | 10 | 1.85 | 2.7 | 0.125 | 0.2 | 'S' | 3.822 | 40 | 40 | 0.0625 | 1 |
| '2-1/2" Pipe - Carbon Steel - Schedule 10' | 1 | 11 | 2.7 | 3 | 0.1044 | 0.138 | '10' | 3.918 | 40 | 40 | 0.0625 | 1 |
| '2-1/2" Pipe - Carbon Steel - Schedule 40' | 1 | 12 | 2.7 | 3 | 0.17661 | 0.23345 | 'S' | 3.781 | 40 | 40 | 0.0625 | 1 |
| '3" Pipe - Carbon Steel - Schedule 10' | 1 | 13 | 3.2 | 4 | 0.085 | 0.138 | '10' | 3.925 | 40 | 40 | 0.0625 | 1 |
| '3" Pipe - Carbon Steel - Schedule 40' | 1 | 14 | 3.1 | 3.8 | 0.18 | 0.2484 | 'S' | 3.805 | 40 | 40 | 0.0625 | 1 |
| 3-1/2" Pipe - Carbon Steel - Schedule 10' | 1 | 15 | 3.953375 | 4.055625 | 0.1044 | 0.138 | '10' | 0 | 40 | 40 | 0.0625 | 1 |
| 3-1/2" Pipe - Carbon Steel - Schedule 40' | 1 | 16 | 3.953375 | 4.055625 | 0.19662 | 0.2599 | 'S' | 0 | 40 | 40 | 0.0625 | 1 |
| 4" Pipe - Carbon Steel - Schedule 10' | 1 | 17 | 4.1 | 4.7 | 0.085 | 0.138 | '10' | 3.945 | 27 | 40 | 0.0625 | 1 |
| '4" Pipe - Carbon Steel - Schedule 40' | 1 | 18 | 3.9 | 4.7 | 0.19 | 0.273 | 'S' | 3.82 | 37 | 45 | 0.03125 | 1 |
| 5" Pipe - Carbon Steel - Schedule 10' | 1 | 19 | 5 | 5.634625 | 0.095 | 0.1541 | '10' | 3.935 | 30 | 40 | 0.0625 | 1 |
| 5" Pipe - Carbon Steel - Schedule 40' | 1 | 20 | 5 | 5.635 | 0.2 | 0.297 | 'S' | 3.77 | 50 | 40 | 0.375 | 1 |
| 6" Pipe - Carbon Steel - Schedule 10' | 1 | 21 | 6.25 | 6.703625 | 0.1 | 0.1541 | '10' | 3.955 | 30 | 40 | 0.0625 | 1 |
| '6" Pipe - Carbon Steel - Schedule 40' | 1 | 22 | 6.3 | 7 | 0.235 | 0.322 | 'S' | 3.77 | 50 | 40 | 0.375 | 1 |
| '8" Pipe - Carbon Steel - Schedule 10' | 1 | 23 | 8 | 8.703625 | 0.1 | 0.25 | '10' | 2.645 | 40 | 40 | 0.25 | 1 |
| '8" Pipe - Carbon Steel - Schedule 40' | 1 | 24 | 8 | 9 | 0.28014 | 0.3703 | 'S' | 2.475 | 60 | 40 | 1 | 1 |
| '10" Pipe - Carbon Steel - Schedule 10' | 1 | 25 | 10 | 10.828625 | 0.14355 | 0.18975 | '10' | 2.617 | 40 | 40 | 0.25 | 1 |
| '10" Pipe - Carbon Steel - Schedule 40' | 1 | 26 | 10.375 | 10.828625 | 0.318 | 0.42 | 'S' | 2.365 | 60 | 40 | 1 | 1 |
| '12" Pipe - Carbon Steel - Schedule 10' | 1 | 27 | 12 | 12.828625 | 0.1566 | 0.207 | '10' | 0 | 40 | 40 | 0.0625 | 0 |
| '12" Pipe - Carbon Steel - Standard' | 1 | 28 | 12 | 12.828625 | 0.32625 | 0.43125 | 'S' | 2.49 | 75 | 45 | 1.25 | 1 |
| '14" Pipe - Carbon Steel - Standard' | 1 | 29 | 13.953375 | 14.078625 | 0.32625 | 0.43125 | 'S' | 0 | 40 | 40 | 0.0625 | 1 |
| '16" Pipe - Carbon Steel - Standard' | 1 | 30 | 15.953375 | 16.078625 | 0.32625 | 0.43125 | 'S' | 0 | 40 | 40 | 0.0625 | 1 |
| '18" Pipe - Carbon Steel - Standard' | 1 | 31 | 17.953375 | 18.078625 | 0.32625 | 0.43125 | 'S' | 0 | 40 | 40 | 0.0625 | 1 |
| '20" Pipe - Carbon Steel - Standard' | 1 | 32 | 19.958375 | 20.078625 | 0.32625 | 0.43125 | 'S' | 0 | 40 | 40 | 0.0625 | 1 |
| '22" Pipe - Carbon Steel - Standard' | 1 | 33 | 21.953375 | 22.078625 | 0.32625 | 0.43125 | 'S' | 0 | 40 | 40 | 0.0625 | 1 |
| '24" Pipe - Carbon Steel - Standard' | 1 | 34 | 23.953375 | 24.078625 | 0.32625 | 0.43125 | 'S' | 0 | 40 | 40 | 0.0625 | 1 |
| '26" Pipe - Carbon Steel - Standard' | 1 | 36 | 25.953375 | 26.108625 | 0.32625 | 0.43125 | 'S' | 0 | 40 | 40 | 0.0625 | 1 |
| '28" Pipe - Carbon Steel - Standard' | 1 | 36 | 27.953375 | 28.108625 | 0.32625 | 0.43125 | 'S' | 0 | 40 | 40 | 0.0625 | 1 |
| '30" Pipe - Carbon Steel - Standard' | 1 | 37 | 29.953375 | 30.108625 | 0.32625 | 0.43125 | 'S' | 0 | 40 | 40 | 0.0625 | 1 |

FIG. 29A

Pipe Groove Data - Stainless Steel

| Pipe Name | Material Number | Pipe Number | MinOD | MaxOD | WallMin | WallMax | Schedule | RamGroovePos | GrooveTorque | GrooveRPM | GrooveVelLimit | FinishRevs |
|---|---|---|---|---|---|---|---|---|---|---|---|---|
| '1" Pipe - Stainless Steel - Schedule 10' | 2 | 2 | 1 | 1.4 | 0.125 | 0.15 | '10' | 5.148 | 25 | 40 | 0.0625 | 1 |
| '1-1/4" Pipe - Stainless Steel - Schedule 10' | 2 | 3 | 1.4 | 1.7 | 0.125 | 0.15 | '10' | 5.155 | 25 | 40 | 0.0625 | 1 |
| '1-1/2" Pipe - Stainless Steel - Schedule 10' | 2 | 4 | 1.6 | 2.1 | 0.125 | 0.145 | '10' | 5.175 | 25 | 40 | 0.0625 | 1 |
| '2" Pipe - Stainless Steel - Schedule 10' | 2 | 5 | 2 | 2.5 | 0.06 | 0.129 | '10' | 3.945 | 40 | 40 | 0.0625 | 1 |
| '2-1/2" Pipe - Stainless Steel - Schedule 10' | 2 | 6 | 2.830375 | 2.919625 | 0.1044 | 0.138 | '10' | 0 | 40 | 40 | 0.0625 | 1 |
| '3" Pipe - Stainless Steel - Schedule 10' | 2 | 7 | 3.453375 | 3.550625 | 0.1044 | 0.138 | '10' | 0 | 40 | 40 | 0.0625 | 1 |
| '3-1/2" Pipe - Stainless Steel - Schedule 10' | 2 | 8 | 3.953375 | 4.055625 | 0.1044 | 0.138 | '10' | 0 | 40 | 40 | 0.0625 | 1 |
| '4" Pipe - Stainless Steel - Schedule 10' | 2 | 9 | 4.1 | 4.7 | 0.085 | 0.138 | '10' | 3.975 | 28 | 40 | 0.0625 | 1 |
| '5" Pipe - Stainless Steel - Schedule 10' | 2 | 10 | 5.516375 | 5.634625 | 0.11658 | 0.1541 | '10' | 0 | 40 | 40 | 0.0625 | 1 |
| '6" Pipe - Stainless Steel - Schedule 10' | 2 | 11 | 6.578375 | 6.703625 | 0.11658 | 0.1541 | '10' | 0 | 40 | 40 | 0.0625 | 1 |
| '8" Pipe - Stainless Steel - Schedule 10' | 2 | 12 | 8.578375 | 8.703625 | 0.12876 | 0.1702 | '10' | 0 | 40 | 40 | 0.0625 | 1 |
| '10" Pipe - Stainless Steel - Schedule 10' | 2 | 13 | 10.703375 | 10.828625 | 0.14355 | 0.18975 | '10' | 0 | 40 | 40 | 0.0625 | 1 |
| '12" Pipe - Stainless Steel - Schedule 10' | 2 | 14 | 12.703375 | 12.828625 | 0.1566 | 0.207 | '10' | 0 | 40 | 40 | 0.0625 | 1 |

FIG. 29B

Pipe Groove Data - Copper

| Pipe Name | Material Number | Pipe Number | MinOD | MaxOD | WallMin | WallMax | Schedule | RamGroovePos | GrooveTorque | GrooveRPM | GrooveVelLimit | FinishRevs |
|---|---|---|---|---|---|---|---|---|---|---|---|---|
| '2" Pipe - Copper CTS - Standard' | 3 | 1 | 2.118 | 2.132 | 0.053 | 0.843 | 'S' | 0 | 30 | 40 | 0.0625 | 0 |
| '2-1/2" Pipe - Copper CTS - Standard' | 3 | 2 | 2.618 | 2.632 | 0.06 | 0.11 | 'S' | 0 | 30 | 40 | 0.0625 | 0 |
| '3" Pipe - Copper CTS - Standard' | 3 | 3 | 3.118 | 3.132 | 0.04 | 0.125 | 'S' | 0 | 30 | 40 | 0.0625 | 0 |
| '4" Pipe - Copper CTS - Standard' | 3 | 4 | 4.118 | 4.132 | 0.053 | 0.152 | 'S' | 0 | 30 | 40 | 0.0625 | 0 |
| '5" Pipe - Copper CTS - Standard' | 3 | 5 | 5.118 | 5.132 | 0.067 | 0.181 | 'S' | 0 | 30 | 40 | 0.0625 | 0 |
| '6" Pipe - Copper CTS - Standard' | 3 | 6 | 6.118 | 6.132 | 0.078 | 0.216 | 'S' | 0 | 30 | 40 | 0.0625 | 0 |
| '8" Pipe - Copper CTS - Standard' | 3 | 7 | 7.116 | 7.132 | 0.104 | 0.303 | 'S' | 0 | 30 | 40 | 0.0625 | 0 |

FIG. 29C

Pipe Data - Other

| Pipe Name | Material Number | Pipe Number | MinOD | MaxOD | WallMin | WallMax | Schedule | RamGroovePos | GrooveTorque | GrooveRPM | GrooveVelLimit | PipeHomePos | BankNumber |
|---|---|---|---|---|---|---|---|---|---|---|---|---|---|
| 'Select a Pipe Size' | 1 | 0 | 0 | 0 | 0 | 0 | '10' | 1.25 | 0 | 0 | 0 | 1.25 | 0 |
| '1" Pipe - Stainless Steel - Schedule 10' | 1 | 1 | 1 | 1.4 | 0.125 | 0.15 | '10' | 4.8 | 25 | 50 | 0.0625 | 4.375 | 0 |
| '1-1/4" Pipe - Stainless Steel - Schedule 10' | 1 | 2 | 1.4 | 1.7 | 0.125 | 0.15 | '10' | 4.8 | 25 | 50 | 0.0625 | 4.25 | 1 |
| '1-1/2" Pipe - Stainless Steel - Schedule 10' | 1 | 3 | 1.6 | 2.1 | 0.125 | 0.145 | '10' | 4.8 | 25 | 50 | 0.0625 | 4.25 | 2 |
| '2" Pipe - Stainless Steel - Schedule 10' | 1 | 4 | 2 | 2.5 | 0.06 | 0.129 | '10' | 3.945 | 40 | 40 | 0.0625 | 3.25 | 3 |
| '2-1/2" Pipe - Stainless Steel - Schedule 10' | 1 | 5 | 2.83 | 2.92 | 0.1044 | 0.138 | '10' | 3.918 | 40 | 40 | 0.0625 | 3.25 | 4 |
| '3" Pipe - Stainless Steel - Schedule 10' | 1 | 6 | 3.453375 | 3.550625 | 0.1044 | 0.138 | '10' | 3.925 | 40 | 40 | 0.0625 | 3.25 | 5 |
| '3-1/2" Pipe - Stainless Steel - Schedule 10' | 1 | 7 | 3.953375 | 4.055625 | 0.1044 | 0.138 | '10' | 3.925 | 40 | 40 | 0.0625 | 3.25 | 6 |
| '4" Pipe - Stainless Steel - Schedule 10' | 1 | 8 | 4.1 | 4.7 | 0.085 | 0.138 | '10' | 3.935 | 28 | 40 | 0.0625 | 3.25 | 6 |
| '5" Pipe - Stainless Steel - Schedule 10' | 1 | 9 | 5.516375 | 5.634625 | 0.11658 | 0.1541 | '10' | 3.96 | 40 | 40 | 0.0625 | 3.25 | 7 |
| '6" Pipe - Stainless Steel - Schedule 10' | 1 | 10 | 6.25 | 6.703625 | 0.1 | 0.1541 | '10' | 3.955 | 30 | 40 | 0.0625 | 3.25 | 7 |
| '8" Pipe - Stainless Steel - Schedule 10' | 1 | 11 | 8 | 8.703625 | 0.1 | 0.25 | '10' | 2.645 | 30 | 30 | 0.094 | 2 | 8 |
| '10" Pipe - Stainless Steel - Schedule 10' | 1 | 12 | 10.703375 | 10.828625 | 0.14355 | 0.18975 | '10' | 2.617 | 40 | 40 | 0.0625 | 1.875 | 9 |
| '12" Pipe - Stainless Steel - Schedule 10' | 1 | 13 | 12 | 12.828625 | 0.1566 | 0.207 | '10' | 2.7 | 35 | 40 | 0.5 | 1.75 | 10 |
| 2" Pipe - Copper CTS - Standard' | 1 | 14 | 2.118 | 2.132 | 0.053 | 0.343 | 'S' | 3.945 | 30 | 40 | 0.0625 | 2.875 | 3 |
| '2-1/2" Pipe - Copper CTS - Standard' | 1 | 15 | 2.618 | 2.632 | 0.06 | 0.11 | 'S' | 3.918 | 30 | 40 | 0.0625 | 2.875 | 4 |
| '3" Pipe - Copper CTS - Standard' | 1 | 16 | 3.118 | 3.132 | 0.04 | 0.125 | 'S' | 3.925 | 30 | 40 | 0.0625 | 2.875 | 5 |
| '4" Pipe - Copper CTS - Standard' | 1 | 17 | 4.118 | 4.132 | 0.053 | 0.152 | 'S' | 3.935 | 30 | 40 | 0.0625 | 2.875 | 6 |
| '5" Pipe - Copper CTS - Standard' | 1 | 18 | 5.118 | 5.132 | 0.067 | 0.181 | 'S' | 3.96 | 30 | 40 | 0.0625 | 2.875 | 7 |
| '6" Pipe - Copper CTS - Standard' | 1 | 19 | 6.118 | 6.132 | 0.078 | 0.216 | 'S' | 3.955 | 30 | 40 | 0.0625 | 2.875 | 7 |
| '8" Pipe - Copper CTS - Standard' | 1 | 20 | 7.116 | 7.132 | 0.104 | 0.303 | 'S' | 2.645 | 30 | 40 | 0.0625 | 2.875 | 8 |
| 14" Pipe - Standard' | 1 | 21 | 13 | 14.078625 | 0.3125 | 0.43125 | 'S' | 2.455 | 57 | 50 | 1.25 | 1.25 | 11 |
| 16" Pipe - Standard' | 1 | 22 | 15.75 | 17 | 0.3 | 0.43125 | 'S' | 2.442 | 58 | 50 | 1.25 | 1.25 | 12 |
| 18" Pipe - Standard' | 1 | 23 | 17.25 | 19 | 0.3 | 0.43125 | 'S' | 2.43 | 70 | 50 | 1.25 | 1.25 | 13 |
| 20" Pipe - Standard' | 1 | 24 | 19.25 | 21 | 0.3 | 0.43125 | 'S' | 2.435 | 70 | 50 | 1.25 | 1.25 | 14 |
| 22" Pipe - Standard' | 1 | 25 | 21.5 | 23 | 0.3 | 0.43125 | 'S' | 2.435 | 70 | 50 | 1.25 | 1.25 | 15 |
| 24" Pipe - Standard' | 1 | 26 | 23.5 | 25 | 0.3 | 0.43125 | 'S' | 2.705 | 80 | 50 | 1.25 | 1.25 | 15 |

FIG. 29D

PIPE GROOVER

REFERENCE TO RELATED APPLICATIONS

This application claims the benefit of U.S. Provisional Application No. 63/245,511, filed Sep. 17, 2021, which is hereby specifically incorporated by reference herein in its entirety.

TECHNICAL FIELD

Field of Use

This disclosure relates to pipe groovers. More specifically, this disclosure relates to pipe groovers that automatically form grooves in pipe and with only minimal interaction, if any, by a user.

Related Art

Lengths of pipes such as those used in a fluid distribution system are typically joined to each other using couplings. Some couplings are specially configured to join grooved pipes, which are pipes defining a groove extending radially inward around a circumference thereof and proximate to each mating end. Machines for forming grooves in pipes typically utilize a single set of intermeshing rollers that are specific to certain pipe sizes and pipe materials, use hydraulic power, require significant manual intervention including regular trial-and-error adjustments, and require manual checking of pipe sizes by an operator. Such machines also can only accommodate one set of rollers and, therefore, to form a groove using a different set of rollers the roller sets must be manually swapped out.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

In one aspect, disclosed is a pipe groover comprising: a base assembly; a spindle plate secured to the base assembly but configured to rotate about an axis with respect to the base assembly; and a plurality of roller assemblies secured to the spindle plate, each of the roller assemblies comprising a pair of rollers configured to form a groove in a pipe proximate to an end of the pipe.

In a further aspect, disclosed is a pipe groover comprising: an inner roller configured to receive a pipe to be grooved; a pivot arm assembly configured to rotate with respect to the inner roller, the pivot arm assembly comprising a pivot arm and an outer roller coupled to the pivot arm, the pivot arm assembly comprising a pivot point proximate to a first end, the outer roller positioned between the first end and a second end distal from the first end; and an actuator configured to move the roller into the pipe by pushing against the second end of the pivot arm assembly, a lever arm distance defined between a first contact point proximate to the outer roller and a second contact point proximate to the second end of the pivot arm assembly, contact between the pivot arm assembly and the pipe defining the first contact point and contact between the actuator and the pivot arm assembly defining the second contact point.

In yet another aspect, disclosed is a pipe groover comprising an electric actuator.

In yet another aspect, disclosed is a method of using a pipe groover, the method comprising: automatically determining a thickness of the pipe wall based on the pipe groover taking at least a first measurement involving the pipe; automatically determining a diameter of the pipe based on the pipe groover taking at least a second measurement involving the pipe; and identifying a set of pipe specifications matching the pipe based at least partly on the first measurement and the second measurement.

In yet another aspect, disclosed is a method of using a pipe groover, the method comprising: forming a groove in a bottom end of a pipe, an outer roller of a pair of rollers configured to form the groove positioned below the bottom end of the pipe; and supporting the pipe from below the pipe with an adjustable support roller secured to the pipe groover.

In yet another aspect, disclosed is a method of using a pipe groover, the method comprising: automatically determining a diameter and a thickness of a wall of a pipe engaged with the pipe groover based on the pipe groover taking a measurement defining a distance between a sensor and an outer surface of the pipe; and identifying a set of pipe specifications matching the pipe based at least the measurement and a database to which the pipe groover has access.

In yet another aspect, disclosed is a method of using a pipe groover, the method comprising: forming a groove in a bottom end of a pipe, an outer roller of a pair of rollers configured to form the groove positioned below the bottom end of the pipe when the pipe is positioned in the pipe groover relative to a Z-axis direction defined by the pipe groover; and supporting the pipe from below the pipe with an adjustable support roller secured to the pipe groover.

In yet another aspect, disclosed is a method of using a pipe groover comprising: obtaining the pipe groover, the pipe grooving comprising: a base assembly; a tool head secured to the base assembly; an enclosure secured to the base assembly, the enclosure configured to receive both the tool head and a pipe to be grooved; and a safety sensor system secured to the enclosure; engaging a pipe with the tool head of the pipe groover; and sensing, with the safety sensor system, a foreign object positioned inside an opening defined by the enclosure, the foreign object not being the pipe groover itself or the pipe.

Various implementations described in the present disclosure may comprise additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations may be realized and obtained by means of the systems, methods, features particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

The accompanying drawings, which are incorporated in and constitute a part of this specification, illustrate several aspects of the disclosure and together with the description, serve to explain various principles of the disclosure. The drawings are not necessarily drawn to scale. Corresponding features and components throughout the figures may be designated by matching reference characters for the sake of consistency and clarity.

FIG. 28 is a table listing various parameters for an exemplary list of different tools for grooving and, more specifically, roller assemblies.

FIG. 29A is a table listing various parameters for an exemplary list of different pipes formed from carbon steel.

FIG. 29B is a table listing various parameters for an exemplary list of different pipes formed from stainless steel.

FIG. 29C is a table listing various parameters for an exemplary list of different pipes formed from copper.

FIG. 29D is a table listing various parameters for an exemplary list of other pipes formed from various materials in accordance with another aspect of the current disclosure.

DETAILED DESCRIPTION

Figure 1A:
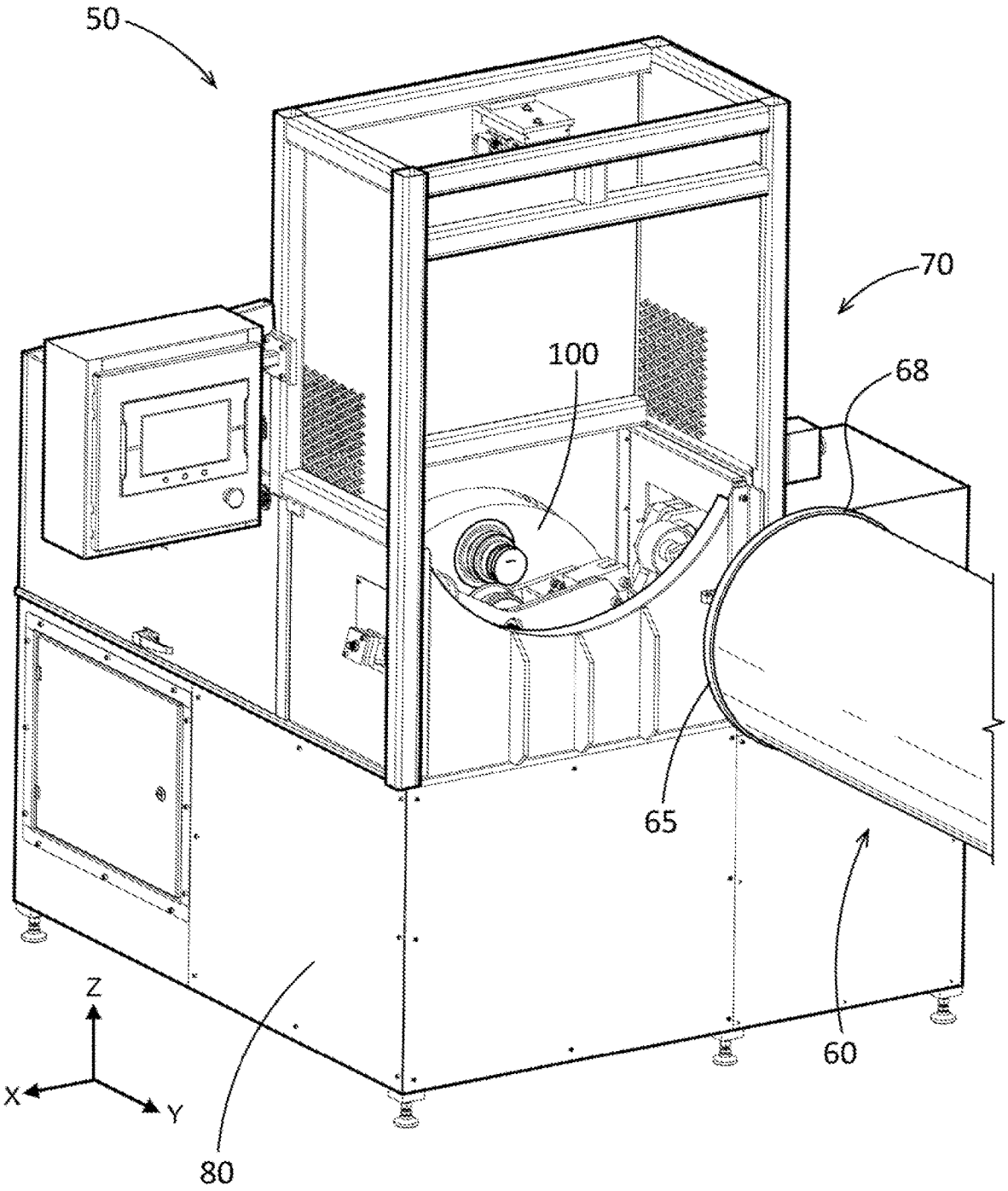
FIG. 1A is a front top left perspective view of a pipe groove system and, more specifically, a pipe groover in accordance with one aspect of the current disclosure showing also a pipe offset in an axial direction of the pipe from the pipe groover.

The present disclosure can be understood more readily by reference to the following detailed description, examples, drawings, and claims, and their previous and following description. However, before the present devices, systems, and/or methods are disclosed and described, it is to be understood that this disclosure is not limited to the specific devices, systems, and/or methods disclosed unless otherwise specified, as such can, of course, vary. It is also to be understood that the terminology used herein is for the purpose of describing particular aspects only and is not intended to be limiting.

The following description is provided as an enabling teaching of the present devices, systems, and/or methods in their best, currently known aspect. To this end, those skilled in the relevant art will recognize and appreciate that many changes can be made to the various aspects described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to a quantity of one of a particular element can comprise two or more such elements unless the context indicates otherwise. In addition, any of the elements described herein can be a first such element, a second such element, and so forth (e.g., a first widget and a second widget, even if only a "widget" is referenced).

Ranges can be expressed herein as from "about" one particular value, and/or to "about" another particular value. When such a range is expressed, another aspect comprises from the one particular value and/or to the other particular value. Similarly, when values are expressed as approximations, by use of the antecedent "about" or "substantially," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance may or may not occur, and that the description comprises instances where said event or circumstance occurs and instances where it does not.

The word "or" as used herein means any one member of a particular list and also comprises any combination of members of that list. The phrase "at least one of A and B" as used herein means "only A, only B, or both A and B"; while the phrase "one of A and B" means "A or B."

The word "assembly" can mean that the identified structure comprises two or more components. In some aspects, however, the assembly need not require more than one part.

To simplify the description of various elements disclosed herein, the conventions of "left," "right," "front," "rear," "top," "bottom," "upper," "lower," "inside," "outside," "inboard," "outboard," "horizontal," and/or "vertical" may be referenced. Unless stated otherwise, "front" describes that end of the system and pipe groover nearest to and occupied by a user or operator of the pipe groover facing a side of the pipe groover configured to receive a pipe; "rear" is that end of the system and pipe groover that is opposite or distal the front; "left" is that which is to the left of or facing left from the user facing towards the front; and "right" is that which is to the right of or facing right from that same person while facing towards the front. "Horizontal" or "horizontal orientation" describes that which is in a plane extending from left to right and aligned with the horizon. "Vertical" or "vertical orientation" describes that which is in a plane that is angled at 90 degrees to the horizontal.

The pipe groover can also be described using a coordinate axis of X-Y-Z directions shown in FIG. 1A. An X-axis direction can be referred to as a left-right or horizontal direction. An upper-lower direction is a Z-axis direction orthogonal to the X-axis direction and to a Y-axis direction. The Y-axis direction is orthogonal to the X-axis direction (left-right direction) and the Z-axis direction (upper-lower direction) and can also be referred to as a front-rear direction. A surface of a structural element that is parallel with the front-rear direction can be referred to as a lateral side.

In one aspect, a pipe groover and associated methods, systems, devices, and various apparatuses are disclosed herein. In one aspect, the pipe groover can comprise a pipe measurement system for automatically identifying a pipe engaged with the pipe groover. In one aspect, the pipe groover can comprise a plurality of spindle heads, each of which is configured to form a groove in a different range of pipe sizes by simply rotating to a station with the desired spindle head. In one aspect, the pipe groover can comprise an electric actuator, which can be a ball screw linear actuator. In one aspect, the pipe groover can form a groove in a bottom end of a pipe, the bottom end of the pipe being defined as a lowermost portion of the pipe, with respect to the Z-axis, when the pipe is engaged with the pipe groover. In one aspect, the pipe groover can comprise a support roller and can support the bottom end of the pipe with the support roller during a grooving operation and, optionally, with a plurality of support rollers.

FIG. 1A is a front top left perspective view of a pipe groove system 50 and, more specifically, a pipe groover 70 in accordance with one aspect of the current disclosure. In some aspects, a pipe 60 can be offset in an axial direction of the pipe 60 from the pipe groover 70 before engagement therewith. The system 50 can comprise an electrical power source (not shown), which can provide a source of electricity for any electrical components such as, for example and without limitation, electric actuators, electric motors, and controllers. The system 50 can comprise a pneumatic (i.e., air) power source, which can provide a source of pressurized air (or another gas) for any pneumatic components such as, for example and without limitation, gas-powered cylinders. In contrast to typical pipe groovers, the system 50 can, but need not, comprise a hydraulic power source, at least for purpose of driving any of the components thereof. In some aspects, the system 50 can comprise a source of oil such as for the purpose of lubricating the pipe 60 and/or the pipe groover 70. As will be described herein, the pipe groover 70 can be configured to at least semi-automatically (i.e., with only some intervention by a user or operator) form a groove 68 in any one of a plurality of pipes 60 of varying sizes proximate to an end 65 of the pipe 60. The pipe groover 70 can comprise a spindle assembly 100. The pipe groover 70 can comprise a frame 80, which can be configured to support and/or enclose the spindle assembly 100. The frame 80 and, more generally, the pipe groover 70 can be positioned on a surface of a floor (e.g., in a manufacturing facility).

Figure 1B:
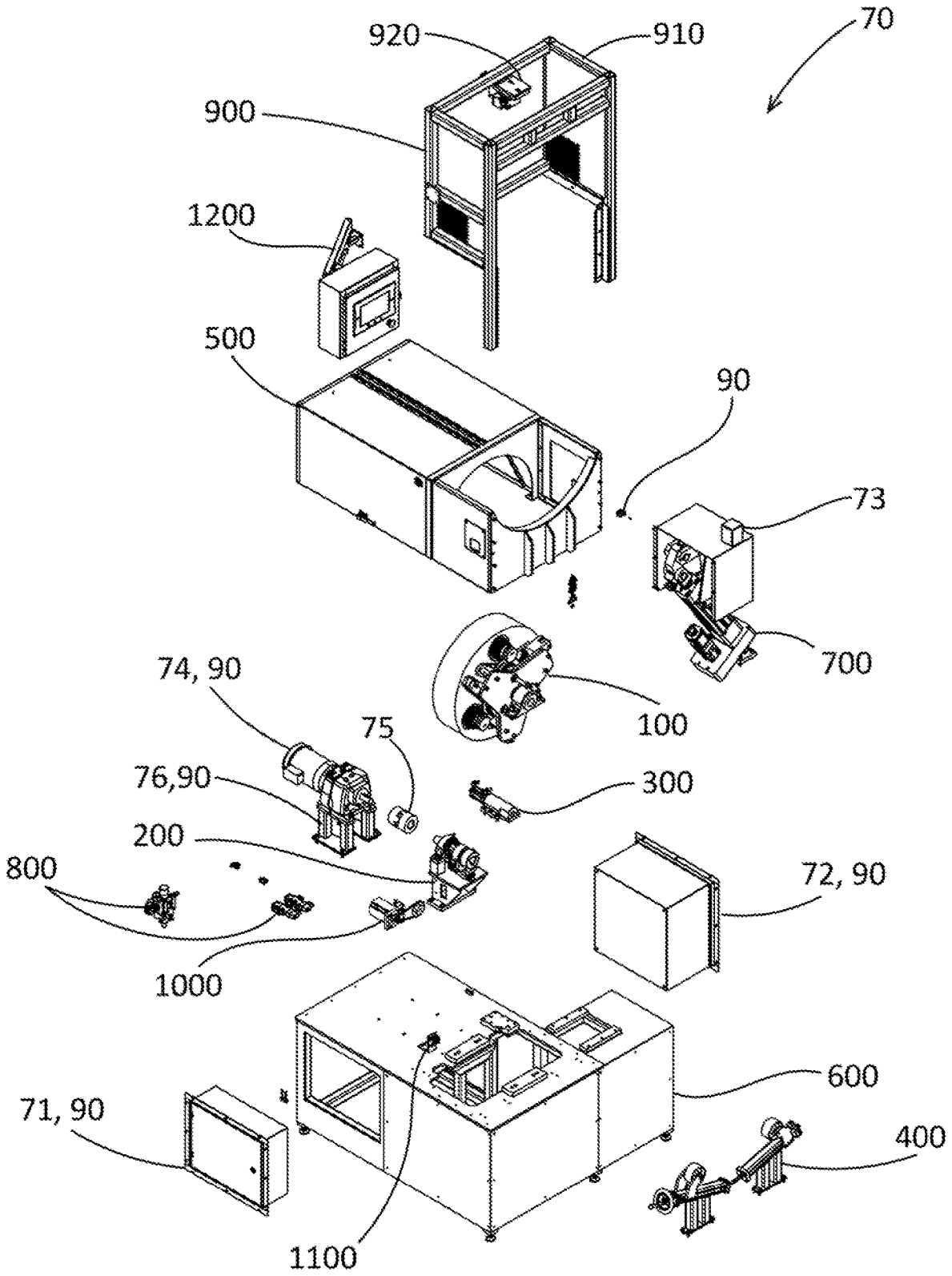
FIG. 1B is a front top left perspective exploded view of the pipe groover of FIG. 1B showing various assemblies of the pipe groover separated from each other.
Figure 1C:
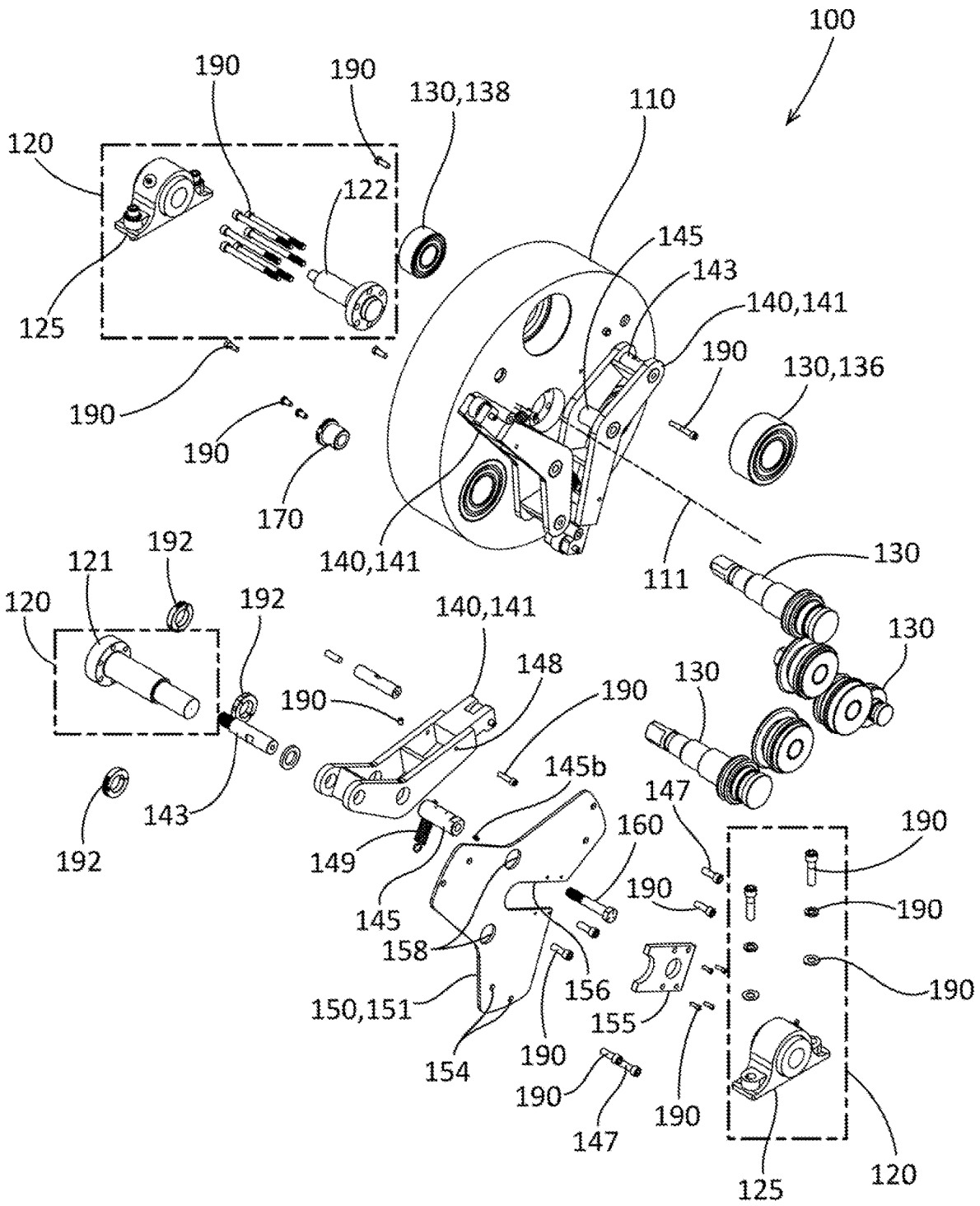
FIG. 1C is a front top left perspective exploded view of a spindle assembly of the pipe groover of FIG. 1B.
Figure 16:
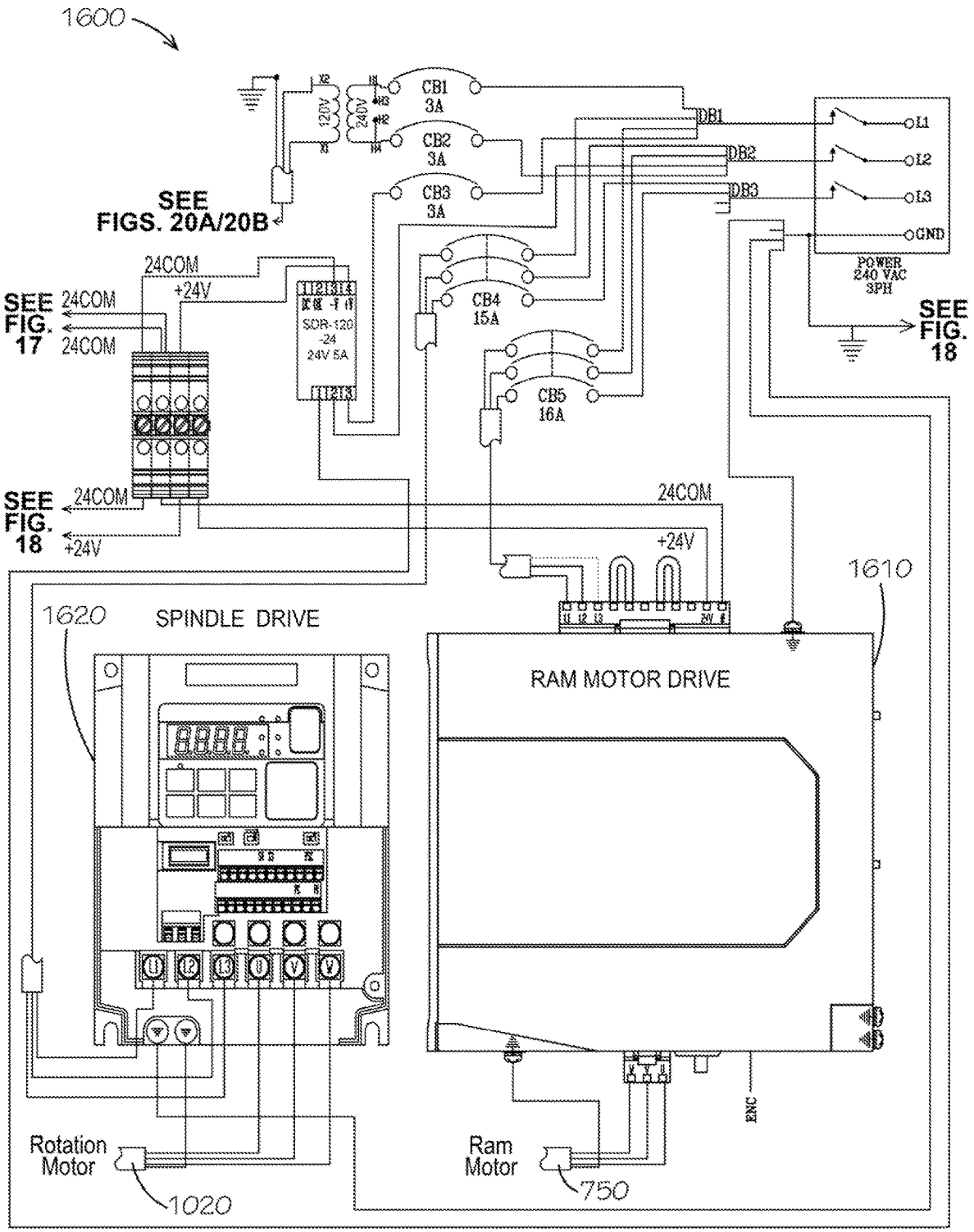
FIG. 16 is an electrical schematic of power cabinet wiring of the pipe groover of FIG. 1B.
Figure 19A:
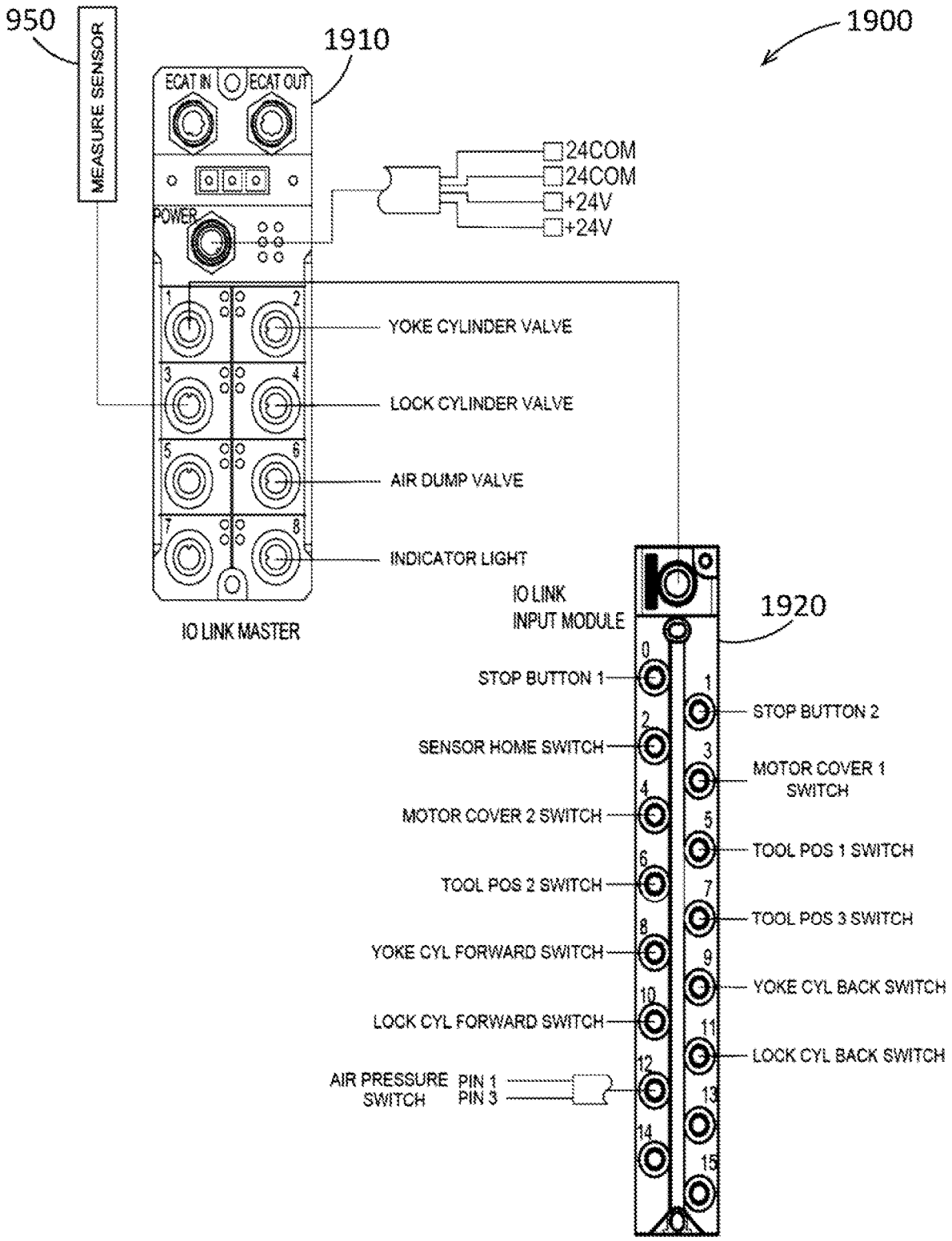
FIG. 19A is an electrical schematic of IO link wiring of the pipe groover of FIG. 1B.

FIG. 1B is a front top left perspective exploded view of the pipe groover 70 of FIG. 1B showing various assemblies of the pipe groover 70 separated from each other. The pipe groover 70 can comprise one or more of the spindle assembly 100, a yoke assembly 200, a spindle lock assembly 300, a guide wheel assembly 400, a top enclosure assembly 500, a base assembly 600, a spindle ram assembly or ram assembly 700, a pneumatic system 800, a pipe sensor assembly 900, a spindle rotation assembly 1000, a spindle position assembly 1100, and a controller assembly 1200. The pipe groover 70 can comprise a control cabinet assembly 71, which can comprise components and wiring operating at a low or control voltage (e.g., 24V), for example as shown in FIG. 19A. The pipe groover 70 can comprise a power cabinet assembly 72, which can comprise components and wiring operating at a high or power voltage (e.g., 240V), for example as shown in FIG. 16. The pipe groover 70 can comprise a stop switch 73, which can serve as an emergency stop for the pipe groover 70 and can be configured to immediately halt operation of the pipe groover 70 upon activation. The pipe groover 70 can comprise a roller motor assembly 74, which can be configured to operate one or more rollers of a roller assembly 130 (shown in FIG. 10), as will be described. The pipe groover 70 can comprise a drive shaft coupling 75, which can be configured to couple the roller motor assembly 74 to the yoke assembly 200. The roller motor assembly 74 can comprise a mount 76, which can facilitate positioning of the roller motor assembly 74 and, more specifically, can set a vertical position of the roller motor assembly 74 along the Z-axis direction. The pipe sensor assembly 900 can comprise a pipe sensor enclosure or sensor enclosure 910 and a pipe sensor shuttle assembly or shuttle assembly 920.

Any one or more of the elements of the pipe groover 70 can comprise one or more fasteners 90 or can be attached to each other or a neighboring structure with the one or more fasteners 90.

Figure 10:
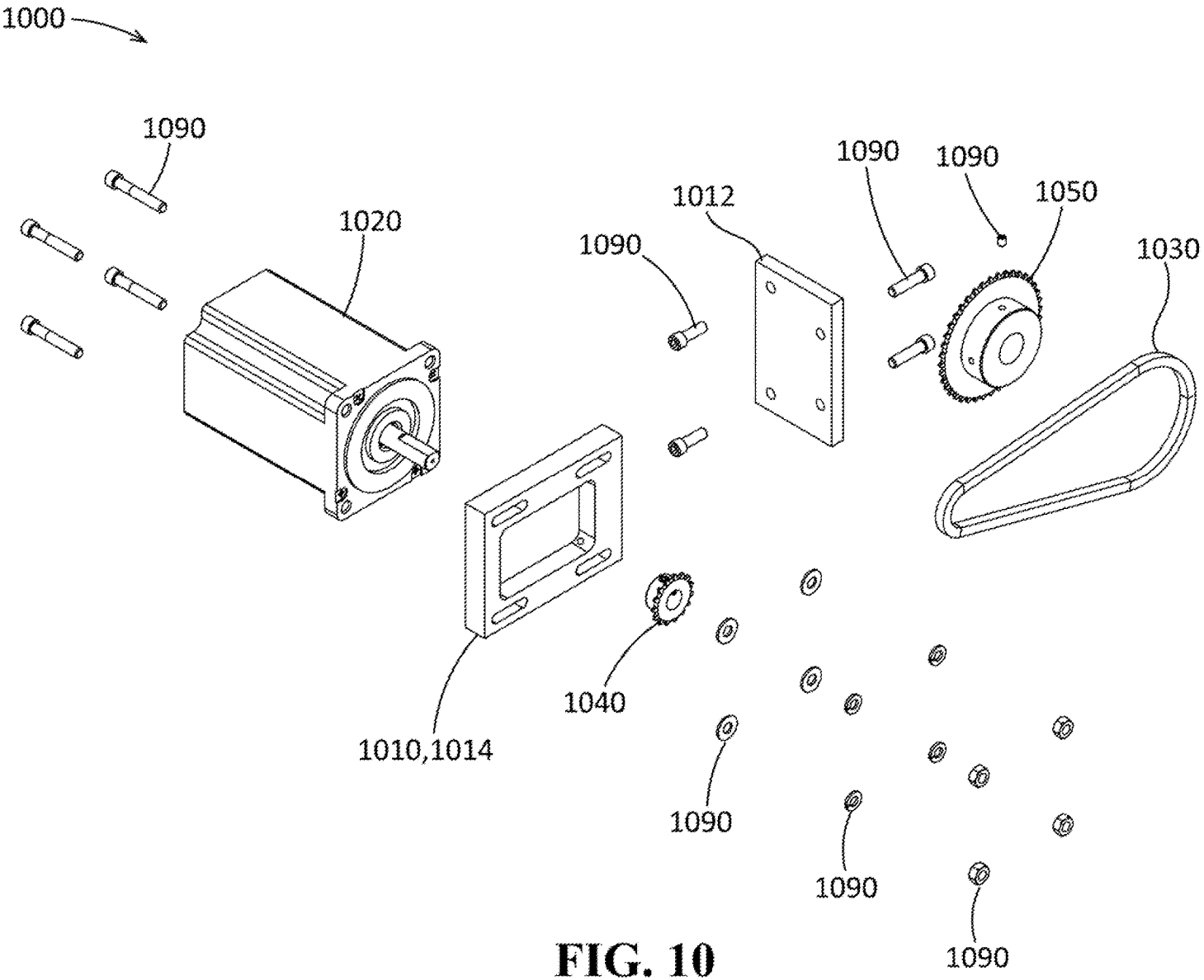
FIG. 10 is a front top left perspective exploded view of a spindle rotation assembly of the pipe groover of FIG. 1B.

FIG. 10 is a front top left perspective exploded view of the spindle assembly 100 of the pipe groover 70 of FIG. 1B. The spindle assembly or assembly 100 can comprise a spindle plate or tool head 110. The spindle assembly 100 and the spindle plate 110 can move and, more specifically, can rotate to expose different rollers of the spindle assembly 100 to a user for grooving of various sizes of the pipe 60 (shown in FIG. 1A). The spindle assembly 100 can comprise a rotation shaft assembly 120, about which the spindle plate 110 can rotate. The spindle assembly 100 can comprise one or more of a roller assembly 130, a pivot arm assembly 140, and a spindle lock bushing 170. In some aspects, the spindle assembly 100 can comprise only one each of the roller assembly 130, the pivot arm assembly 140, and the spindle lock bushing 170. In some aspects, the spindle assembly 100 can comprise a plurality of each of the roller assemblies 130, the pivot arm assemblies 140, and the spindle lock bushings 170, each of which can correspond to a single station or turret location among a plurality of such stations or locations. In some aspects, as shown, the spindle assembly 100 can comprise three each of the roller assembly 130, the pivot arm assembly 140, and the spindle lock bushing 170, which in effect can combine the features of three separate pipe groovers accommodating differing pipe sizes into the single pipe groover 70. The spindle assembly 100 can comprise a face plate assembly 150. The spindle assembly 100 can comprise a roller pin removal tool 160.

The spindle plate 110 can receive, secure, or otherwise engage with other components of the pipe groover 70 and, more specifically, the spindle assembly 100. For example and without limitation, one or more of the one or more roller assemblies 130, the one or more pivot arm assemblies 140, and the one or more spindle lock bushings 170 can be secured to the spindle plate 110. In some aspects, a shaft collar 192 can slide or clamp around a shaft 137 (shown in FIG. 1F) of the inner roller 132 and against a rear side of the spindle plate 110 as a retainer therefor. In some aspects, the face plate assembly 150 can be secured, directly or indirectly as shown, to the spindle plate 110 through corresponding openings defined therein. In some aspects, as shown, the spindle plate 110 can define a disc shape or, more specifically, a circular disc shape. In some aspects, the spindle plate 110 can define a polygonal shape. In some aspects, the spindle plate 110 can rotate about an axis of the spindle plate 110 and, more specifically, can rotate about a central axis 111 of the spindle plate, in which case the central axis 111 can define a center of the circular disc shape and a center of rotation of the circular disc. In some aspects, the axis of rotation of the spindle plate 110 need not be a center of the spindle plate 110.

In some aspects, as shown, the rotation shaft assembly 120 can comprise a front rotation shaft 121 and a rear rotation shaft 122. In some aspects, the rotation shaft assembly 120 can comprise a single rotation shaft able to support and facilitate rotation of the spindle plate 110. The rotation shaft assembly 120 can comprise one or more shaft supports 125, which can be pillow blocks, within which the respective rotation shafts 121,122 can be supported and can rotate. In some aspects, a portion of the rotation shaft assembly 120 can rotate with the spindle plate 110 during operation of the pipe groover 70 or vice versa. For example and without limitation, at least the spindle plate 110 can rotate with respect to the one or more rotation shafts 121,122 during operation of the pipe groover 70. Axes, which can be central axes, of each of the rotation shafts 121,122 and the shaft supports 125 can align with the axis 111 of the spindle plate 110. Fasteners 190, which can be bolts and can extend completely through the spindle plate 110, can secure each of the front rotation shaft 121 and the rear rotation shaft 122 to the spindle plate 110.

Each of the one or more roller assemblies 130 and, more specifically, a plurality of rollers 132,134 (shown in FIG. 1F) thereof, which can form the groove 68 in the pipe 60 (shown in FIG. 1), can be secured to the corresponding pivot arm assembly 140.

The one or more pivot arm assemblies 140 can be secured to the spindle plate 110 with a pin such as a pivot pin 143. Each of the pivot arm assemblies 140 can comprise a pivot arm 141, which can be configured to rotate about the pivot pin 143—and a pivot axis 142 (shown in FIG. 1D) defined thereby—with respect to the spindle plate 110. As shown, the pivot arm 141 can be configured to rotate in a counterclockwise direction towards the pipe 60. The pivot arm assembly 140 can comprise a roller pin 145, which can be received within a corresponding roller 134 (shown in FIG. 1F) of the roller assemblies 130. As shown, each of the pivot arms 141, the pivot pins 143, the roller pins 145, and support pins 147 can be received and secured between the spindle plate 110 and a face plate 151. In some aspects, one or more washers or spacers can be positioned between the pivot arm 141 and either or both of the spindle plate 110 and the face plate 151 to maintain a position of the components and also minimize friction therebetween. A biasing element 149 can extend between an attachment point 148 on the pivot arm 141 and an attachment point on the spindle plate 110 and can bias the pivot arm 141 away from the pipe 60 except when the pivot arm 141 is positively pushed towards the pipe 60. More specifically, the biasing element 149 can extend between one of the fasteners 190 extending through the pivot arm 141 at the attachment point 148 and one of the fasteners 190 (shown in FIG. 1D) extending through the spindle plate 110. In some aspects, the biasing element 149 can be a coil spring and, more specifically, an extension spring. The pivot arm 141 can further define a tip distal from the end defining the pivot axis 142, and the tip can comprise a roller 146 (shown in FIG. 1D). The tip can define a notch configured to receive the support pin 147, which can be a stop against which the pivot arm 141 naturally rests under a biasing force of the biasing element 149.

The face plate assembly 150 can provide another structure to which the pivot arms 141 can be secured—in addition to the spindle plate 110—and thereby can avoid the pivot arms 141 being loaded as a cantilever structure during grooving of the pipe 60. The face plate assembly 150 can define openings 154, which can be configured to receive a plurality of the fasteners 190 configured to secured the pivot arms 141 and can be configured to receive a plurality of the support pins 147. More specifically, the face plate assembly 150 can comprise the face plate 151, which can define one or more notches or recesses to substantially match a profile of the corresponding pivot arms 141 and provide clearance for insertion of the pipe 60. In some aspects, the face plate 151 can define a slot 156 extending across a center of the face plate 151 to facilitate removal of the face plate 151 with minimal disassembly of surrounding parts. In some aspects, a cover plate 155 can extend across the slot. The face plate 151 and the cover plate 155 can define roller pin access holes 158, which can permit access to and removal of the roller pins 145 from the pivot arm assemblies 140 when changing out the outer rollers 134 of any of the roller assemblies 130.

Figure 1D:
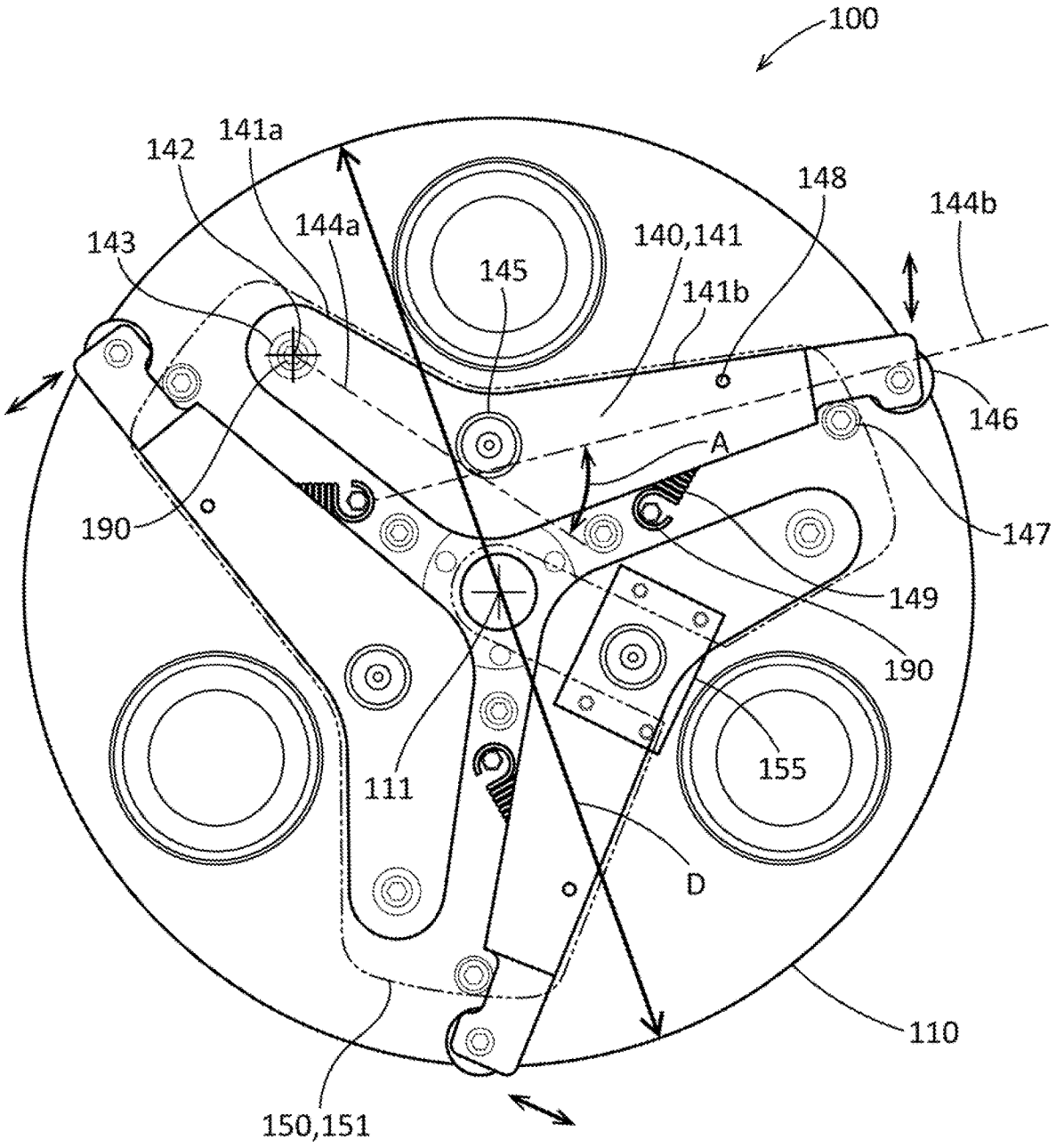
FIG. 1D is a front elevation view of a plurality of pivot arms of the spindle assembly of FIG. 10 shown positioned between the spindle plate and the face plate (shown in transparent form, i.e., in broken lines) of the face plate assembly.
Figure 1E:
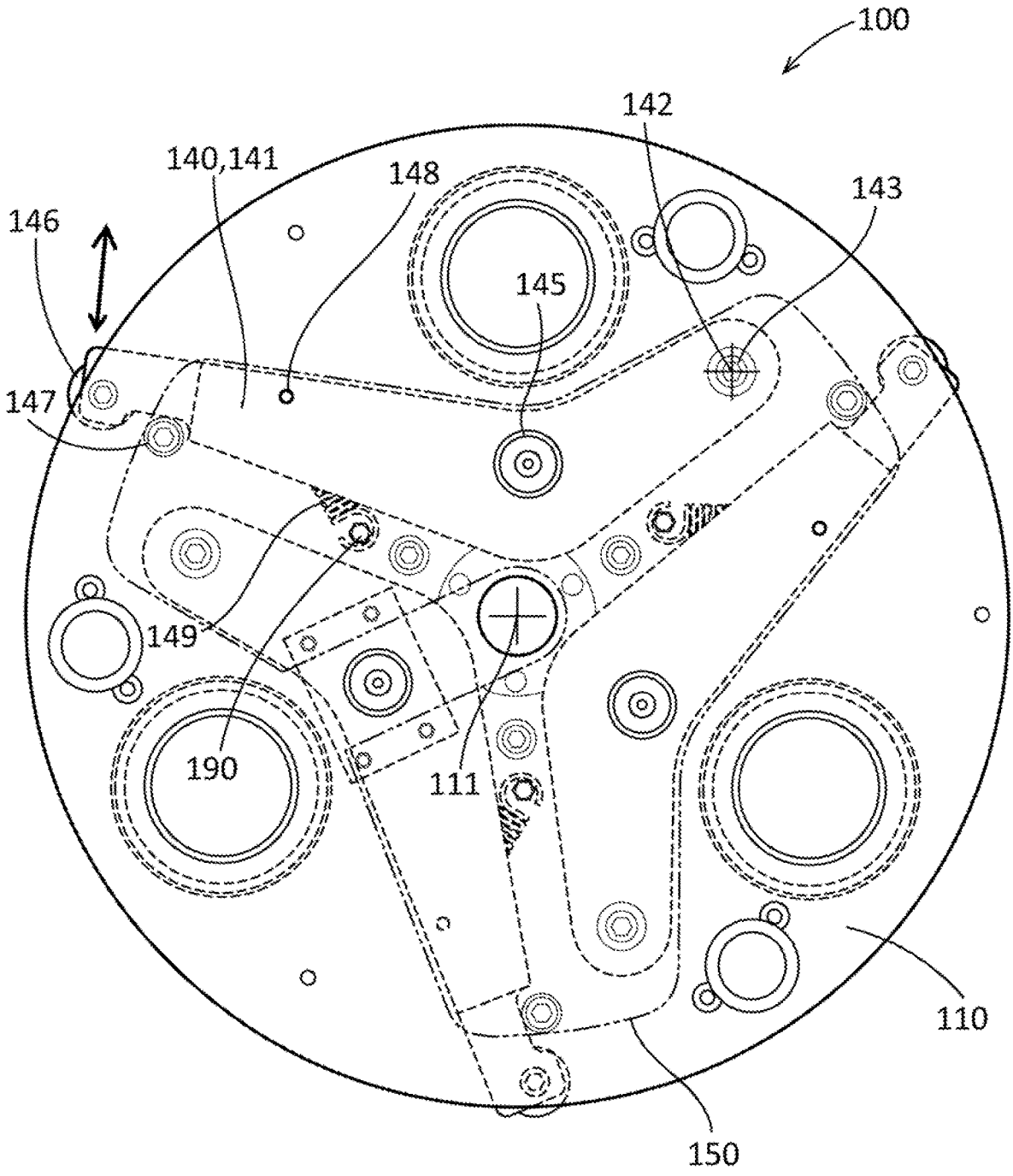
FIG. 1E is a rear elevation view of a plurality of pivot arms of the spindle assembly of FIG. 10 shown positioned between the spindle plate (shown in transparent form) and the face plate.
Figure 1F:
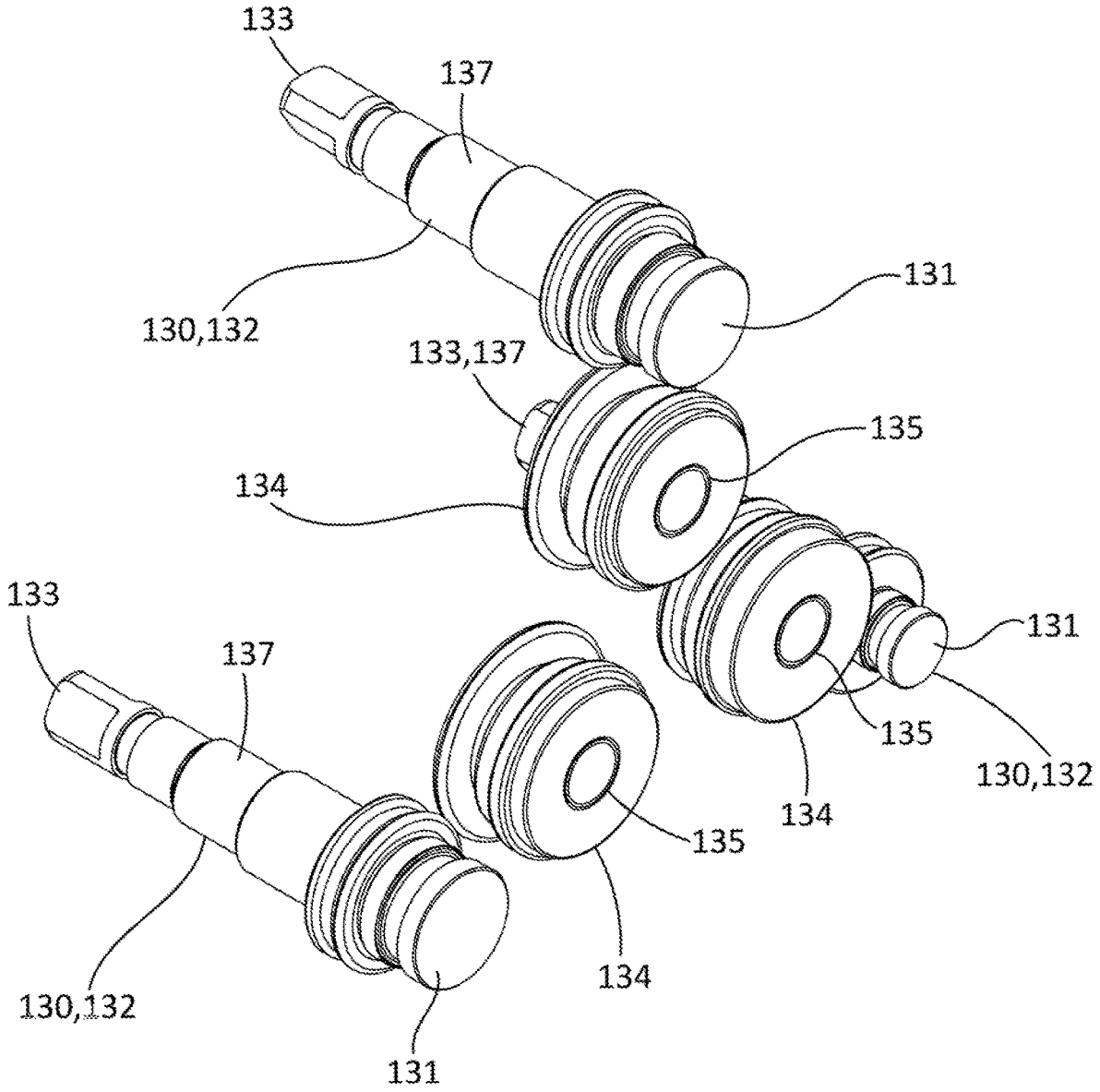
FIG. 1F is a front top left perspective view of a plurality of rollers of the pipe groover of FIG. 1B.

The roller pin removal tool 160, which can be a shaft removal tool or simply a removal tool, can be configured to be received and can be received within the roller pin 145 to facilitate removal of the roller pin 145 and the corresponding roller 134 (shown in FIG. 1F). The roller pin 145 can define a hole, which can be a threaded and/or blind hole and can be sized to receive and secure the roller pin removal tool 160. The roller pin removal tool 160, which can be a fastener such as, for example and without limitation, a bolt, can be modified, e.g., by machining at an end distal from a head thereof, to not interfere with a grease fitting 145*b* assembled to the roller pin 145 at a base of the hole. Upon assembly of the threaded roller pin removal tool 160 to the roller pin 145, the roller pin 145 can be removed in an axial direction of the roller pin 145 and the roller 134 can be removed.

Any one or more of the elements of the spindle assembly 100 can comprise one or more of the fasteners 190 or can be attached to each other or a neighboring structure with the one or more fasteners 190. For example and without limitation, one or more of the fasteners 190 can secure either or both of the front rotation shaft 121 and the rear rotation shaft 122 to the spindle plate 110 and/or to each other; one or more of the fasteners 190 can secure the shaft supports 125 to a surrounding structure; and one or more of the fasteners 190 can fasten together the aforementioned components of the pivot arm assemblies 140.

FIG. 1D is a front elevation view of the pivot arm assemblies 140 and, more specifically, a plurality of pivot arms 141 of the spindle assembly 100 of FIG. 10. As shown, the pivot arm assemblies 140 can be positioned between the spindle plate 110 and the face plate 151 of the face plate assembly 150, the latter of which is shown in transparent form. Each of the pivot arms 141 can comprise a first member 141*a* and a second member 141*b*, and an axis or centerline or bisector 144*b* of the second member 141*b* can be angled at a pivot arm angle A with respect to an axis 144*a* of the first member 141*a*. The axis 144*a* of the first member 141*a* can be defined between the pivot axis 142 and an axis defined by the roller pin 145 or, alternatively as shown, by simply bisecting main outer edges of the first member 141*a*; and the axis 144*b* of the second member 141*b* can be defined between the pivot axis 142 and an axis defined by the roller at the top (e.g., the roller pin 145) or, alternatively as shown, by simply bisecting main outer edges of the second member 141*b*. By angling the second member 141*b* with respect to the first member 141*a*, each of the pivot arms 141 can avoid interference with the corresponding roller assembly 130 and minimize a diameter D of the spindle plate 110.

FIG. 1E is a rear elevation view of the pivot arm assemblies 140 showing the plurality of pivot arm assemblies 140 of the spindle assembly 100 of FIG. 10 again shown positioned between the spindle plate 110, which is now shown in transparent form together with most of the pivot arm assemblies 140, and the face plate 151.

FIG. 1F is a front top left perspective view of the roller assemblies 130 of the pipe groover 70 of FIG. 1B. Each of the roller assemblies 130 can comprise a top or inner roller 132, which can be or can form a roller/bushing assembly, and a bottom or outer roller 134, which can be sized to mate with the respective inner roller 132. The inner roller 132 and the respective outer roller 134 can be sized and otherwise configured to receive and engage the pipe 60 (shown in FIG. 1A) and form the groove 68 (shown in FIG. 1A) in the pipe 60. In some aspects, as shown, each of the three roller assemblies 130 can accommodate 2" to 6" steel pipe, 8" to 12" steel pipe, and 14" to 16" steel pipe, respectively. Accordingly, the three roller assemblies 130 can accommodate three different ranges of pipe sizes and/or materials or can otherwise be combined to form grooves in pipes 60 otherwise requiring two or more different roller assemblies 130. Other roller sizes or combinations thereof can be used as desired depending on the pipes to be grooved.

The relationship between each inner roller 132 and the respective outer roller 134 can be generally seen in and is described in greater detail with respect to FIG. 15, but as an initial matter each of the outer rollers 134 can define a roller bore 135 sized to receive the corresponding roller pin 145 of the pivot arm assembly 140. Each of the inner rollers 132 can comprise or define the roller shaft 137 sized to be received within and through the spindle plate 110 and be driven on a rear side of the spindle plate 110 at a drive end 133 of the inner roller 132 distal from a working end 131 configured to form the groove 68 in the pipe 60. In some aspects, the roller shaft 137 can define a cylindrical shape in cross-section on one or both ends. In some aspects, the roller shaft 137 can define a non-cylindrical shape in cross-section and, more specifically, an anti-rotation feature on one or both ends. In some aspects, as shown, the roller shaft 137 can define a cylindrical shape in cross-section on the working end 131 and a non-cylindrical shape on the drive end 133. More specifically, as shown, the drive end 133 can define one or more flats or other anti-rotation features, which can be other than flats such as, for example and without limitation, a slot, key, or other protrusion or depression in a surface of the roller shaft 137. The inner rollers 132 of the roller assemblies 130 can be received within roller bores 112 (shown in FIG. 1G) defined within the spindle plate 110 (shown in FIG. 1G), and the outer rollers 134 can be assembled to the corresponding pivot arm assemblies 140 (shown in FIG. 1D). Anti-friction elements 136,138 (shown in FIG. 10), which in some aspects can be bearings and, more specifically, ball bearings as shown, can be received within the roller bores 112, and the rollers 132,134 can be received within the anti-friction elements 136,138. Each of the roller assemblies 130 can be configured to be interchangeable with any other roller assembly 130, such than any combination of roller assemblies 130 can be assembled in the spindle assembly 100. Each of the roller assemblies 130 can be marked with visible indicia indicating to a user of the pipe groover 70 a size or range of sizes of the pipe 60 compatible therewith.

Figure 1G:
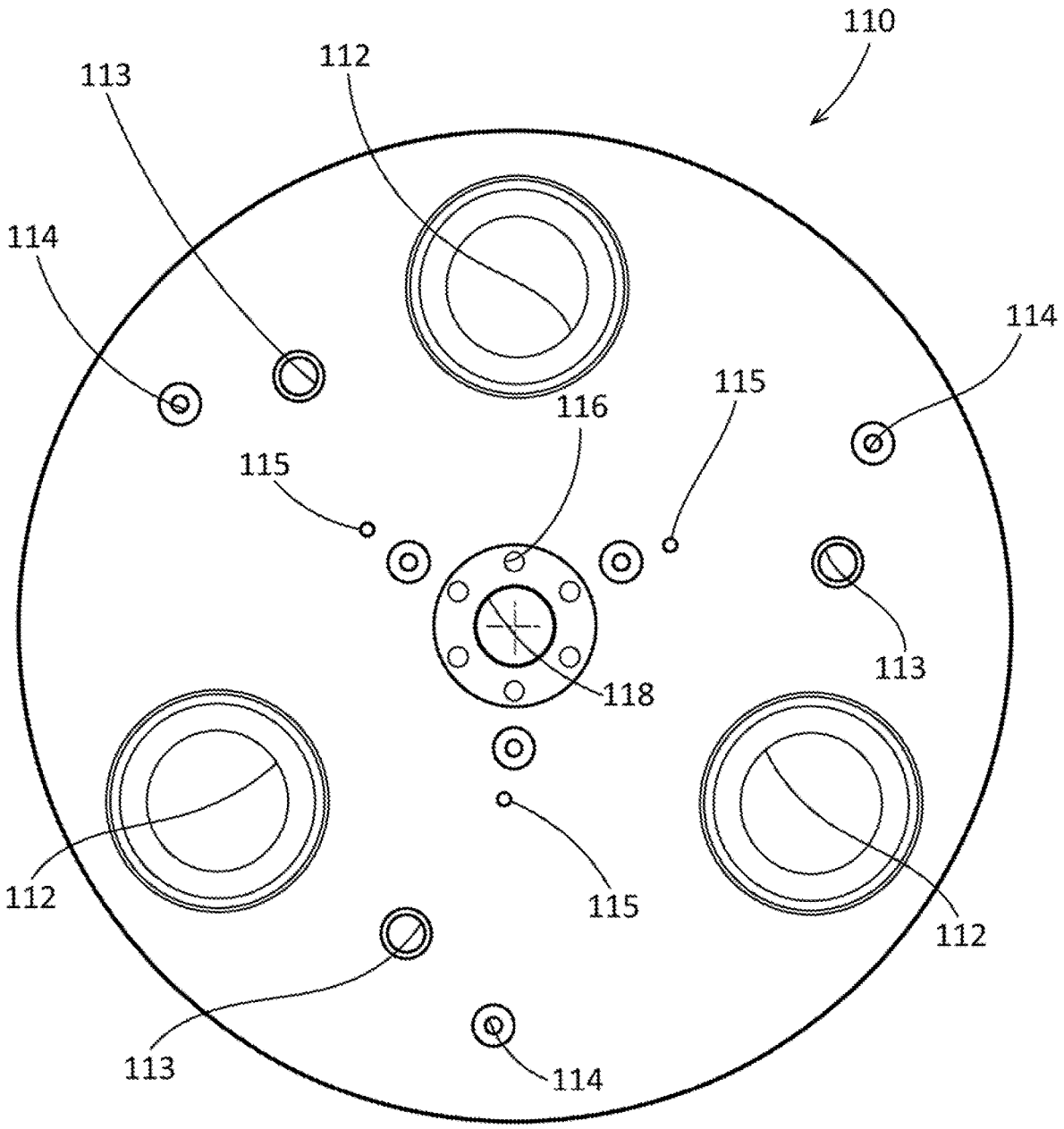
FIG. 1G is a front elevation view of a spindle plate of the spindle assembly of FIG. 10.

FIG. 1G is a front elevation view of the spindle plate 110 of the spindle assembly 100 of FIG. 10. The spindle plate 110 can define one or more holes, bores, or other openings for securing or engaging with other components of the pipe groover 70 (shown in FIG. 1A) and, more specifically, the spindle assembly 100. Again, the spindle plate 110 can define the roller bores 112, which can receive the anti-friction elements 136 and/or the inner rollers 132. The spindle plate 110 can define pivot pin bores 113, which can receive the pivot pins 143 about which the pivot arms 141 can rotate. The spindle plate 110 can define support pin bores 114, which can receive the support pins 147 against which the pivot arms 141 can stop or remain in a disengaged position. The spindle plate 110 can define biasing element attachment bores 115, which can receive the fasteners 190 securing the corresponding biasing elements 149 (shown in FIG. 1D). The spindle plate 110 can define rotation shaft attachment bores 116, which can receive the fasteners 190 securing the rotation shafts 121,122 (shown in FIG. 10). The spindle plate 110 can define a main bore 118, which can receive a portion of the rotation shaft assembly 120 such as, for example and without limitation, the rotation shafts 121,122. Other bores can secure the three fasteners securing the face plate 151 to the spindle plate 110 in some aspects.

Figure 1H:
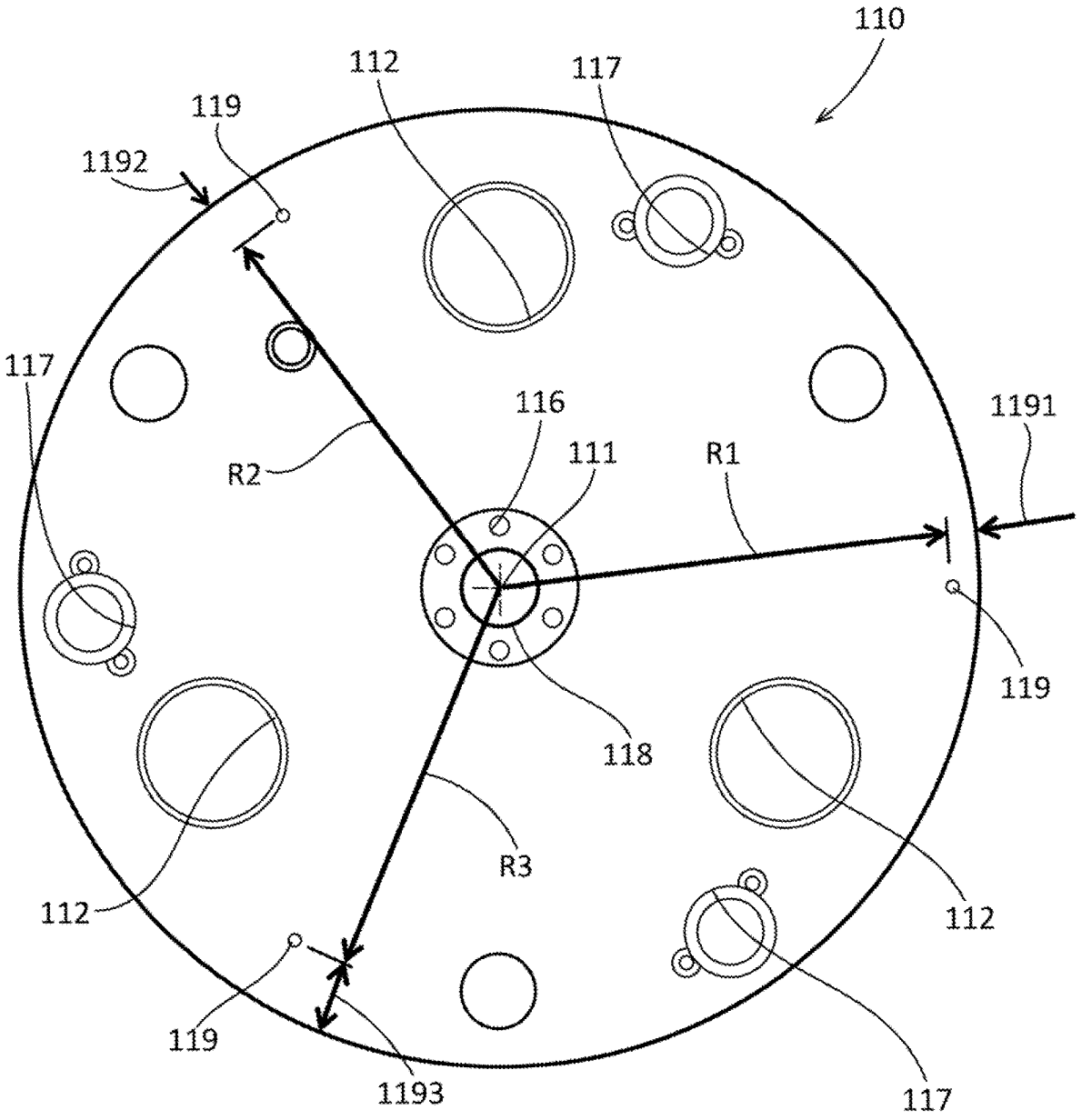
FIG. 1H is a rear elevation view of the spindle plate of FIG. 1E.

FIG. 1H is a rear elevation view of the spindle plate 110 of FIG. 1E. On a rear side, the spindle plate 110 can define one or more holes, bores, or other openings for securing or engaging with other components of the pipe groover 70. Again, the spindle plate 110 can define the roller bores 112, which can receive the anti-friction elements 138 and/or the inner rollers 132. The spindle plate 110 can define bushing bores 117, which can receive the spindle lock bushings 170. The spindle plate 110 can define proximity fastener bores 119, which can receive proximity fasteners or fasteners (not shown) for triggering one or more proximity sensors of the spindle position assembly 1100. In some aspects, the proximity fasteners can be ferritic or magnetic or can otherwise be configured to trigger or activate a proximity switch such as a proximity switch 1120 (shown in FIG. 11). As shown, a radial distance R1, R2, R3 to each of the proximity fastener bores 119 and a radial distance 1191, 1192, 1193 from each of the proximity fastener bores 119 to the outer edge of the spindle plate 110 can vary at each of the three tool locations.

Figure 2:
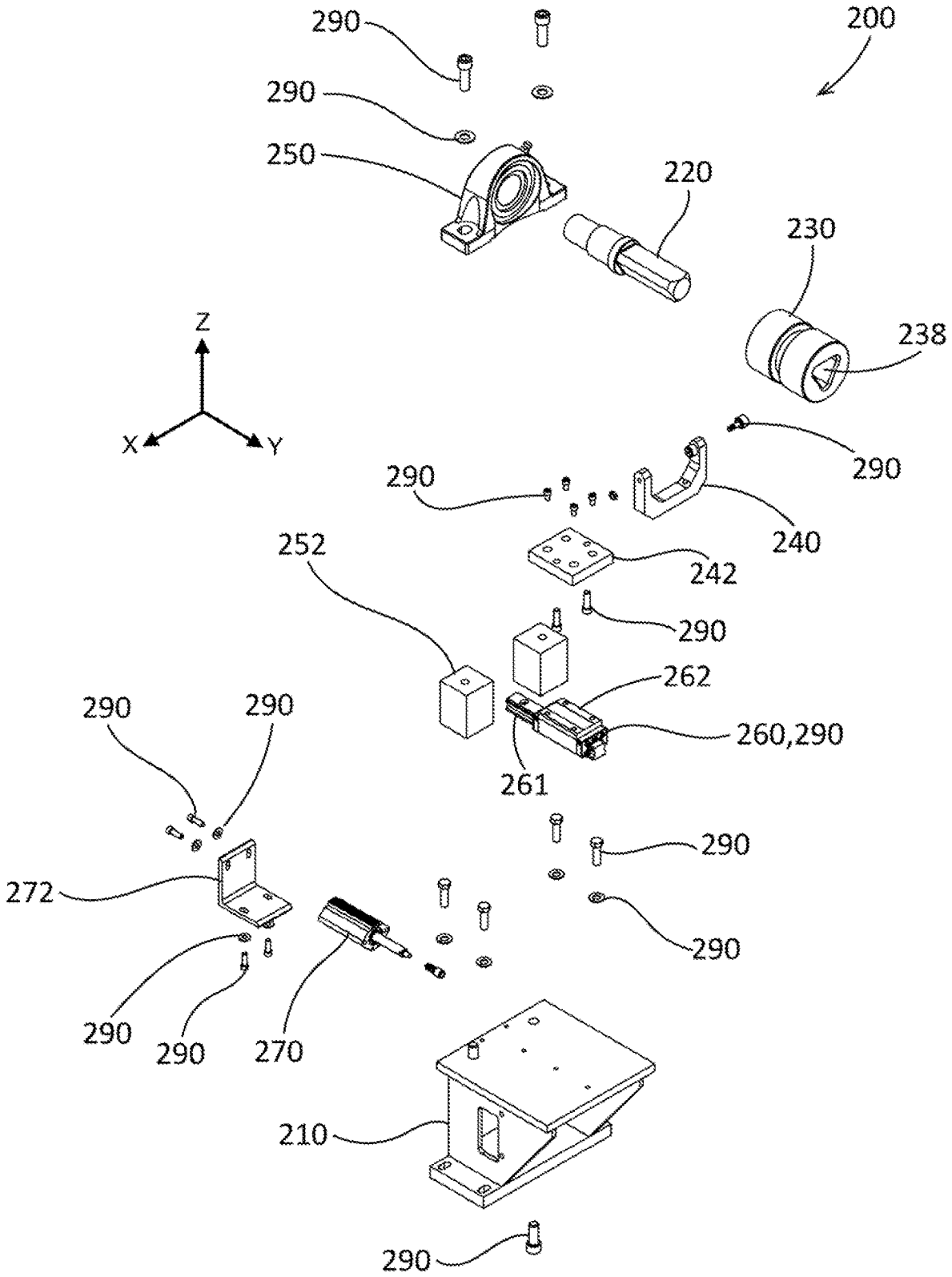
FIG. 2 is a front top left perspective exploded view of a yoke assembly of the pipe groover of FIG. 1B.

FIG. 2 is a front top left perspective exploded view of the yoke assembly 200 of the pipe groover 70 of FIG. 1B. The yoke assembly 200 can comprise a yoke mount 210. The yoke assembly 200 can comprise a roller rotation slide shaft 220, which can selectively transfer rotational movement of a roller motor of the roller motor assembly 74 (shown in FIG. 1B) to the drive end 133 of the inner roller 132 upon engagement therewith and, more directly, to a slide coupling 230, which can be a spindle shaft coupling. The yoke mount 210 can facilitate positioning of the roller rotation slide shaft 220 and, more specifically, can set a vertical position of the roller rotation slide shaft 220 along the Z-axis direction. The yoke assembly 200 can comprise the slide coupling 230, which can define a shaft receiver cavity 238 therein configured to receive the roller shaft 137 and can, upon engagement with the roller shaft 137 of the inner roller 132, transfer rotational movement of the roller rotation slide shaft 220 to the roller shaft 137 and thereby also to the inner roller 132. The yoke assembly 200 can comprise a coupling yoke 240, which can support and maintain a position of the slide coupling 230 in one or more (as shown, three) dimensions relative to a slide plate 242 or other structure to which the coupling yoke 240 can be secured. The yoke assembly 200 can comprise a rotation slide shaft support 250, which can support and maintain a position of the roller rotation slide shaft 220 in one or more (as shown, two) dimensions relative to the yoke mount 210. In some aspects, one or more spacers 252 can be positioned between yoke mount 210 and the rotation slide shaft support 250 to lift the rotation slide shaft support 250 and provide additional vertical space for a rail assembly 260 on which and by which the coupling yoke 240 can slide. The yoke assembly 200 can comprise the rail assembly 260, which can comprise a stationary portion 261 secured to the yoke mount 210 and a sliding portion 262 slidably secured to the stationary portion 261. The rail assembly 260 can move the coupling yoke 240 selectively towards the spindle plate 110 to engage with the roller shaft 137 and away from the spindle plate 110 to disengage from the roller shaft 137. The yoke assembly 200 can comprise a cylinder 270, which can be a pneumatic cylinder and can drive movement of the sliding portion 262 of the rail assembly 260 relative to the stationary portion 261. In some aspects, the cylinder 270 can be mounted to the yoke mount 210 with a cylinder mount 272, which as shown can be an angle or "L" bracket.

Any one or more of the elements of the yoke assembly 200 can comprise one or more fasteners 290 or can be attached to each other or a neighboring structure with the one or more fasteners 290. For example and without limitation, the fasteners 290 can secure the yoke mount 210 to a surface of the base assembly 600 (shown in FIG. 1B) to which it is mounted; the fasteners 290 can secure each of the rotation slide shaft support 250 and the cylinder 270 to the yoke mount 210; the fasteners 290 can fastener the slide coupling 230 to the coupling yoke 240; and the fastener 290 can adjust flow to and from the cylinder 270.

Figure 3:
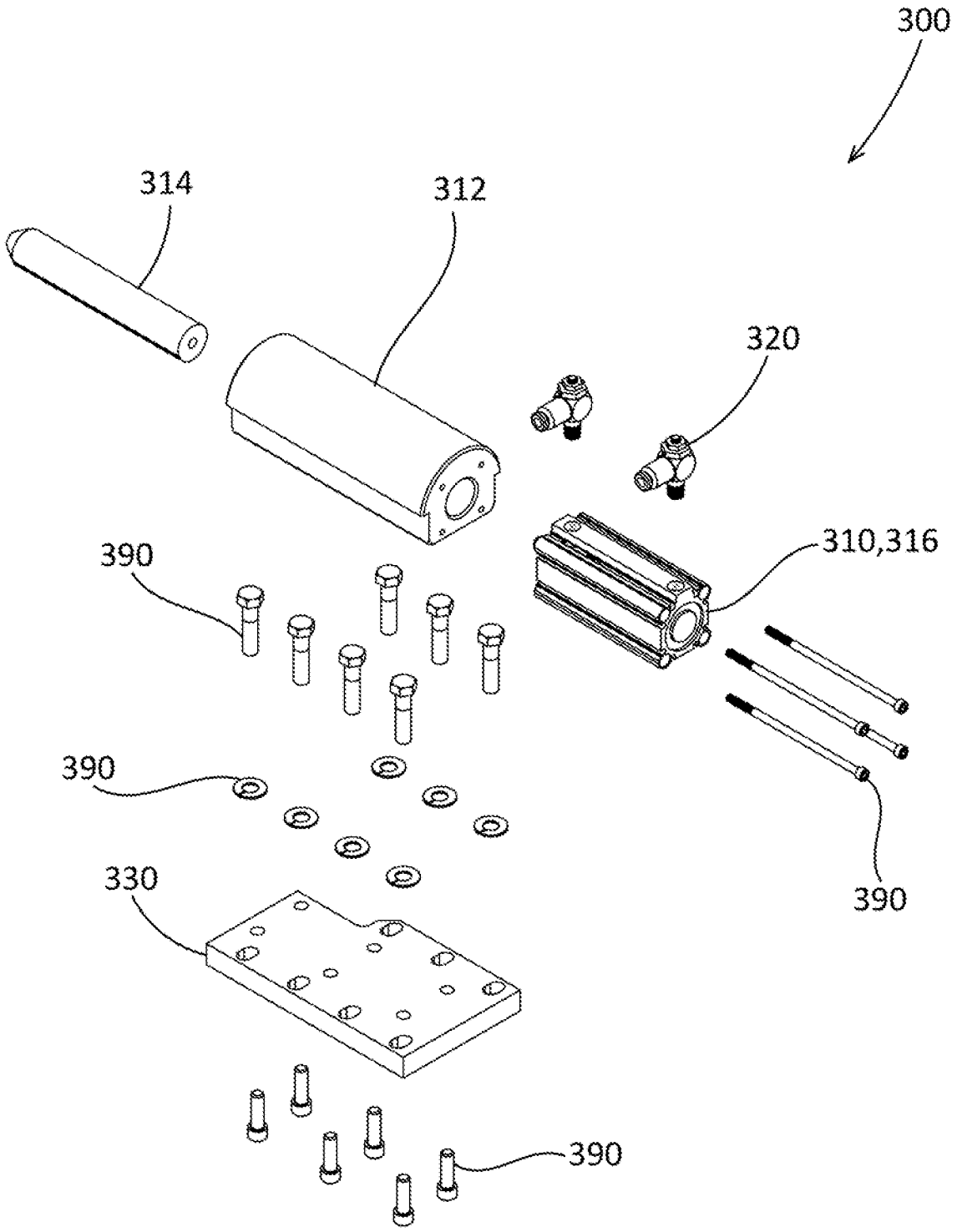
FIG. 3 is a rear top right perspective exploded view of a spindle lock assembly of the pipe groover of FIG. 1B.

FIG. 3 is a rear top right perspective exploded view of the spindle lock assembly 300 of the pipe groover 70 of FIG. 1B. The spindle lock assembly 300 can comprise a cylinder assembly 310, which can comprise a housing 312, a rod 314, and a cylinder 316. The spindle lock assembly 300 can comprise one or more fittings 320, which can route and, as desired, regulate pressurized air to and from the cylinder assembly 310 from a source of pressurized air. The spindle lock assembly 300 can comprise a mount 330, which can comprise a plate and can be positioned between the cylinder assembly 310 and the base assembly 600 (shown in FIG. 1B).

Any one or more of the elements of the spindle lock assembly 300 can comprise one or more fasteners 390 or can be attached to each other or a neighboring structure with the one or more fasteners 390. For example and without limitation, the fasteners 390 can secure the mount 330 to each of the housing 312 and the base assembly 600, and the fasteners 390 can secure the components of the cylinder assembly 310 to each other.

Figure 4:
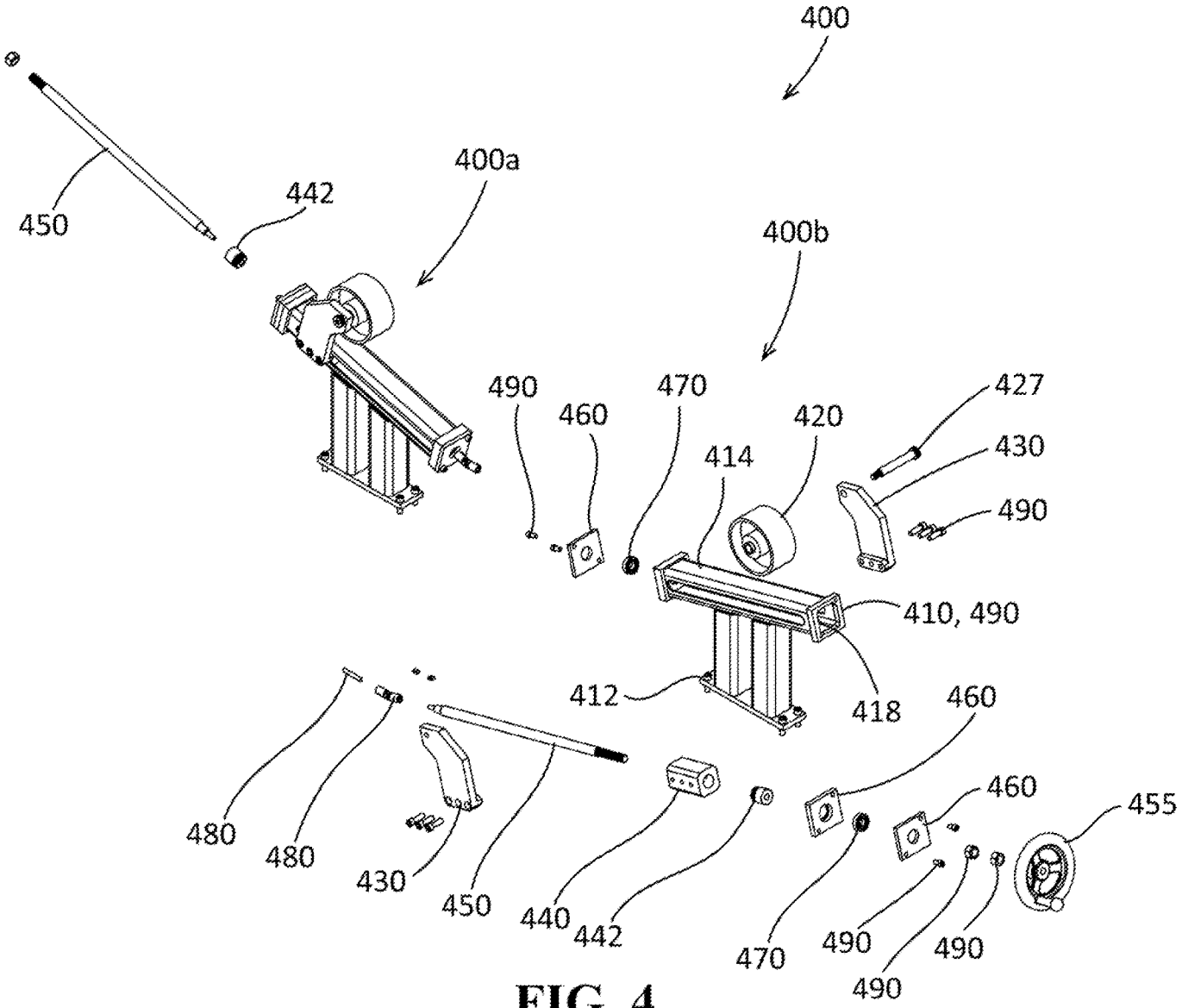
FIG. 4 is a front top right perspective exploded view of a guide wheel assembly of the pipe groover of FIG. 1B.

FIG. 4 is a front top right perspective exploded view of the guide wheel assembly 400 of the pipe groover 70 of FIG. 1B. In some aspects, the guide wheel assembly 400 can comprise a single guide wheel support 400*a*. In some aspects, as shown, the guide wheel assembly 400 can comprise two guide wheel supports 400*a,b*. In any case, the one or more guide wheel supports 400*a,b* can support a bottom surface of the pipe 60 (shown in FIG. 1A). More specifically, the one or more guide wheel supports 400*a,b* can sufficiently support a bottom surface of the end 65 (shown in FIG. 1A) of the pipe 60 and thereby maintain a position of an end of the pipe 60 whether or not the pipe 60 is engaged with and/or locked in the active roller assembly 130 or otherwise supported.

Either or both of the guide wheel supports 400*a,b* can comprise a guide wheel mount 410, which can be or can comprise a frame. A base 412 of the guide wheel mount 410 can be configured to be secured to the base assembly 600 (shown in FIG. 1B) or other surrounding structure. A riser 414 of the guide wheel mount 410 can be configured to slidably support a support roller or guide wheel or wheel 420 of the guide wheel support 400*a,b*. The riser can be a guide tube and can define a rectangular cross-section or, more specifically, a square cross-section as shown. The riser 414 can define a cavity 418, which can be open at one or both longitudinal ends and at one or both lateral sides thereof and can also define a substantially rectangular and/or square cross-section. Being open at one or both of the longitudinal ends as shown can facilitate assembly and insertion in the cavity 418 of one or more components facilitating positioning of the wheel 420. The riser 414 can be angled with respect to the base 412 and can be inclined or sloped with respect to a horizontal orientation of the pipe groover 70.

In some aspects, as shown, the wheel 420 can be secured to a support plate 430 on both sides, and each of the support plates 430 can be secured to a nut mount 440. The nut mount 440 can itself define a substantially rectangular and/or square cross-section and can be sized to slide within the cavity 418 of the riser 414 of the guide wheel mount 410. The fasteners 490 can secure the support plates 430 to the nut mount 440 and can extend through openings, which can be slots, defined in the lateral sides of the riser 414. The wheel 420 can rotate about its axis and be supported and its movement constrained by an axle 427 extending between the support plates 430.

Additional components of each guide wheel support 400*a,b* can facilitate movement of the nut mount 440, and thereby also the wheel 420, in a longitudinal direction along the riser 414. Each guide wheel support 400*a,b* can comprise an adjustment screw 450, which can extend through a bore defined in the nut mount 440 in a longitudinal direction thereof. Each guide wheel support 400*a,b* can comprise a nut 442, which can be an Acme nut and can be positioned in the bore of the nut mount 440 and facilitate movement of the nut mount 440 along the adjustment screw 450 in the longitudinal direction during rotation of the adjustment screw 450. Each guide wheel support 400*a,b* can comprise bearing plates, end plates, or end caps 460, which can substantially close or cap an opening of the riser 414 at either or both of a first end and a second end of the riser 414. Each guide wheel support 400*a,b* can comprise anti-friction elements 470, which can be bearings and can facilitate smooth rotation of the adjustment screw 450 at one or both ends of the riser 414. The adjustment screw 450 can be configured to remain stationary in an axial or longitudinal direction by causing the adjustment screw 450 to seat or bear against one of the anti-friction elements 470 or otherwise be fixed in the longitudinal direction with respect to the anti-friction elements 470.

The wheels 420 of the guide wheel supports 400*a,b* can move or, more specifically, slide up and down the riser 414 of the guide wheel mount 410, which can adjust a distance between the wheels 420 and the pipe 60 and bring the wheels 420 in contact with the pipe 60. Such movement can be facilitated by a handle 455, which can be secured to the adjustment screw 450. In some aspects, as shown, the handle 455 can be a hand wheel. In some aspects, the handle 455 can be a lever. A union joint assembly 480, which can comprise a union joint and union joint shaft, can be secured to a second end of each riser 414 and the guide wheel supports 400*a,b* can be joined by direct or indirect joining (for example, through an intermediate member) of the corresponding union joint assemblies 480. By joining the guide wheel supports 400*a,b*, a single instance of the handle 455 can operate both of the guide wheel supports 400*a,b*.

Any one or more of the elements of the guide wheel assembly 400 can comprise one or more fasteners 490 or can be attached to each other or a neighboring structure with the one or more fasteners 490.

Figure 5:
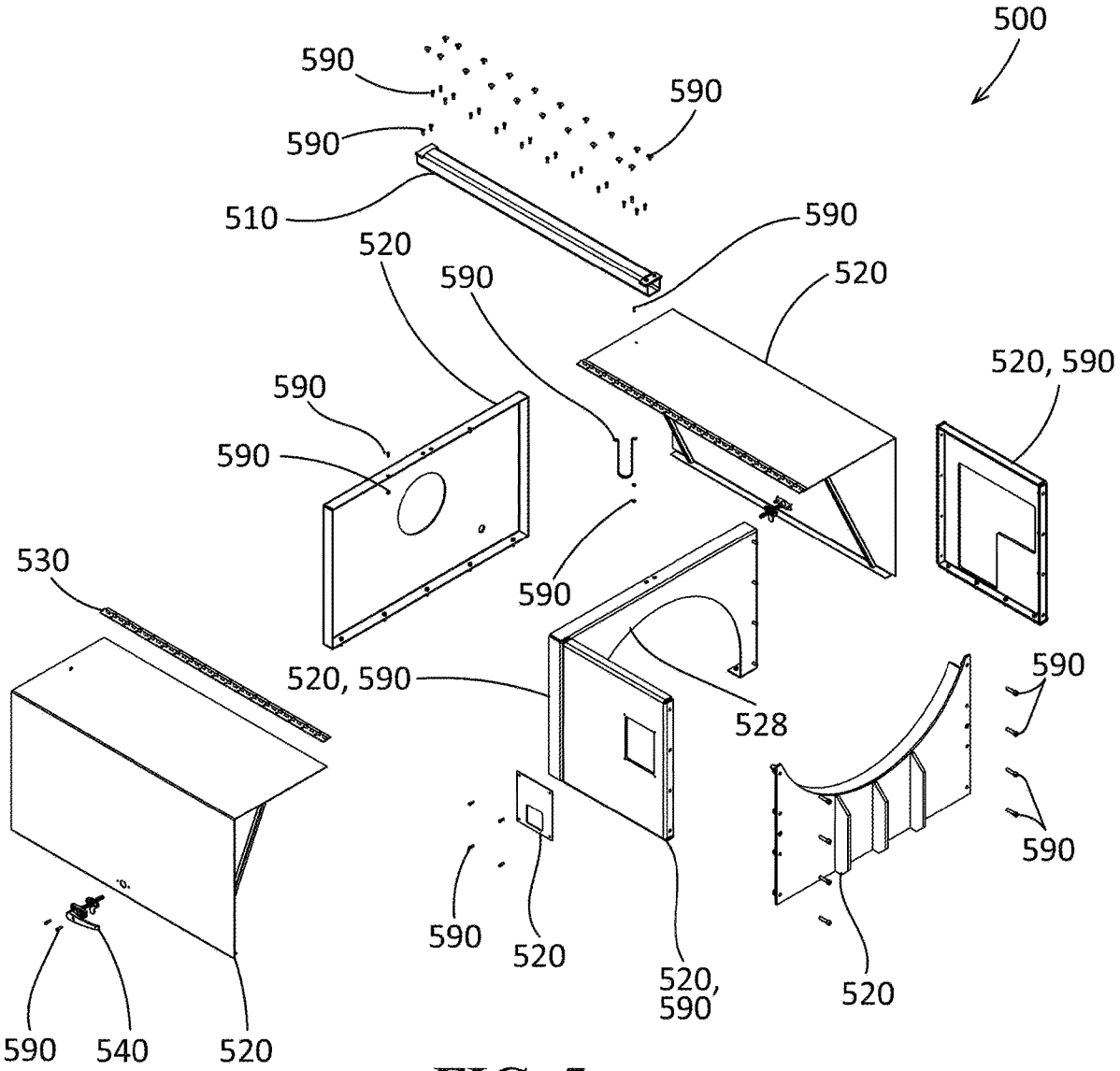
FIG. 5 is a front top left perspective exploded view of a top enclosure assembly of the pipe groover of FIG. 1B.

FIG. 5 is a front top left perspective exploded view of the top enclosure assembly 500 of the pipe groover 70 of FIG. 1B. The top enclosure assembly 500 can comprise one or more structural members 510, each of which can be a frame member and can provide reinforcement of other components such as panels 520 or the pipe groover 70 more generally and/or can provide a surface against which other components can be secured or rested. The top enclosure assembly 500 can comprise one or more of the panels 520, which can be plates or doors and can define openings 528 therein. In some aspects, one or more of the panels 520 or, more generally, the top enclosure assembly 500 can comprise a hinge 530 or be joined to surrounding structure with the hinge 530. In some aspects, the panels 520 can be otherwise configured to move out of position to provide access to some portion of the pipe groover 70 without being completely removed. In some aspects, the panels 520 can be configured to not be removable during normal operation of the pipe groover 70. The top enclosure assembly 500 can comprise one or more handles 540, which can facilitate securing, closing, and/or locking of one or more of the panels 520.

Any one or more of the elements of the top enclosure assembly 500 can comprise one or more fasteners 590 or can be attached to each other or a neighboring structure with the one or more fasteners 590.

Figure 6A:
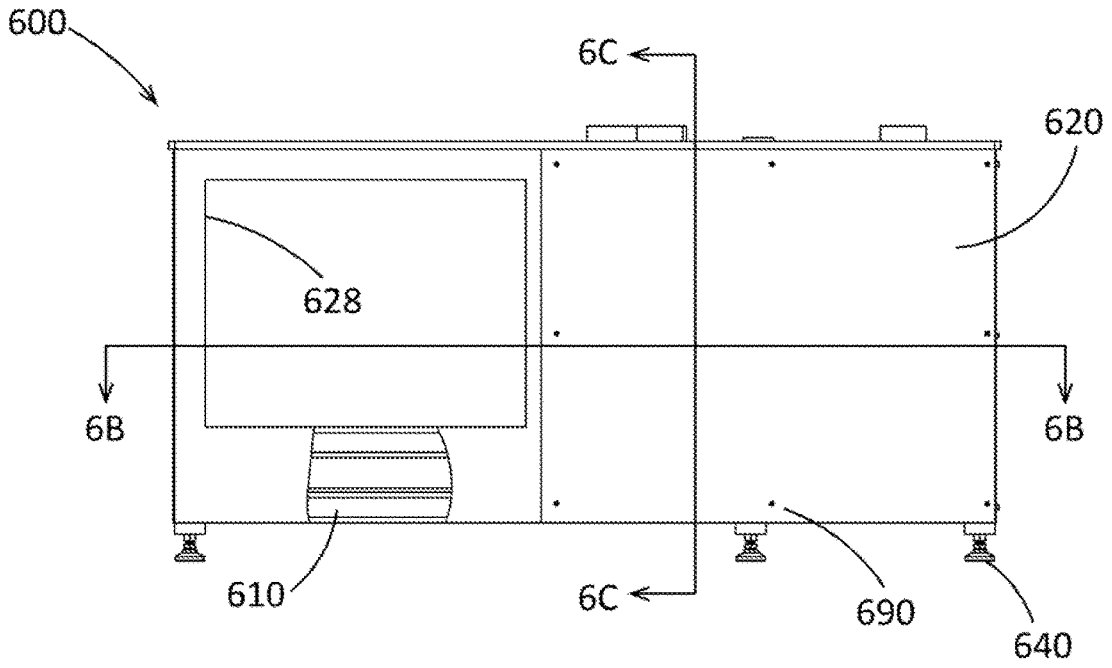
FIG. 6A is a partial cutaway left side elevation view of a base assembly of the pipe groover of FIG. 1B.
Figure 6B:
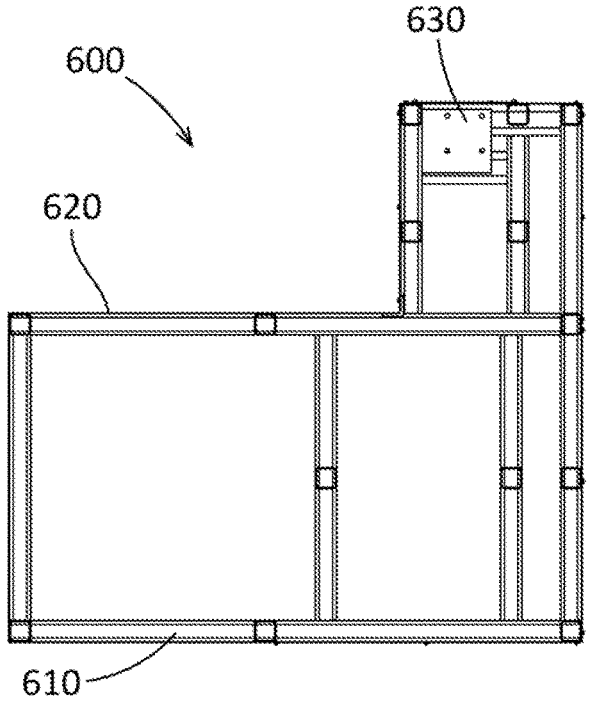
FIG. 6B is a top sectional view of the base assembly of FIG. 6A taken along line 6B-6B of FIG. 6A.
Figure 6C:
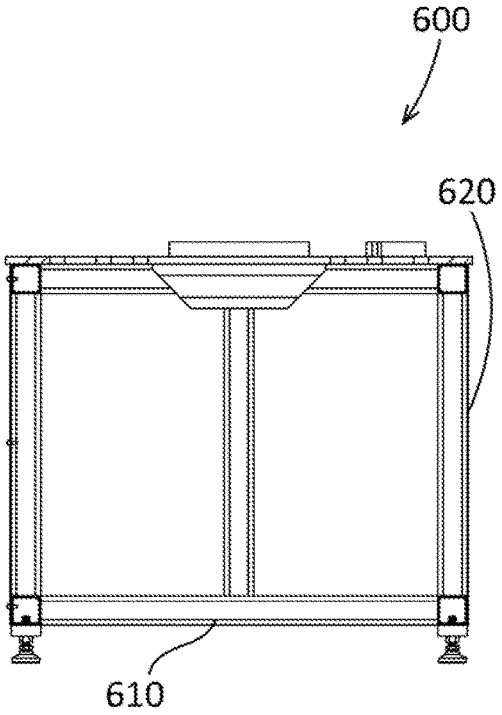
FIG. 6C is a front sectional view of the base assembly of FIG. 6A taken along line 6C-6C of FIG. 6A.

FIG. 6A is a partial cutaway left side elevation view of a base assembly 600 of the pipe groover 70 of FIG. 1B. FIG. 6B is a top sectional view taken along line 6B-6B of FIG. 6A, and FIG. 6C is a front sectional view of the base assembly 600 of FIG. 6A taken along line 6C-6C of FIG. 6A. The base assembly 600 can comprise one or more structural members 610, each of which can be a frame member and can provide reinforcement of other components such as panels 620 or the pipe groover 70 more generally and/or can provide a surface against which other components can be secured or rested. In some aspects, the structural members 610 can be joined together in frames, which can be joined with separate fasteners or simply welded into one piece. The base assembly 600 can comprise one or more of the panels 620, which can be plates or doors and can define openings 628 therein. In some aspects, one or more of the panels 620 can comprise a hinge or be joined to surrounding structure with the hinge. In some aspects, the panels 620 can be otherwise configured to move out of position to provide access to some portion of the pipe groover 70 without being completely removed. In some aspects, the panels 620 can be configured to not be removable during normal operation of the pipe groover 70. The base assembly 600 can comprise one or more handles (not shown), which can facilitate securing closing and/or locking of one or more of the panels 620. The base assembly 600 can comprise one or more reinforcement plates 630 (shown in FIG. 6B), which can be installed on one or both sides of one of the panels 620 for reinforcement of same and/or to provide a thicker mounting structure for components of the pipe groover 70. The base assembly 600 can comprise one or more legs and/or feet 640 to lift, stabilize, and/or adjust a vertical position of the base assembly 600 and, more generally, the pipe groover 70.

Any one or more of the elements of the base assembly 600 can comprise one or more fasteners 690 or can be attached to each other or a neighboring structure with the one or more fasteners 690.

Figure 7:
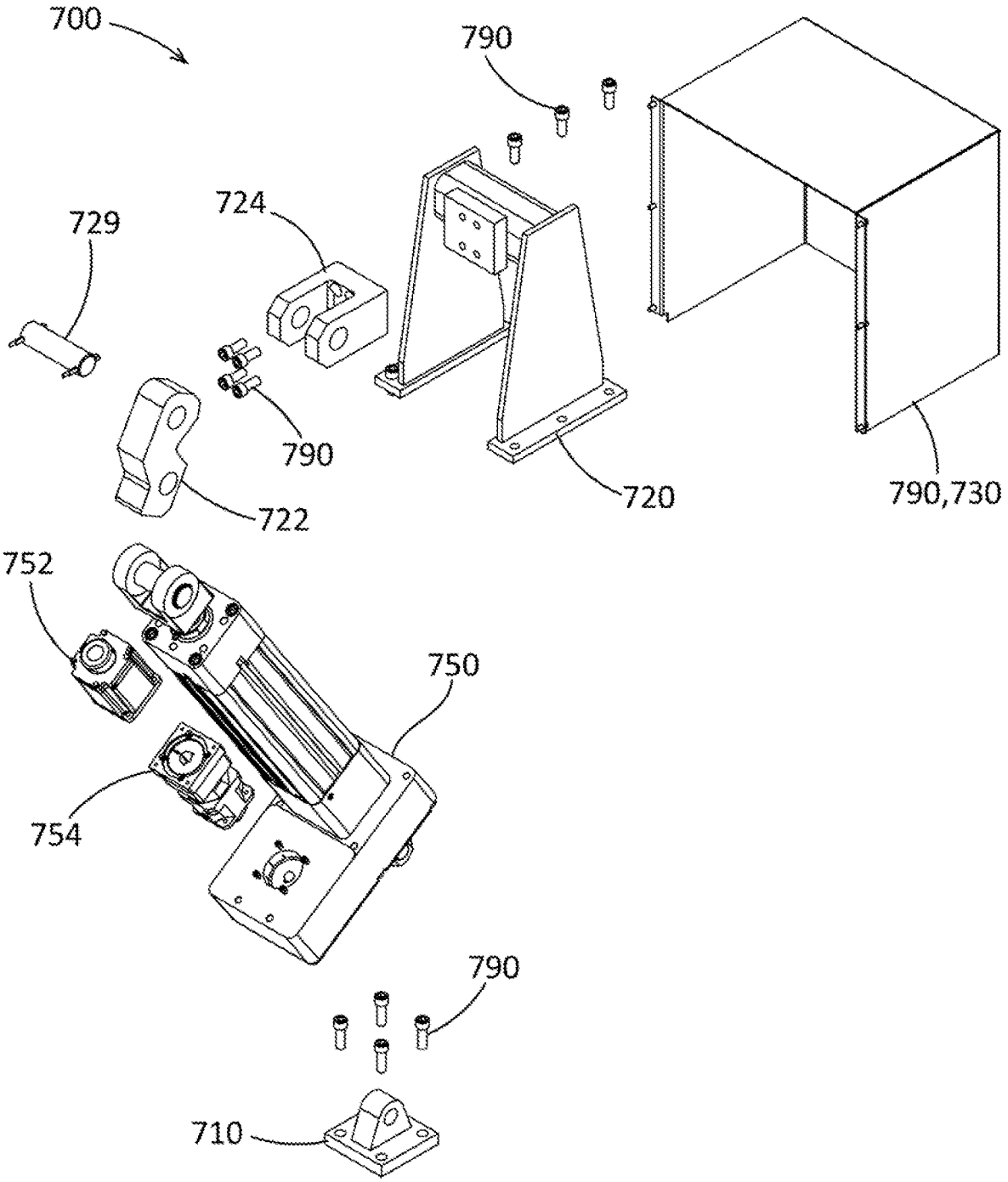
FIG. 7 is a front top left perspective exploded view of a spindle ram assembly of the pipe groover of FIG. 1B.

FIG. 7 is a front top left perspective exploded view of the spindle ram assembly 700 of the pipe groover 70 of FIG. 1B. The spindle ram assembly 700 can comprise an actuator 750. The actuator 750 can be secured to a lower or first mount 710 and an upper or second mount 720. For example and without limitation, either or both of the first mount 710 and the second mount 720 can be secured to the base assembly 600 (shown in FIG. 6). In some aspects, the actuator 750 can be pivotably secured to either or both of the first mount 710 and the second mount. The actuator 750 can be coupled to a load arm 722, which can facilitate physical manipulation of the pivot arms 141 (shown in FIG. 10) of the spindle assembly 100 (shown in FIG. 10) and directly contact same. In some aspects, the actuator 750 can be coupled to the load arm 722, and vice versa, with a fastener 729. The fastener 729 can be, for example and without limitation, a pin. The fastener 729 can itself be secured with one or more fasteners such as, for example and without limitation, a cotter or clevis pin. The load arm 722 can be secured to the second mount 720 with a load arm pivot mount 724. A least a portion of the spindle ram assembly 700 including, for example, the second mount 720 can be enclosed by an enclosure 730, which can itself be mounted to the base assembly 600. The spindle ram assembly 700 can comprise a motor 752 (e.g., a servo motor) and a gear drive 754, which can be coupled to the actuator 750 to facilitate operation of the spindle ram assembly 700. More specifically, the electric actuator can be driven by the motor 752 and the gear drive 754.

The actuator 750 can be an electric ram actuator. The actuator 750 can be powered by or can comprise a ball screw drive. While the grooving process in a typical pipe groover 70 is driven by a hydraulic actuator, an amount of force applied or distance traveled (or extended) by the actuator 750 can be more precisely controlled when the actuator 750 comprises an electric actuator. Among other factors, a torque output of the actuator 750 can be easily—and even constantly—measured as a percentage of a total available torque output, and such data can facilitate forming of the groove 68 (shown in FIG. 1A) by allowing a precise degree of force to be applied to the pipe 60 by the actuator 750 through the pivot arm 141 (shown in FIG. 10) and, more specifically, the outer roller 134 (shown in FIG. 1F).

In a typical pipe groover, some kind of mechanical stop is used, if not required, to stop the grooving process when a sufficient groove depth is reached on the pipe 60. Such mechanical stops can be inaccurate and cumbersome. Use of the electric actuator 750 can have the additional benefit of eliminating the need for any mechanical stop. Due to the accuracy and presence of feedback in the form of being able to control a precise position of a moving ram of the actuator 750, the controller 1220 knows the depth of the groove 68 without having to measure the depth directly.

Any one or more of the elements of the spindle ram assembly 700 can comprise one or more fasteners 790 or can be attached to each other or a neighboring structure with the one or more fasteners 790.

Figure 8A:
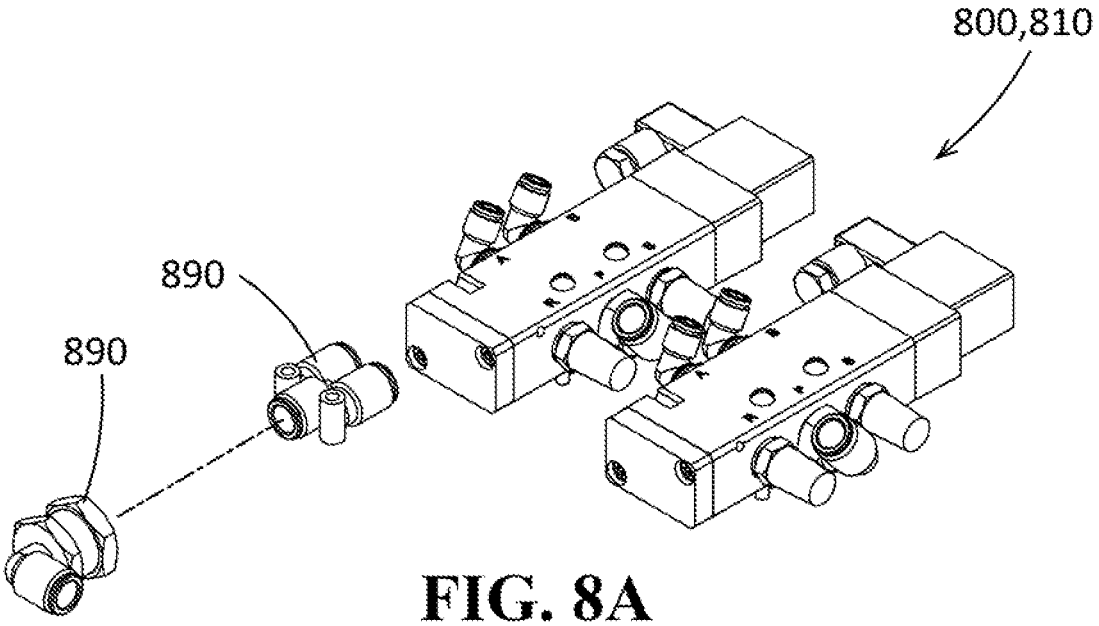
FIG. 8A is a rear top left perspective view of a pair of pneumatic valve assemblies of a pneumatic system of the pipe groover of FIG. 1B.

FIG. 8A is a rear top left perspective view of a pair of pneumatic valve assemblies 810 of a pneumatic assembly or pneumatic system 800 of the pipe groover 70 of FIG. 1B. Each of the pneumatic valve assemblies 810 can comprise one or more of a fitting 890 (e.g., an elbow or union) and can be in fluid communication with a source of pressurized air via tubing (not shown).

Figure 8B:
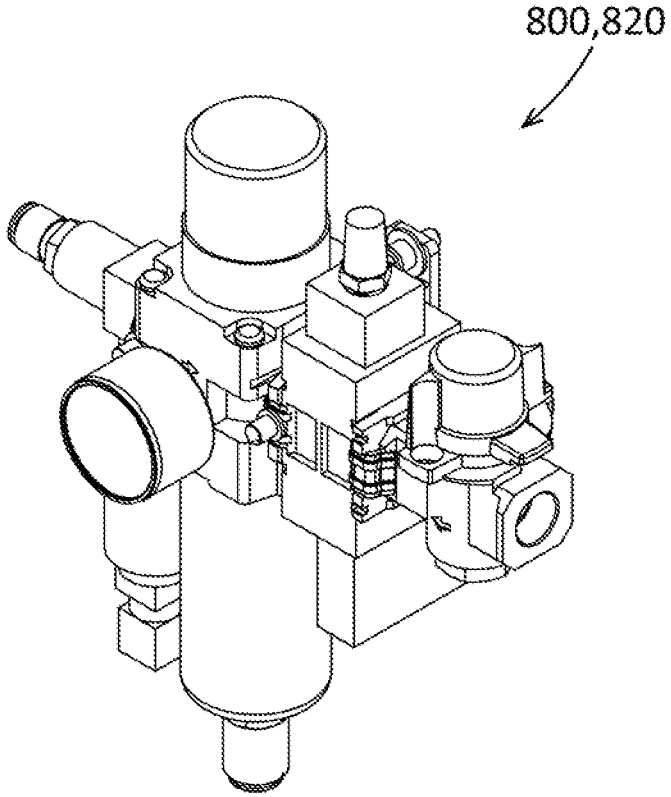
FIG. 8B is a rear top left perspective view of a pneumatic regulator assembly of the pneumatic system of FIG. 8A.

FIG. 8B is a rear top left perspective view of a pneumatic regulator assembly 820 of the pneumatic system 800 of FIG. 8A. The pneumatic regulator assembly 820 can be positioned between the pneumatic valve assemblies 810 (shown in FIG. 8A) and the source of pressurized air and can facilitate regulation of same.

Any one or more of the elements of the pair of pneumatic valve assemblies 810 and the pneumatic regulator assembly 820 can comprise one or more fasteners (not shown) or can be attached to each other or a neighboring structure with the one or more fasteners.

Figure 9A:
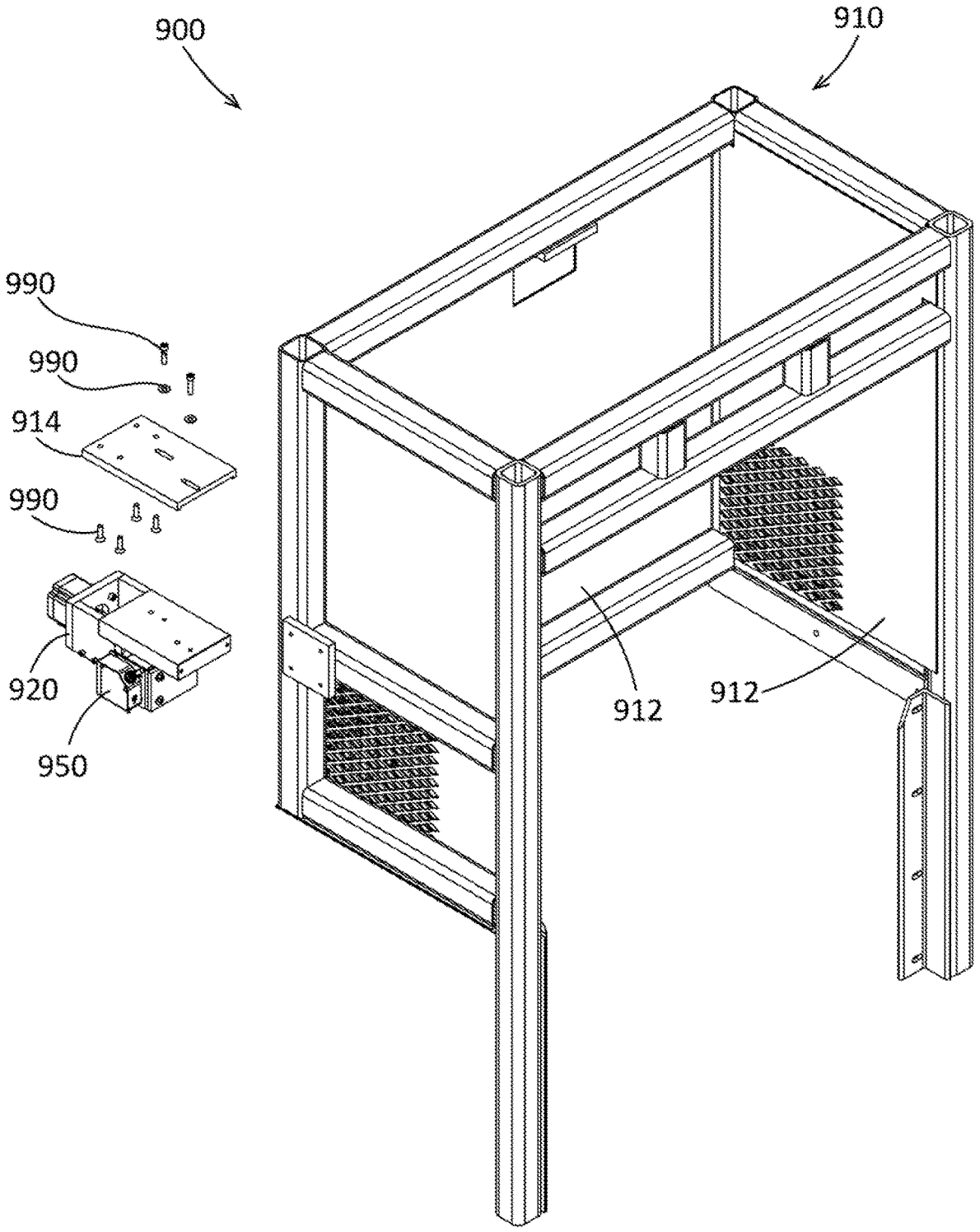
FIG. 9A is a front top left perspective view of a pipe sensor assembly of the pipe groover of FIG. 1B.

FIG. 9A is a front top left perspective view of the pipe sensor assembly 900 of the pipe groover 70 of FIG. 1B. The pipe sensor assembly 900 can comprise the pipe sensor enclosure 910, which can be a pipe sensor mount, which can comprise structural members and panels. In some aspects, the pipe sensor enclosure 910 can comprise a shroud 912, which can comprise or can be a solid panel. The pipe sensor assembly 900 can comprise the pipe sensor shuttle assembly 920. In some aspects, the pipe sensor enclosure 910 and/or a position and orientation of the pipe sensor shuttle assembly 920 can be configured to shield or block the pipe sensor shuttle assembly 920 from light or debris coming from a side or from a rear of the pipe groover 70 or from above the pipe groover 70. In some aspects, as shown, a sensor 950 of the pipe sensor shuttle assembly 920 can be positioned above a front side of the spindle assembly 100 (shown in FIG. 1A) and can be configured to measure a distance to the pipe 60 and/or a portion of the pipe groover 70 positioned directly below the pipe sensor shuttle assembly 920. In some aspects, the sensor 950 can be positioned below the pipe 60 and face upwards to measure a distance to the pipe 60 and the pipe identified thereby, albeit with calculations adjusted for the new orientation. The sensor 950 can be positioned elsewhere and can be configured to measure a distance to the pipe 60. The pipe sensor shuttle assembly 920 can be mounted to the pipe sensor enclosure 910 via a plate 914.

Figure 9B:
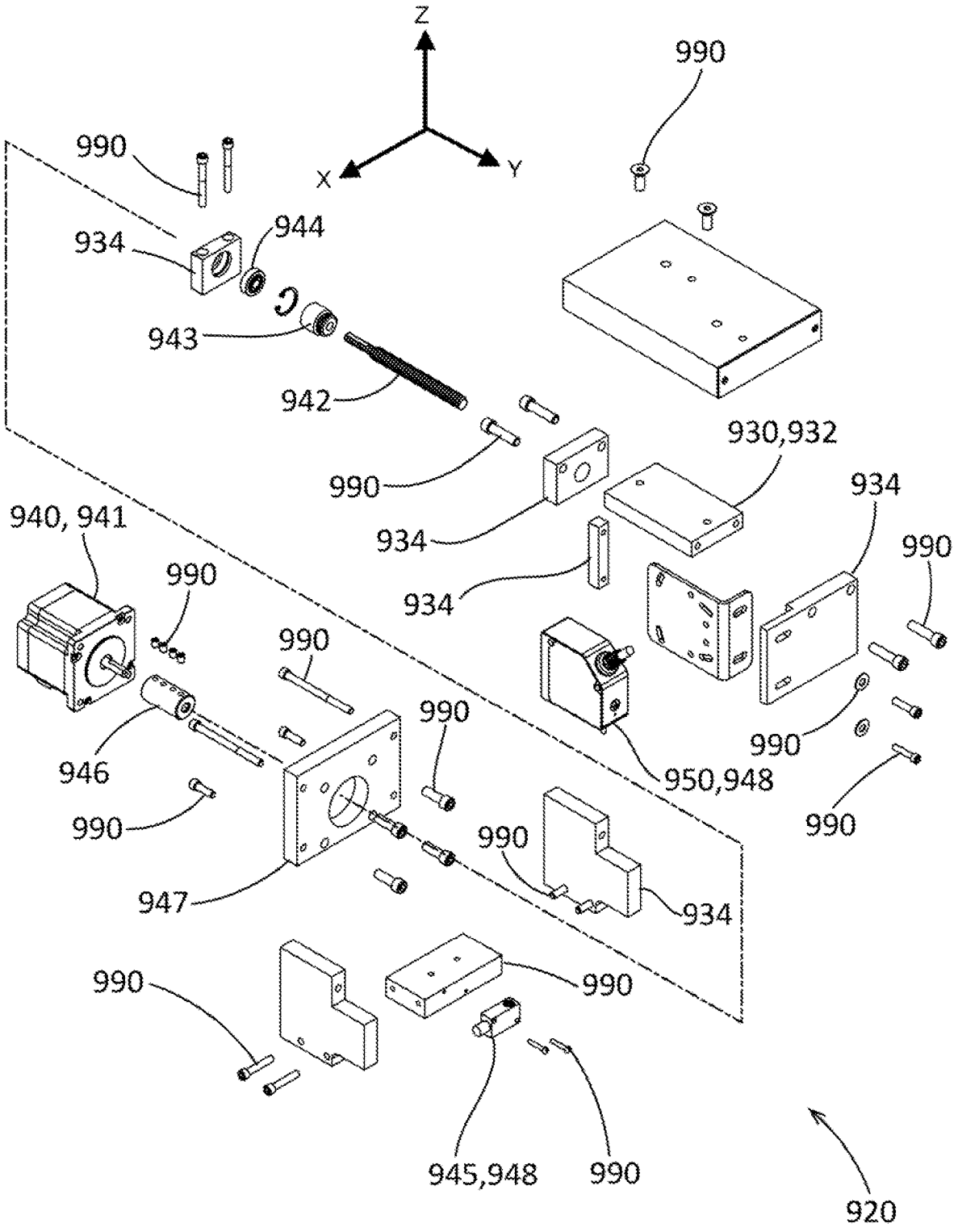
FIG. 9B is a front top left perspective exploded view of a pipe sensor shuttle assembly of the pipe sensor assembly of FIG. 9A.

FIG. 9B is a front top left perspective exploded view of the pipe sensor shuttle assembly 920 of the pipe sensor assembly 900 of FIG. 9A. The pipe sensor shuttle assembly 920 can comprise a mount 930, which can comprise a base 932 and one or walls 934 angled with respect to the base. The pipe sensor shuttle assembly 920 can comprise a linear slide or linear positioner, which can be configured to position the slide with a lead screw and a stepper motor. The mount 930 can comprise one or more plates, blocks, and/or brackets. The mount 930 can enclose one or more of the components of the pipe sensor shuttle assembly 920. The pipe sensor shuttle assembly 920 can comprise a motor assembly 940, which can be configured to adjust a position of the sensor 950. The motor assembly 940 can comprise a motor 941, which can be a stepper motor. The motor assembly 940 can comprise a lead screw 942, which can define threads and, in some aspects, Acme threads. The motor assembly 940 can comprise a nut 943, which can be an Acme nut. As shown, the lead screw 942 can rotate within the nut 943 to adjust the position of the sensor 950. The motor assembly 940 can comprise a bearing 944, within which the lead screw can rotate. The motor assembly 940 can comprise a proximity sensor 945, which can sense when the lead screw 942 or another portion of the motor assembly 940 has reached a predetermined limit of travel. The motor assembly 940 can comprise a motor coupling 946 for joining a motor output shaft and the lead screw 942. The motor assembly 940 can comprise one or more of a motor mount 947 and an electrical harness 948.

The sensor 950 can be a laser sensor and can be configured to measure a distance from the sensor 950 to the pipe 60 and/or some part of the pipe groover 70 in view of the sensor 950. The sensor 950 can define a "read" range of between 100 millimeters and 1000 millimeters, inclusive. The sensor 950 can define a lens through which the laser can be emitted and an inner portion of the sensor 950 also physically shielded.

Any one or more of the elements of the pipe sensor assembly 900 can comprise one or more fasteners 990 or can be attached to each other or a neighboring structure with the one or more fasteners 990.

FIG. 10 is a front top left perspective exploded view of the spindle rotation assembly 1000 of the pipe groover 70 of FIG. 1B. The spindle rotation assembly 1000 can comprise a mount 1010, which in some aspects can comprise a mount bracket 1012 and/or a mount adaptor 1014. The spindle rotation assembly 1000 can comprise a motor 1020, which can be a stepper motor. The spindle rotation assembly 1000 can comprise a drive element 1030, which can be flexible and can be a chain. The spindle rotation assembly 1000 can comprise a drive sprocket 1040 and a shaft sprocket 1050. The drive sprocket 1040 can be coupled to the motor 1020 and, more specifically, a shaft thereof. The shaft sprocket 1050 can be coupled to the rotation shaft assembly 120 (shown in FIG. 10) and, more specifically, a rear rotation shaft 122 thereof.

Any one or more of the elements of the spindle rotation assembly 1000 can comprise one or more fasteners 1090 or can be attached to each other or a neighboring structure with the one or more fasteners 1090.

Figure 11:
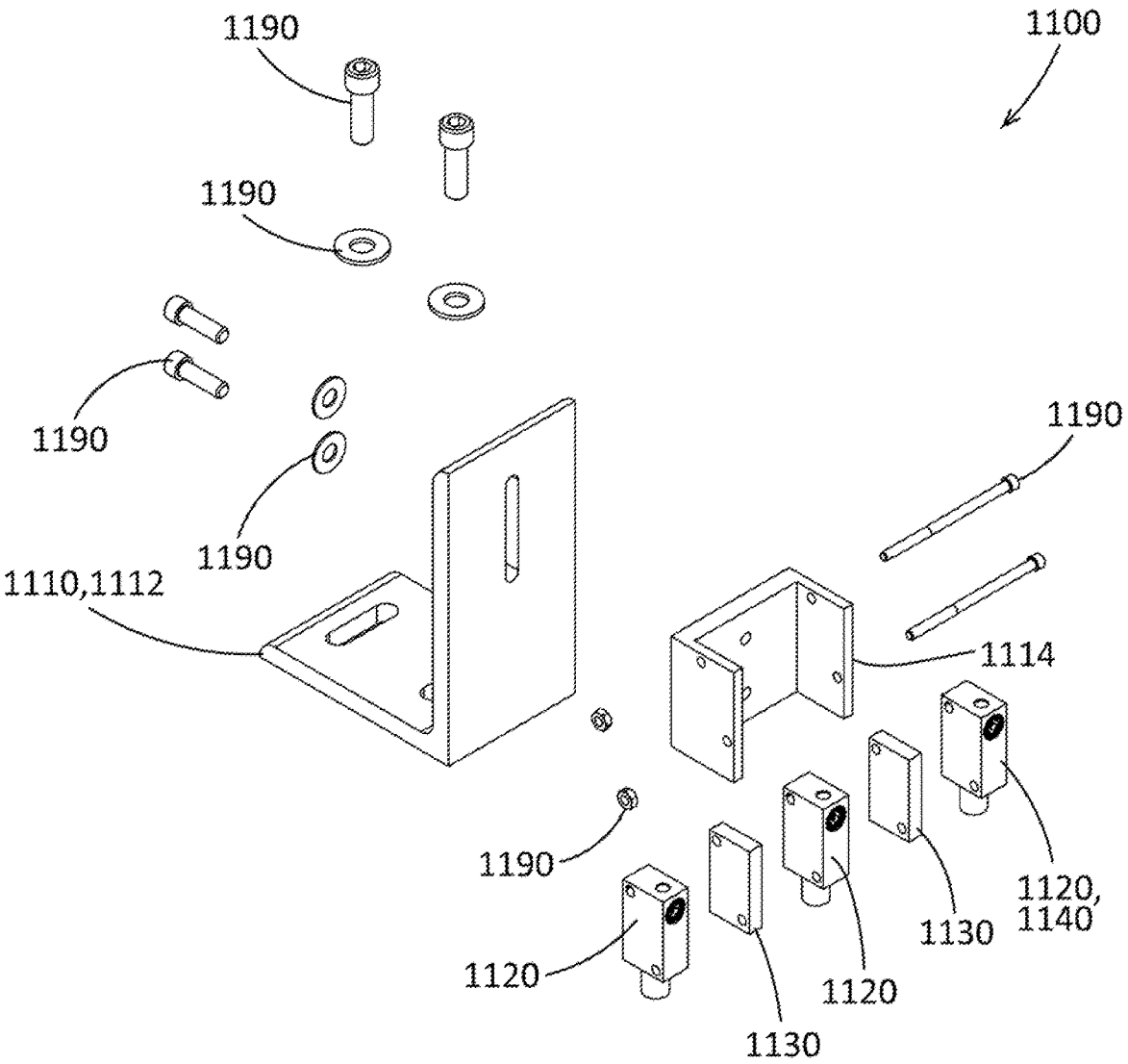
FIG. 11 is a front top left perspective exploded view of a spindle position assembly of the pipe groover of FIG. 1B.

FIG. 11 is a front top left perspective exploded view of a spindle position assembly 1100 of the pipe groover 70 of FIG. 1B. The spindle position assembly 1100 can comprise a mount 1110, which in some aspects can comprise a mount bracket 1112 and/or a mount adaptor 1114. The spindle position assembly 1100 can comprise a proximity switch 1120. In some aspects, the spindle position assembly 1100 can comprise a plurality of proximity switches 1120. More specifically, as shown, the spindle position assembly 1100 can comprise three proximity switches 1120 or one for each tool position of the spindle assembly 100. In some aspects, adjacent proximity switches 1120 of the plurality of proximity switches 1120 can be offset from each other by a switch spacing measured in one of a horizontal direction of the pipe groover 70 and a radial direction of the spindle plate 110 (shown in FIG. 10). The spindle position assembly 1100 and a portion thereof (e.g., the proximity switches 1120) can extend in one or both of the horizontal direction of the pipe groover 70 and the radial direction of the spindle plate 110. The spindle position assembly 1100 can comprise one or more spacers 1130, which can help set and maintain the switch spacing. Similarly, the radial distances R1, R2, R3 (shown in FIG. 1H) and the radial distances 1191, 1192, 1193 (shown in FIG. 1H) can vary at each of the three tool locations. Upon passage of one of the proximity fasteners 190 past the proximity switches 1120, each proximity fastener can be positioned and otherwise configured to activate only one switch, and based on which proximity switch 1120 is activated, the controller 1220 will know the orientation of the spindle plate 110 including which tool position is active and how to make active a different tool loaded in a particular tool position. The spindle position assembly 1100 can comprise a harness 1140, which can provide power and a control communication with other components of the pipe groover 70.

Any one or more of the elements of the spindle position assembly 1100 can comprise one or more fasteners 1190 or can be attached to each other or a neighboring structure with the one or more fasteners 1190.

Figure 12:
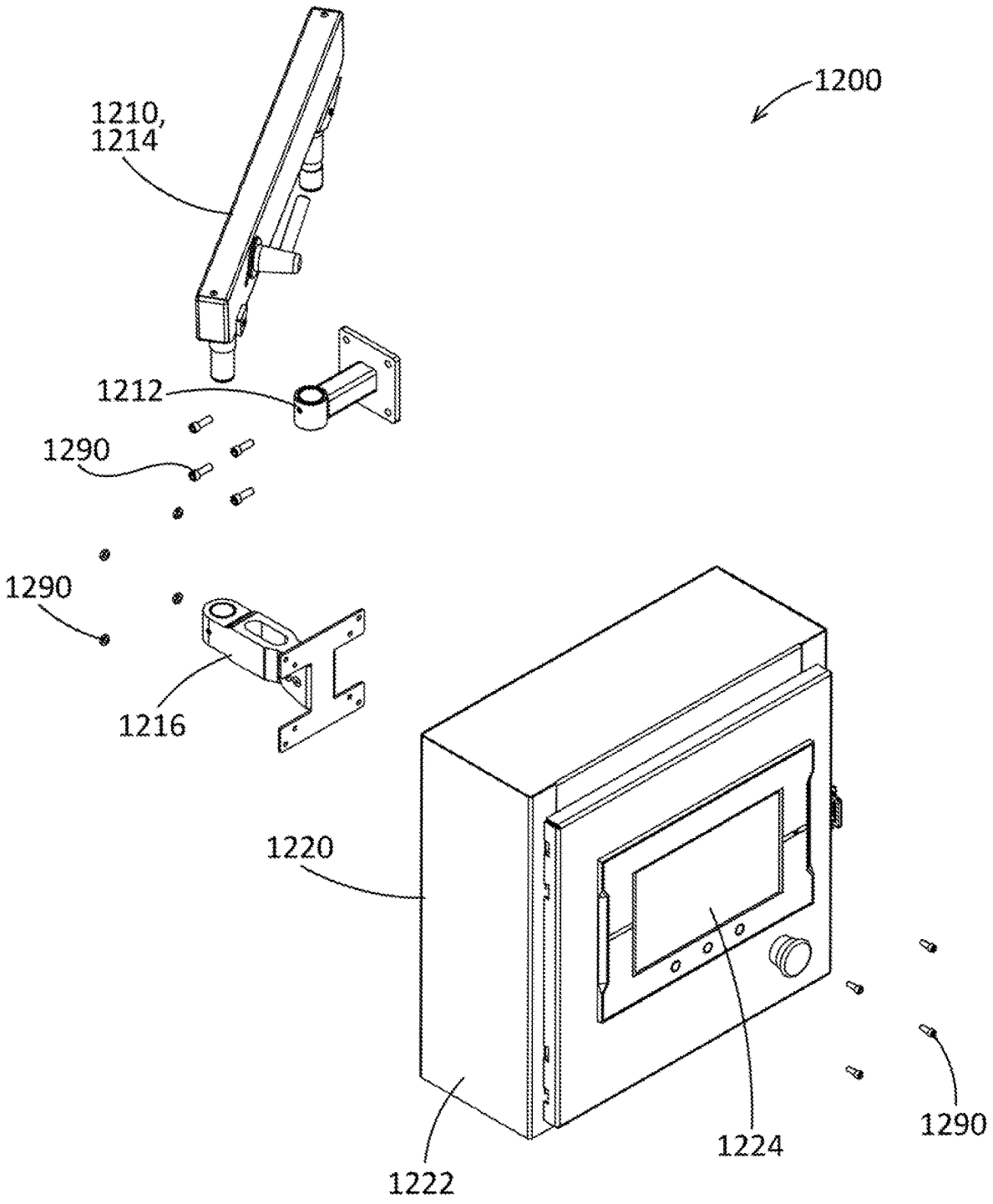
FIG. 12 is a front top left perspective exploded view of a controller assembly of the pipe groover of FIG. 1B.

FIG. 12 is a front top left perspective exploded view of the controller assembly 1200 of the pipe groover 70 of FIG. 1B. The controller assembly 1200 can comprise a mount 1210, which can comprise a mounting bracket 1212, an arm 1214, and/or a mounting adaptor 1216. The controller assembly 1200 can comprise a controller 1220, which can comprise a housing 1222 and a display 1224, which can comprise a user interface or HMI (human-machine interface). As shown in FIGS. 34-45, a user or operator of the pipe groover 70 can interface with the user interface through various interactive menus. In some aspects, a label printer 2070 (shown in FIG. 20A) can be used to print labels based on measurements and actions taken by the pipe groover 70.

Any one or more of the elements of the controller assembly 1200 can comprise one or more fasteners 1290 or can be attached to each other or a neighboring structure with the one or more fasteners 1290.

Figure 13A:
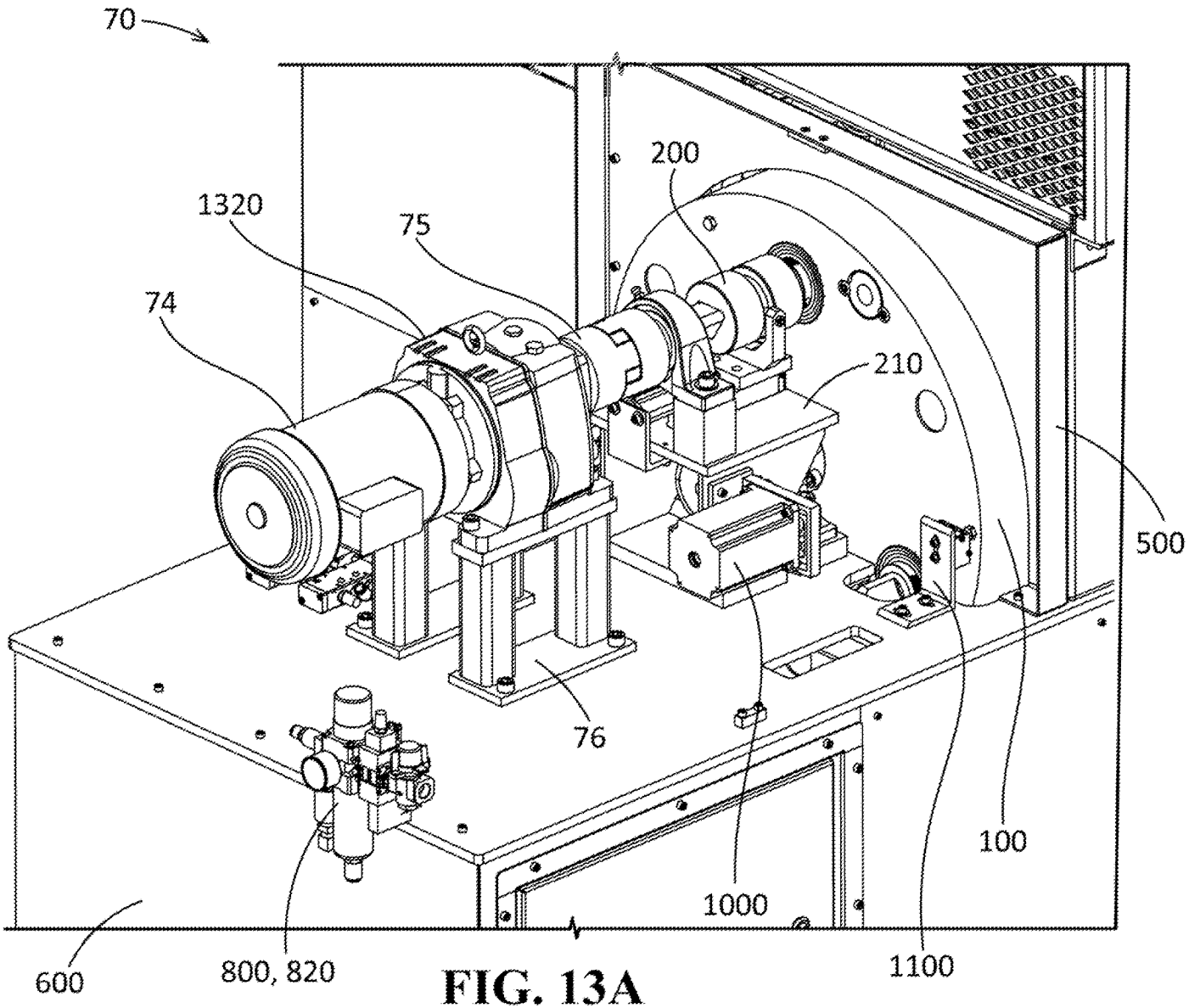
FIG. 13A is a rear top left perspective view of the pipe groover of FIG. 1B, more specifically showing the spindle assembly of FIG. 10; a portion of the top enclosure assembly of FIG. 5; the base assembly of FIGS. 6A-6C; the pneumatic system and, more specifically, the pneumatic regulator assembly of FIG. 8B; the spindle rotation assembly of FIG. 10; the spindle position assembly of FIG. 11; and a tooling motor and a motor shaft coupling of the pipe groover of FIG. 1B.

FIG. 13A is a rear top left perspective view of the pipe groover 70 of FIG. 1 more specifically showing the spindle assembly 100 of FIG. 10; a portion of the top enclosure assembly 500 of FIG. 5; the base assembly 600 of FIGS. 6A-6C; the pneumatic system 800 and, more specifically, the pneumatic regulator assembly 820 of FIG. 8B; the spindle rotation assembly 1000 of FIG. 10; the spindle position assembly 1100 of FIG. 11; and the roller motor assembly 74 and the drive shaft coupling 75 of the pipe groover 70 of FIG. 1B. As shown, the roller motor assembly 74 can be secured to the mount 76, which can raise the roller motor assembly 74 to align a drive shaft thereof with the roller rotation slide shaft 220. The roller motor assembly 74 can comprise a gear box 1320, which can adjust a rotational speed of the drive shaft based on the pipe 60 being grooved.

In some aspects, as shown, the spindle rotation assembly 1000 can be secured to the yoke assembly 200 and, more specifically, the yoke mount 210. In some aspects, the spindle rotation assembly 1000 can be secured to the base assembly 600 or to any other surrounding portion of the pipe groover 70. The drive element 1030 (shown in FIG. 10) can in some aspects extend or pass through an opening defined in the yoke mount 210 and thereby reach the rotation shaft assembly 120 (shown in FIG. 1C).

Figure 13B:
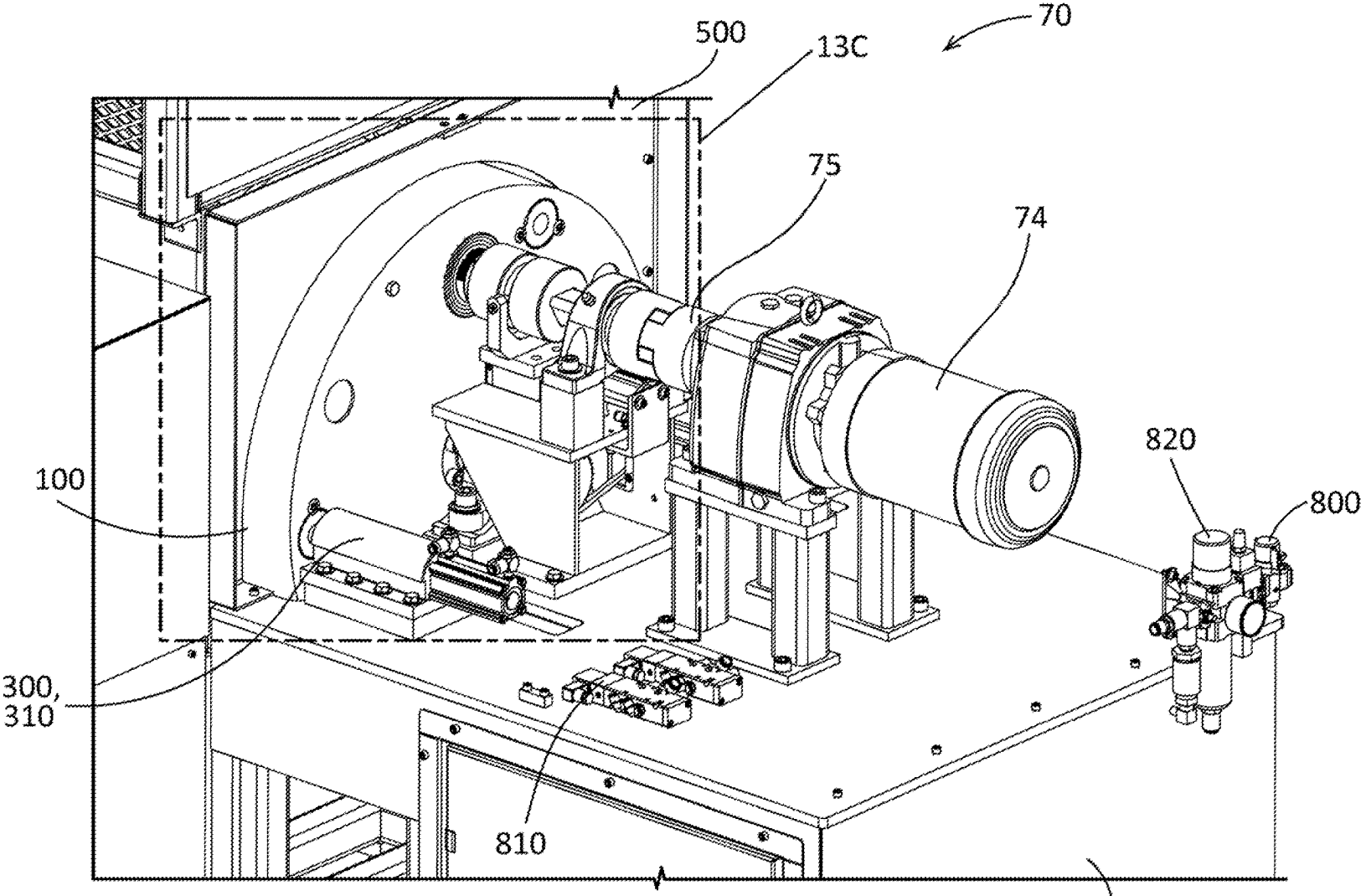
FIG. 13B is a rear top right perspective view of the pipe groover of FIG. 1B more specifically showing the spindle assembly of FIG. 10; the spindle lock assembly of FIG. 3; a portion of the top enclosure assembly of FIG. 5; the base assembly of FIG. 6; the pneumatic system and, more specifically, the pair of pneumatic valve assemblies of FIG. 8A and the pneumatic regulator assembly of FIG. 8B; and a tooling motor and a motor shaft coupling of the pipe groover of FIG. 1B.

FIG. 13B is a rear top right perspective view of the pipe groover 70 of FIG. 1 more specifically showing the spindle assembly 100 of FIG. 10; the spindle lock assembly 300 of FIG. 3; a portion of the top enclosure assembly 500 of FIG. 5; the base assembly 600 of FIG. 6; the pneumatic system 800 and, more specifically, the pair of pneumatic valve assemblies 810 of FIG. 8A; the pneumatic regulator assembly 820 of FIG. 8B; and the roller motor assembly 74 and the drive shaft coupling 75 of the pipe groover 70 of FIG. 1B. More specifically, the pneumatic regulator assembly 820 can regulate a pressure of the pressurized air supplied to the spindle lock assembly 300 and, more specifically, the cylinder assembly 310.

Figure 13C:
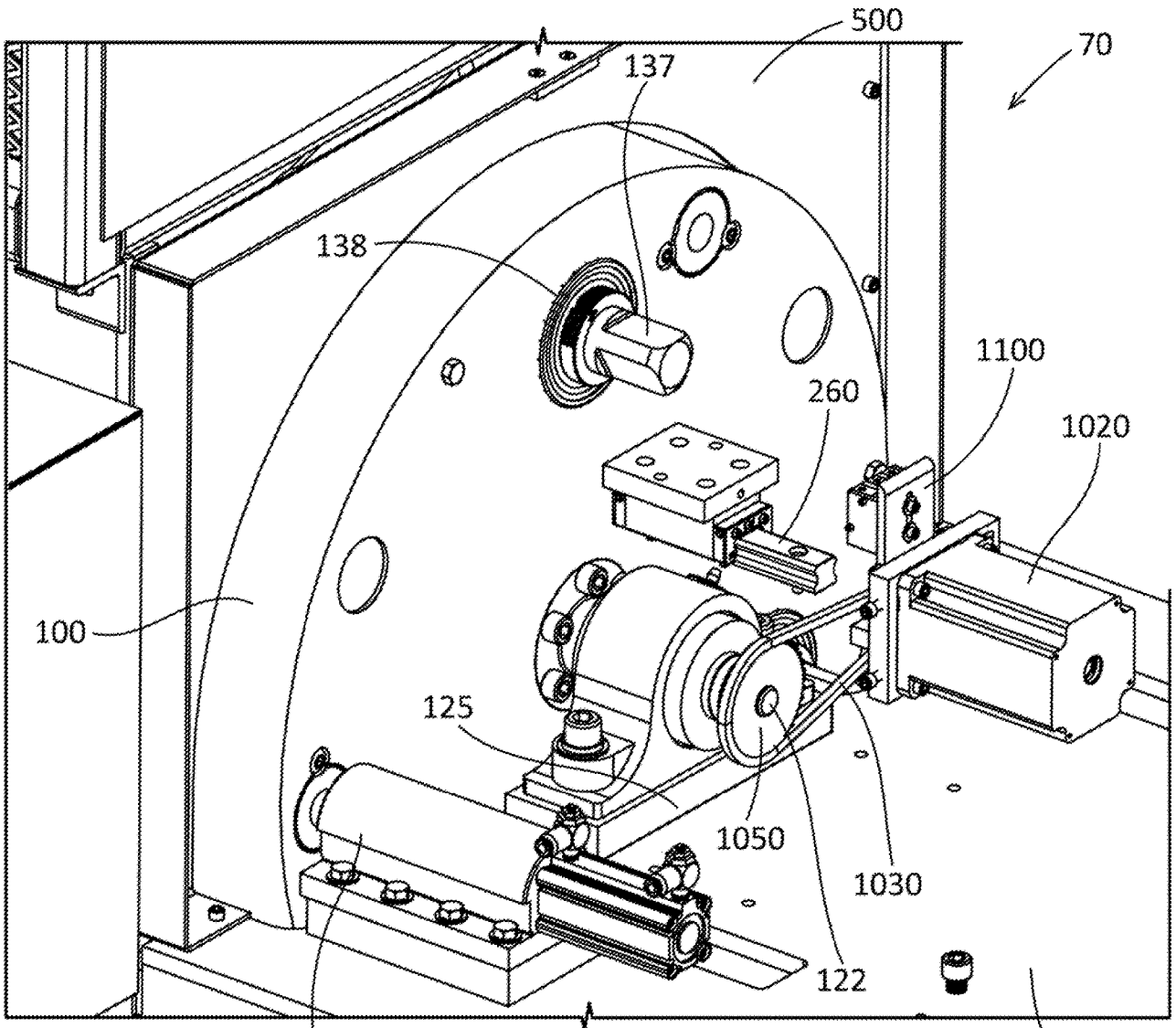
FIG. 13C is a rear top right detail perspective view of the portion of the pipe groover of FIG. 1B taken from detail 13C of FIG. 13B more specifically showing the spindle assembly of FIG. 10; the spindle lock assembly of FIG. 3; a portion of the top enclosure assembly of FIG. 5; the base assembly of FIG. 6; the spindle rotation assembly of FIG. 10; and the spindle position assembly of FIG. 11 with surrounding parts removed.

FIG. 13C is a rear top right detail perspective view of the portion of the pipe groover 70 of FIG. 1 taken from detail 13C of FIG. 13B more specifically showing the spindle assembly 100 of FIG. 10; the spindle lock assembly 300 of FIG. 3; a portion of the top enclosure assembly 500 of FIG. 5; the base assembly 600 of FIG. 6; the spindle rotation assembly 1000 of FIG. 10; and the spindle position assembly 1100 of FIG. 11 with surrounding parts removed. Again, the motor 1020 of the spindle rotation assembly 1000 can drive the rear rotation shaft 122 via the drive element 1030 and the sprockets 1040, 1050 (1040 shown in FIG. 10).

Figure 14:
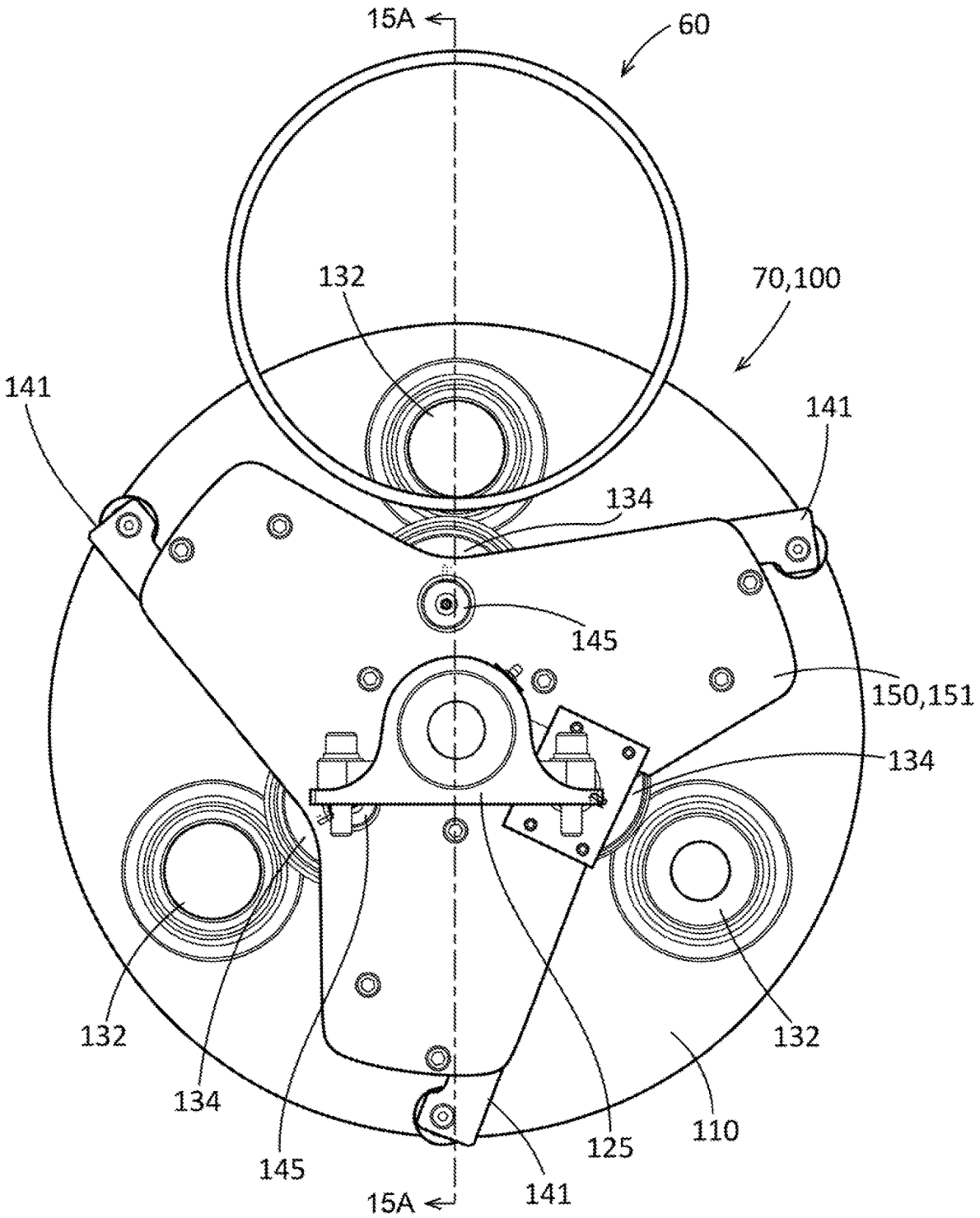
FIG. 14 is a front elevation view of a pipe positioned inside the pipe groover of FIG. 1B and, more specifically, the spindle assembly of FIG. 10.

FIG. 14 is a front elevation view of the pipe 60 positioned inside the pipe groover 70 of FIG. 1B and, more specifically, the spindle assembly 100 of FIG. 10.

Figure 15A:
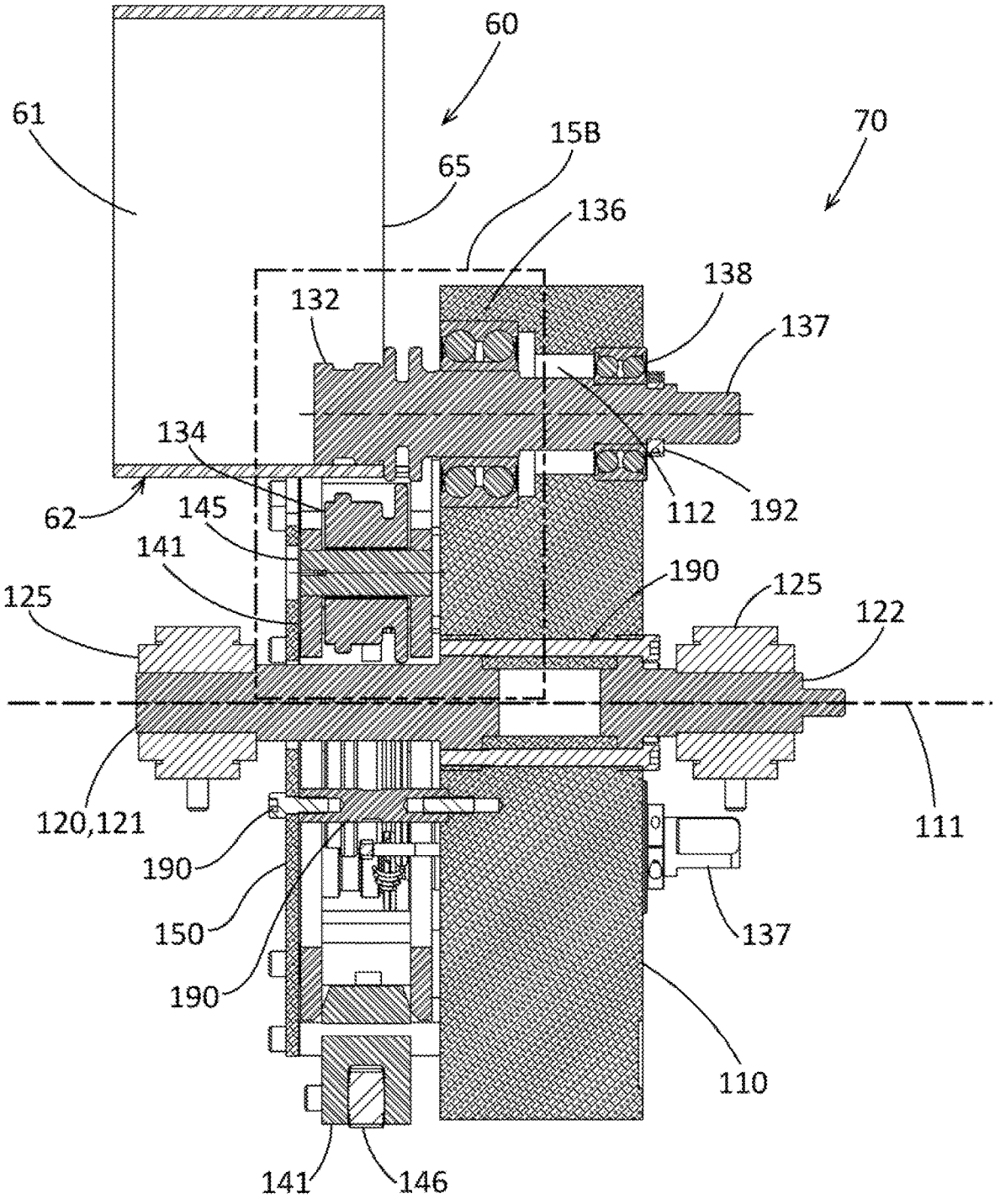
FIG. 15A is a side sectional view of the assembly of FIG. 14 taken along line 15A-15A of FIG. 14.

FIG. 15A is a side sectional view of the assembly of FIG. 14 taken along line 15A-15A of FIG. 14. As shown, an interior surface 61 of the pipe 60 can face the top or inner roller 132, and an outer surface 62 of the pipe 60 can face the bottom or outer roller 134. The end 65 of the pipe 60 can contact a top flange of the inner roller 132 and set an axial position of the pipe 60 with respect to the central axis 111 of the pipe groover 70.

Figure 15B:
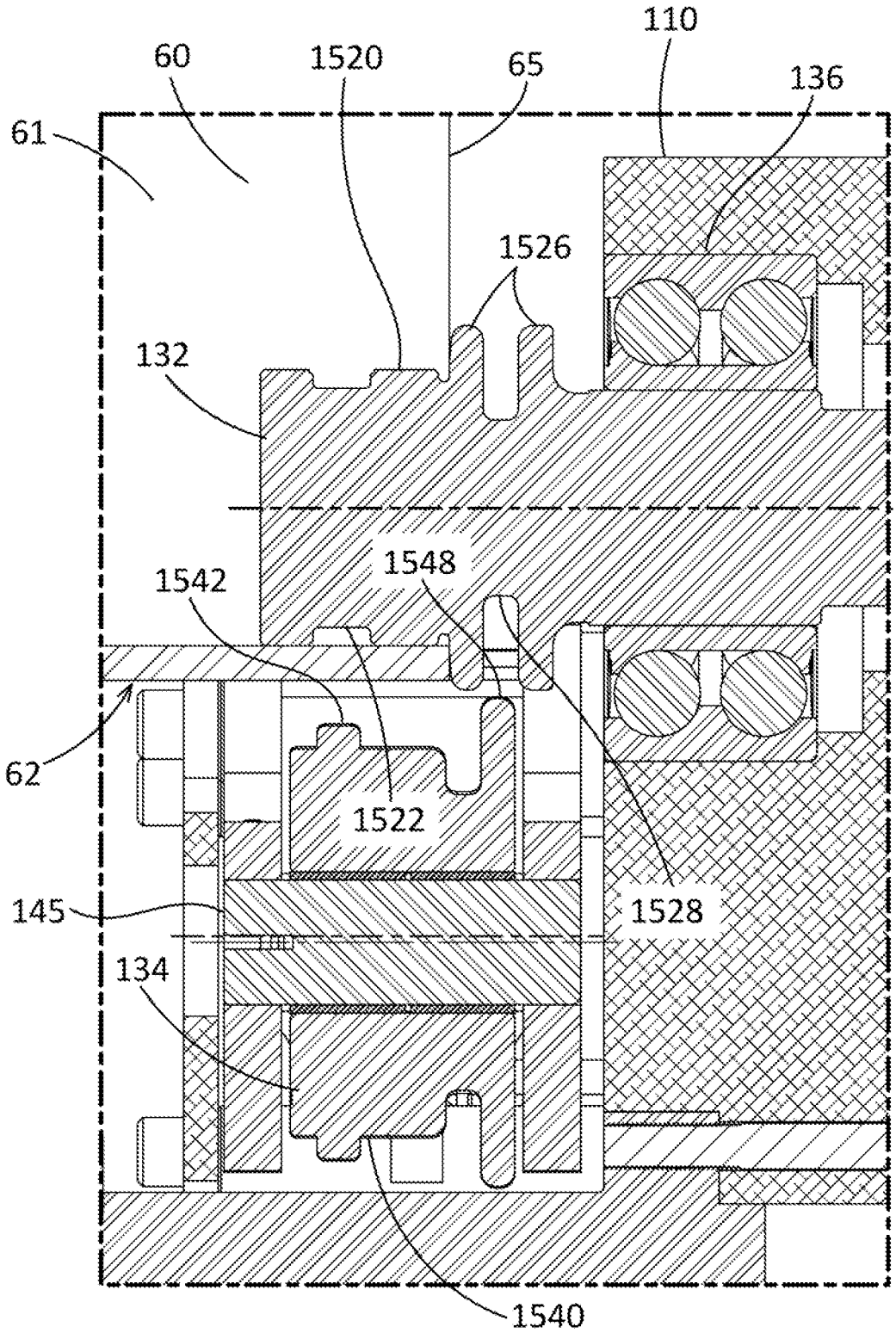
FIG. 15B is a detail side sectional view of the assembly of FIG. 14 taken from detail 15B of FIG. 15A.

FIG. 15B is a detail side sectional view of the assembly of FIG. 14 taken from detail 15B of FIG. 15A. The inner roller 132 and the outer roller 134 can define interlocking geometry including a groove-forming recess 1522 on the inner roller 132 and a groove-forming ridge 1542 on the outer roller 134 configured to form the groove 68 (shown in FIG. 1B) in the pipe 60. A locking recess 1528 on the inner roller 132, which can be formed by adjacent locking ridges 1526 of the inner roller 132, and a locking ridge 1548 on the outer roller 134 can help ensure that an axial position of the rollers 132,134 with respect to each other is maintained as the rollers 132,134 approach each other and encounter mechanical loads that might otherwise cause the rollers 132,134 to become misaligned. The aforementioned ridges and recesses can be formed by differing diameters of the rollers 132,134 in axially adjacent portions thereof. The inner roller 132 can define an outer surface 1520. The outer roller 134 can define an outer surface 1540.

FIGS. 16-20B are electrical schematics, or circuit diagrams, of the pipe groover 70 of FIG. 1B. FIG. 16 is specifically an electrical schematic 1600 of power cabinet wiring thereof. A ram motor drive 1610 can be in electrical communication with the ram motor or actuator 750, a power source (e.g., 240 VAC), and other components inside and outside the power cabinet assembly 72 (shown in FIG. 1B). A spindle drive 1620 can be in electrical communication with the rotation motor or motor 1020, a power source (e.g., 240 VAC), and other components inside and outside the power cabinet assembly 72. The other components shown can facilitate delivery of power and/or control signals to other components inside and outside the power cabinet assembly 72. As shown, depending on power requirements, various components can operate at a higher voltage (e.g., 240 VAC or 120 VAC) or at a lower voltage (e.g., 24 VDC). One or more of the components shown can be housed within the power cabinet assembly 72.

Figure 17A:
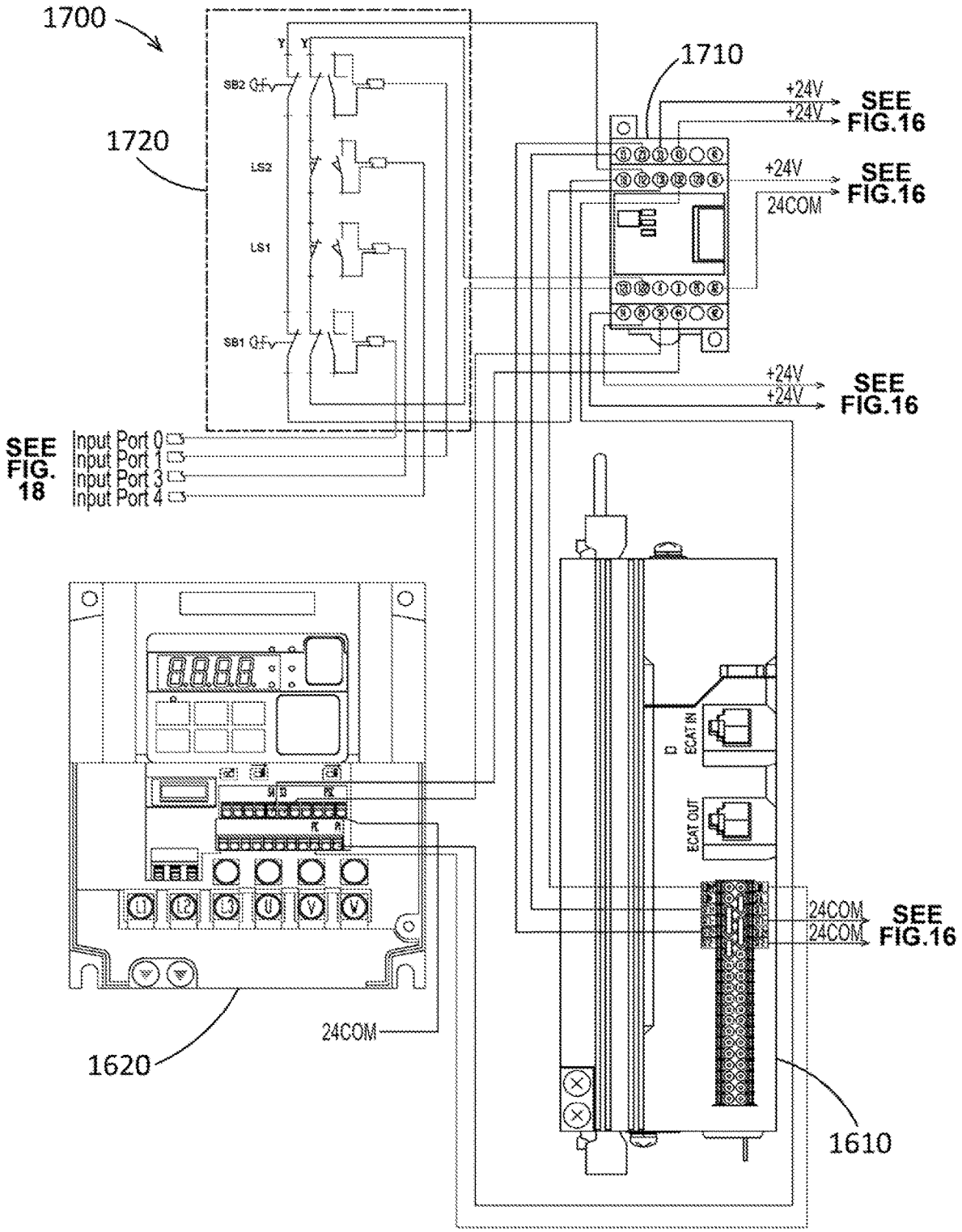
FIG. 17A is an electrical schematic of safety relay wiring of the pipe groover of FIG. 1B.

FIG. 17A is specifically an electrical schematic 1700 of safety relay wiring of the pipe groover 70 of FIG. 1B. As shown, each of the ram motor drive 1610 and the spindle drive 1620 can be in electrical communication with the components shown here and with one or more of the components shown in FIG. 16, including through a safety relay 1710. The safety relay 1710 can be in electrical communication with a safety circuit 1720, which can comprise one or more switches for controlling power such as, for example and without limitation, emergency stops such as kill switches or safety mats. The other components shown can facilitate delivery of power and/or control signals to other components inside and outside the power cabinet assembly 72. One or more of the components shown can be housed within the power cabinet assembly 72.

Figure 17B:
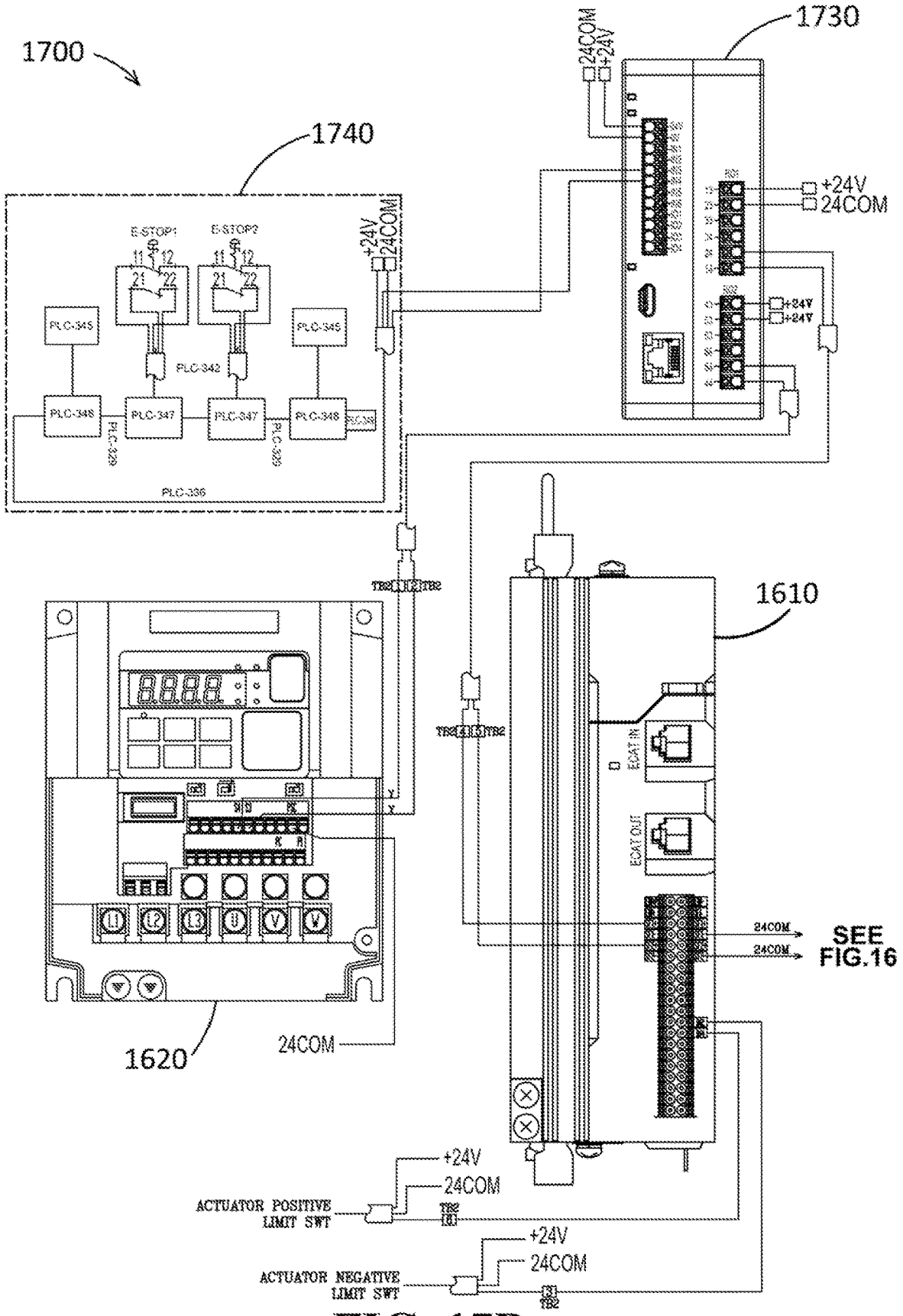
FIG. 17B is an electrical schematic of safety controller wiring of the pipe groover of FIG. 1B in accordance with another aspect of the current disclosure.

FIG. 17B is specifically an electrical schematic 1700 of safety controller wiring of the pipe groover 70 of FIG. 1B in accordance with another aspect of the current disclosure. As shown, each of the ram motor drive 1610 and the spindle drive 1620 can be in electrical communication with the components shown here and with one or more of the components shown in FIG. 16, including through a safety controller 1730. The safety controller 1730 can be in electrical communication with a safety circuit 1740, which can comprise one or more switches for controlling power such as, for example and without limitation, emergency stops such as kill switches or safety mats. In some aspects, the safety circuit 1740 can comprise user inputs (such as, for example and without limitation, inputs made by a user via the display 1224 shown in FIG. 12). The other components shown can facilitate delivery of power and/or control signals to other components inside and outside the power cabinet assembly 72. One or more of the components shown can be housed within the power cabinet assembly 72.

Figure 18:
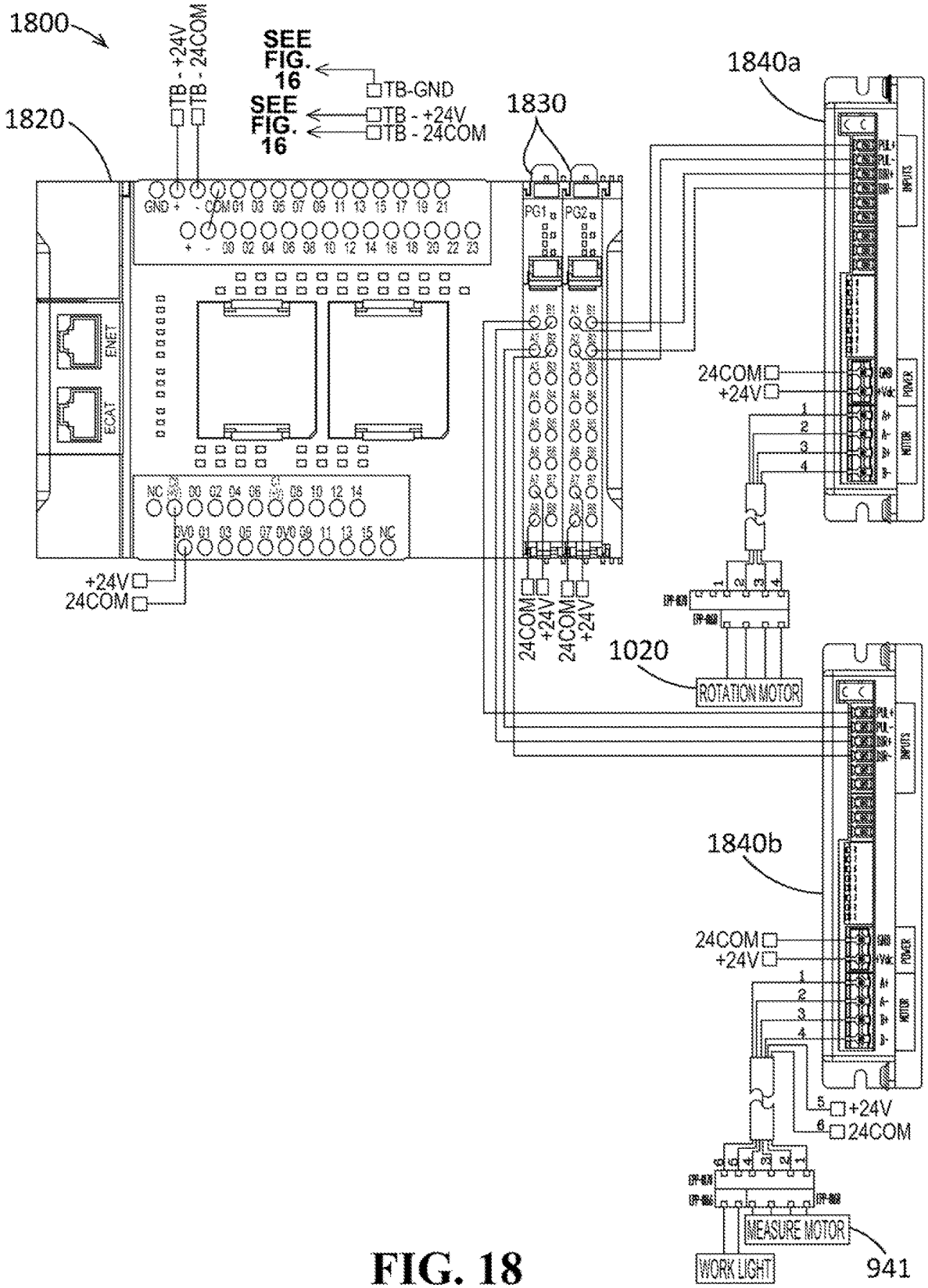
FIG. 18 is an electrical schematic of control cabinet wiring of the pipe groover of FIG. 1B.

FIG. 18 is specifically an electrical schematic 1800 of control cabinet wiring of the pipe groover 70 of FIG. 1B. A programmable logic controller (PLC), machine controller, or controller 1820 can form at least part of the controller 1220 (shown in FIG. 12) and can be in electrical communication with the components shown here and with components shown in FIG. 16, including through power feed units 1830. Stepper motor drives 1840*a,b* can, respectively, facilitate control of the motor 1020 and the motor 941 and, as desired, other components of the pipe groover 70.

FIG. 19A is specifically an electrical schematic 1900 of IO link wiring of the pipe groover 70 of FIG. 1B. An IO link master 1910 and an IO link input module 1920 can be in electrical communication with each other and with one or more inputs or outputs. The IO link master 1910 can be in electrical communication with a power source. In some aspects, the IO link master 1910 can be in electrical communication with one or more inputs such as, for example and without limitation, the sensor 950 and the IO link input module 1920. In some aspects, the IO link master 1910 can be in electrical communication with one or more outputs such as, for example and without limitation, a yoke cylinder valve, a lock cylinder valve, an air dump valve, and an indicator light. In some aspects, the IO link input module 1920 can be in electrical communication with one or more inputs such as, for example and without limitation, one or more stop buttons, a sensor home switch, one or more motor cover switches, one or more tool position switches (e.g., the proximity switches 1120 shown in FIG. 11), yoke cylinder forward and back switches (e.g., switches associated with the cylinder 270 shown in FIG. 2), lock cylinder forward and back switches (e.g., switches associated with the cylinder 316 shown in FIG. 3), and an air pressure switch. The IO link input module 1920 can thereby direct feedback from the various switches to the controller 1220.

Figure 19B:
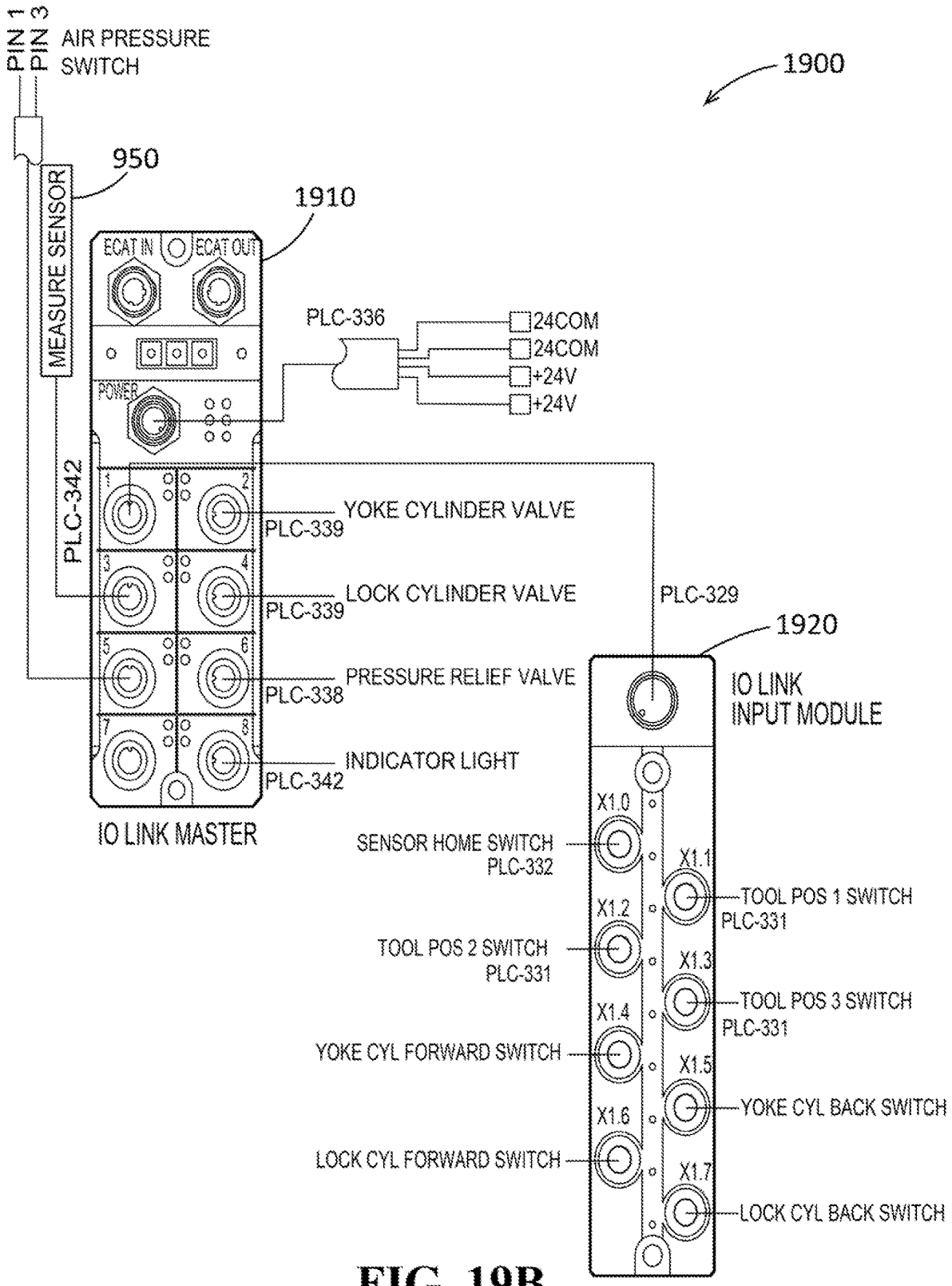
FIG. 19B is an electrical schematic of IO link wiring of the pipe groover of FIG. 1B in accordance with another aspect of the current disclosure.

FIG. 19B is specifically an electrical schematic 1900 of IO link wiring of the pipe groover 70 of FIG. 1B in accordance with another aspect of the current disclosure. In some aspects, the IO link master 1910 can be in electrical communication with one or more inputs such as, for example and without limitation, the sensor 950, an air pressure switch, and the IO link input module 1920. In some aspects, the IO link master 1910 can be in electrical communication with one or more outputs such as, for example and without limitation, the yoke cylinder valve, the lock cylinder valve, the indicator light, and a pressure relief valve. In some aspects, the IO link input module 1920 can be in electrical communication with one or more inputs such as, for example and without limitation, the sensor home switch, the one or more tool position switches, the yoke cylinder switches, and the lock cylinder switches.

Figure 20A:
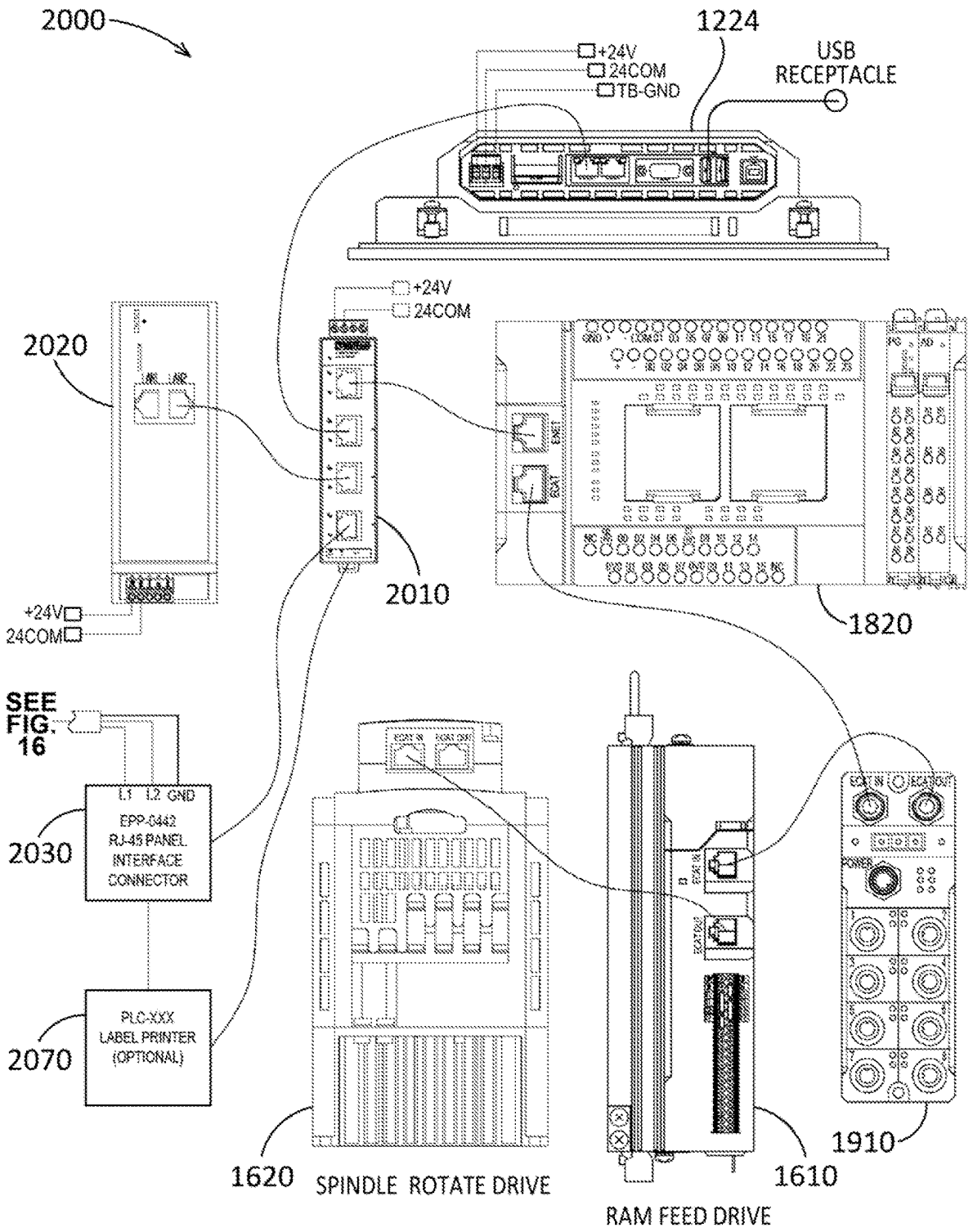
FIG. 20A is an electrical schematic of wiring related to the controller and network connectivity of the pipe groover of FIG. 1B.
Figure 20B:
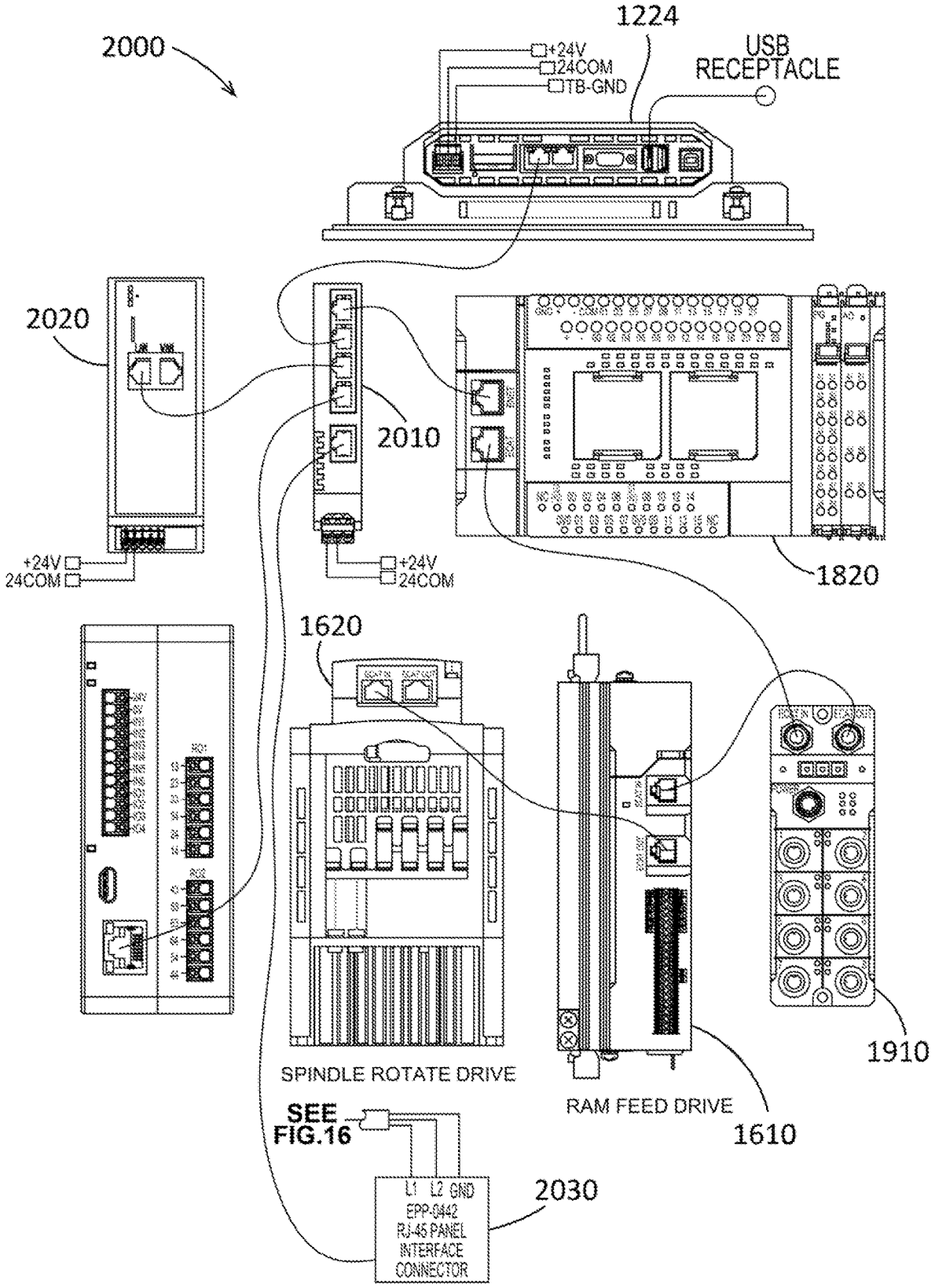
FIG. 20B is an electrical schematic of wiring related to the controller and network connectivity of the pipe groover of FIG. 1B in accordance with another aspect of the current disclosure.

FIG. 20A is specifically an electrical schematic 2000 of wiring related to the controller and network connectivity, and FIG. 20B is specifically an electrical schematic of wiring related to the controller and network connectivity in accordance with another aspect of the current disclosure. Wiring such as, for example and without limitation, EtherCAT or Ethernet cables can connect one or more of the display 1224, the ram motor drive 1610, the spindle rotate drive 1620, the controller 1820, the IO link master 1910, a an internet switch 2010, a remote VPN unit 2020, a panel interface connector 2030, the printer 2070, and a power source.

The components shown in the aforementioned electrical schematics or elsewhere in the figures can, per the following Table 1, comprise one or more of the following components or their equivalents:

TABLE 1

| Description | Manufacturer | Part Number |
|---|---|---|
| Actuator 750 (shown, e.g., in FIGS. 7 and 16) | Tolomatic | RSA64 BNH02 SK6.000 RP2 HT1 YM252503 PCD CLV PK2 |
| Sensor 950 (shown, e.g., in FIGS. 9A and 19A) | Banner | LE550KQP |
| Controller 1220 (PLC) (shown, e.g., in FIGS. 12 and 20A) | Omron | NX1P2-1040DT1 |
| Controller 1220 (Display 1224) (shown, e.g., in FIGS. 12 and 20A) | Omron | NA5-9W001B-V1 |
| Roller Motor Assembly 74 (shown, e.g., in FIGS. 1B and 16) | Browning | CBN3252SB350PT24145T1.5 |
| Spindle Rotation Motor 1020 (shown, e.g., in FIGS. 3 and 16) | SureStep | STP-MTRH-34127 |
| (Spindle Lock) Cylinder 316 (shown, e.g., in FIGS. 3 and 19A) | SMC | NCDQ2B32-75DMZ M9PMAPC |
| Proximity Switch 1120 (shown, e.g., in FIGS. 11 and 19A) | IFM Efector | IS5035 |
| Safety Mat (not shown) | Larco Industrial | N/A |
| Gear Drive 754 (shown, e.g., in FIG. 7) | Stober | P322SPR0200MTL |

Figure 21A:
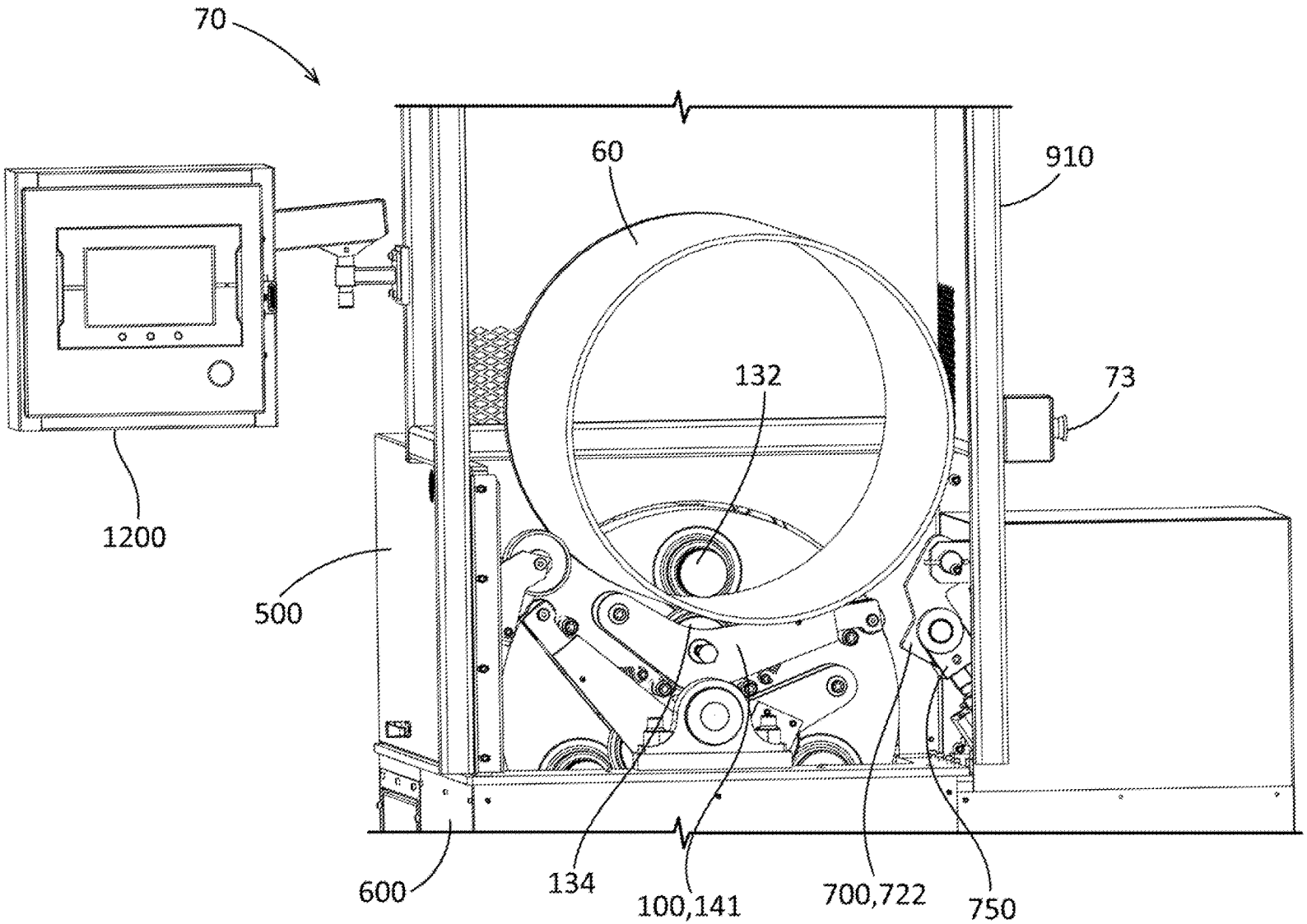
FIG. 21A is a front top left perspective view of the pipe groover of FIG. 1A showing a pipe engaged with the pipe groover in accordance with another aspect of the current disclosure.

FIG. 21A is a front top left perspective view of the pipe groover 70 of FIG. 1A showing the pipe 60 engaged with the pipe groover 70 in accordance with another aspect of the current disclosure. The load arm 722 of the spindle ram assembly 700 is shown connected to the actuator 750 but disengaged from the pivot arm 141 of the spindle assembly 100, and the pipe 60 is positioned but not clamped between the rollers 132,134. In some aspects, as shown, the stop switch 73 can be secured to the pipe sensor enclosure 910. Some surrounding parts have been removed and are hidden for clarity. In some aspects, as shown, the actuator 750 can extend towards the pivot arm 141 and otherwise operate in a transverse direction with respect to the spindle plate 110 and the pipe 60 during operation, i.e., movement of a ram of the actuator 750 can be parallel to the spindle plate 110 and perpendicular to the pipe 60. In some aspects, as shown, the actuator 750 can facilitate grooving of the pipe 60 from the bottom of the pipe. In other aspects, the actuator 750 can be oriented to facilitate grooving at the top of the pipe without any or all of the other improvements disclosed herein.

Figure 21B:
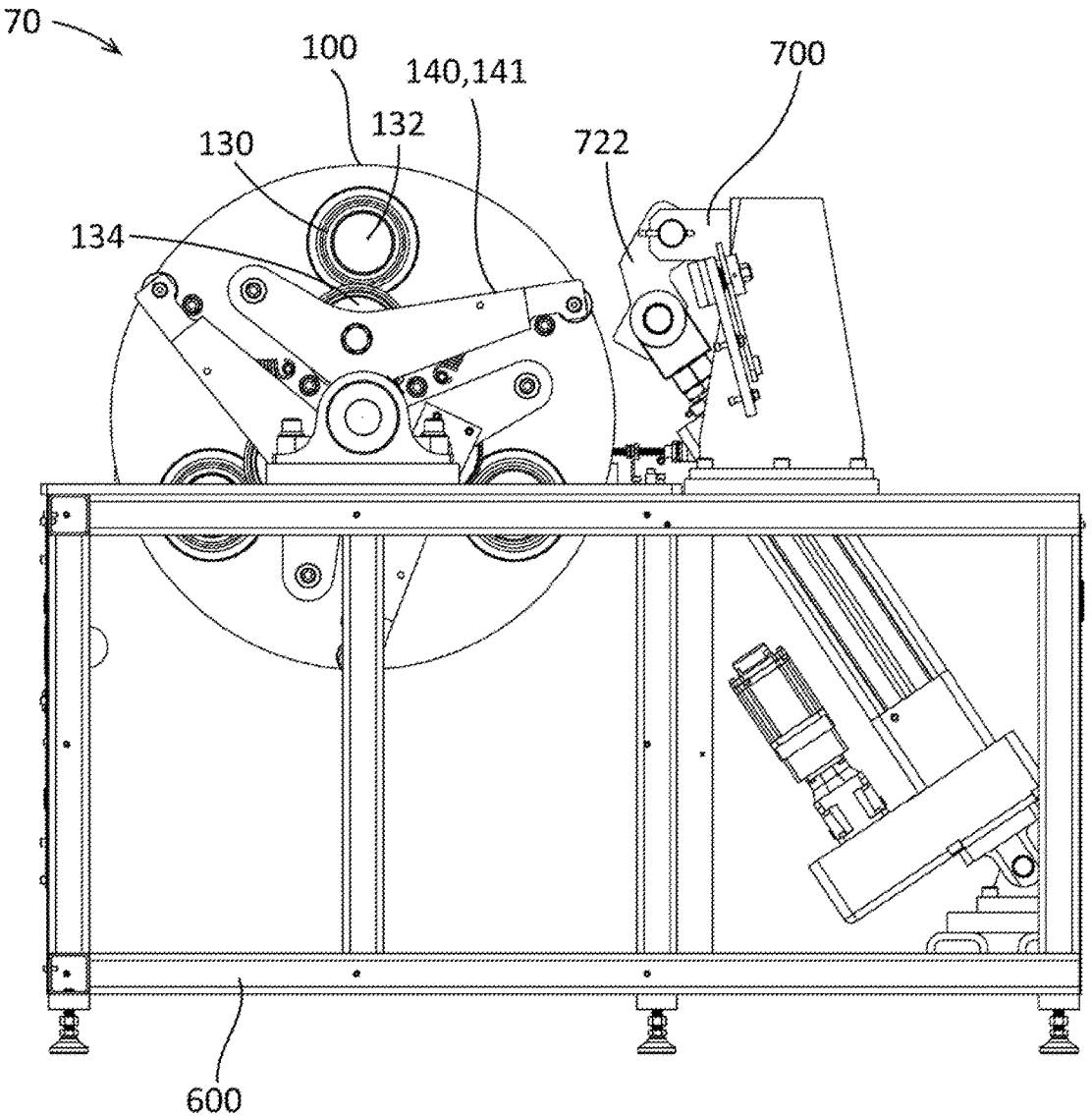
FIG. 21B is a front elevation view of the pipe groover of FIG. 1A showing the spindle assembly of FIG. 10, the base assembly of FIG. 6, and the spindle ram assembly of FIG. 7 and with surrounding parts removed.
Figure 21C:
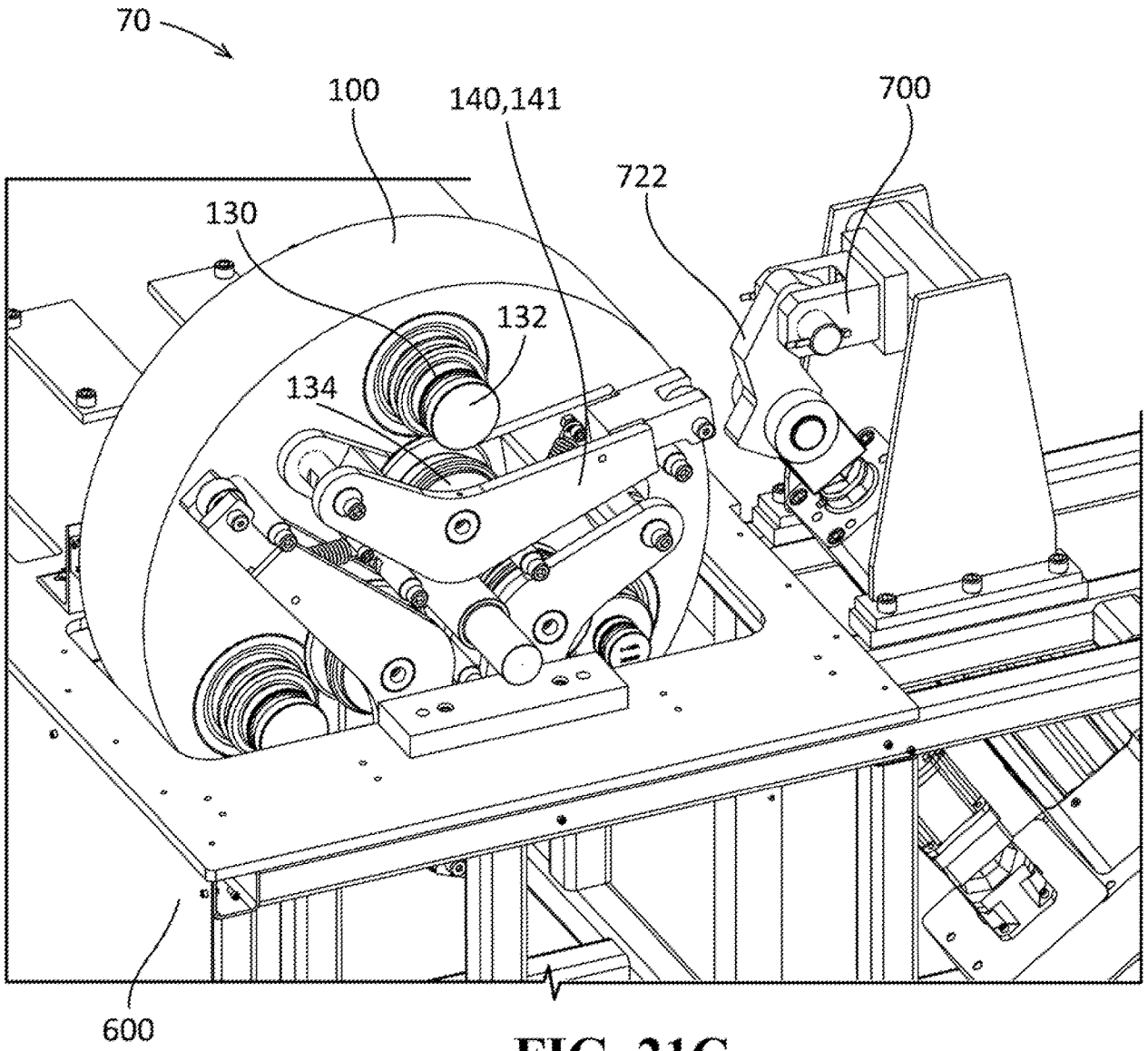
FIG. 21C is a front top left perspective view of the pipe groover of FIG. 1A in the condition shown in FIG. 17B.

FIG. 21B is a front elevation view of the pipe groover 70 of FIG. 1A showing the spindle assembly 100 of FIG. 10, the base assembly 600 of FIG. 6, and the spindle ram assembly 700 of FIG. 7 and with surrounding parts removed; and FIG. 21C is a front top left perspective view of the pipe groover 70 of FIG. 1A in the condition shown in FIG. 17B. The load arm 722 of the spindle ram assembly 700 is shown disengaged from the pivot arm 141 of the spindle assembly 100. More generally, any one of the pivot arm assemblies 140 and the corresponding roller assembly 130 can be configured in an "active" position (available for immediate use by the operator) to receive the pipe 60 therebetween and form the groove 68 (shown in FIG. 1A) in the pipe 60 (shown in FIG. 1A).

Figure 22A:
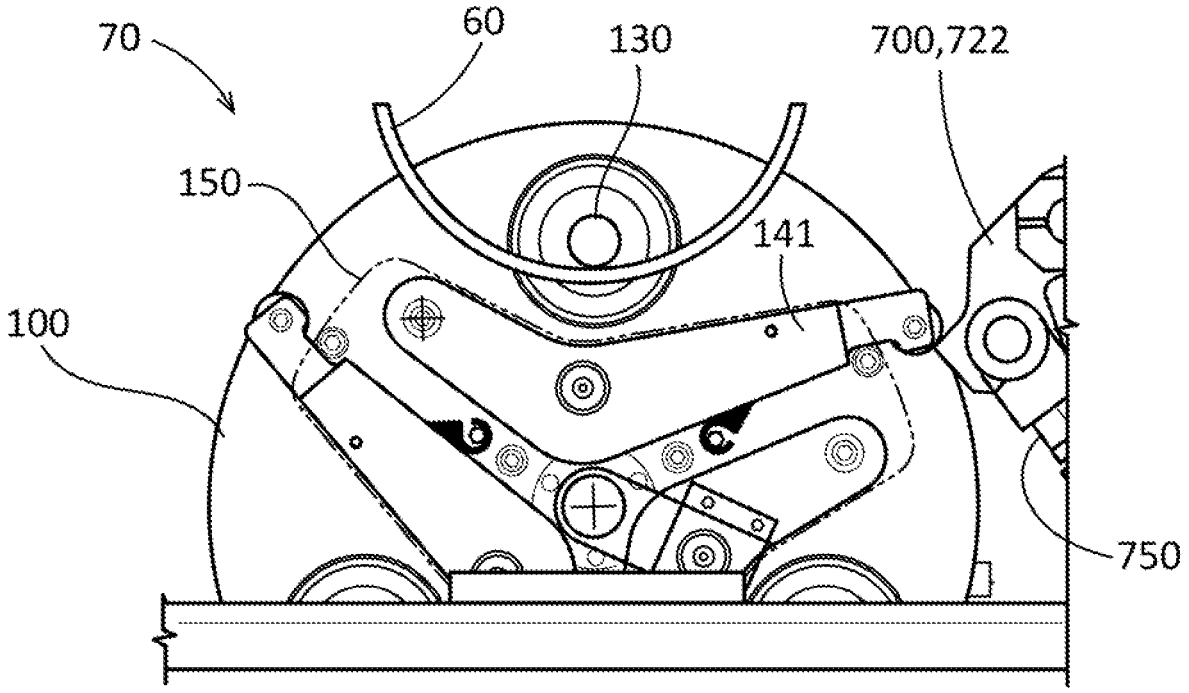
FIG. 22A is a front side perspective view of a front of the spindle assembly of FIG. 10 in a locked condition and showing an actuator of the spindle ram assembly engaged with a pivot arm of the spindle assembly of FIG. 10 and showing the pivot arm disengaged from the pipe.

FIG. 22A is a front side perspective view of a front of the spindle assembly 100 of FIG. 10 in a locked condition and showing the actuator 750 and, more specifically, the load arm 722 of the spindle ram assembly 700 engaged with the pivot arm 141 of the spindle assembly 100 of FIG. 10 and showing the pivot arm 141 and, more directly, the roller assembly 130 disengaged from the pipe 60.

Figure 22B:
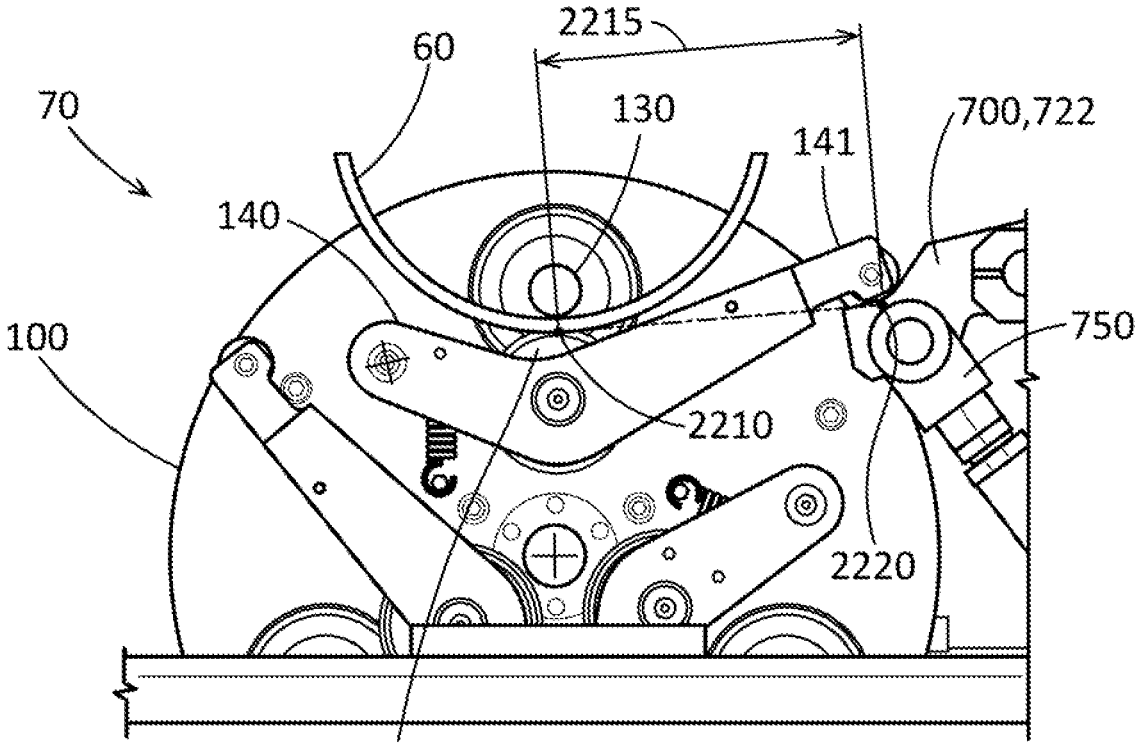
FIG. 22B is a front side perspective view of a front of the spindle assembly of FIG. 10 in a locked condition and showing an actuator of the spindle ram assembly engaged with a pivot arm of the spindle assembly of FIG. 10 and showing the pivot arm engaged with the pipe.

FIG. 22B is a front side perspective view of a front of the spindle assembly 100 of FIG. 10 in a locked condition and showing an actuator 750 and, more specifically, the load arm 722 of the spindle ram assembly 700 engaged with a pivot arm 141 of the spindle assembly 100 of FIG. 10 and showing the pivot arm 141 and, more directly, the roller assembly 130 engaged with the pipe 60. Through mechanical advantage using the pivot arm 141 as a lever, which can be pushed by a portion of the spindle ram assembly 700 such as the load arm 722, the pivot arm 141 can form the groove 68 with a lower force than would otherwise be necessary. As shown, a lever arm distance 2215 can be defined between a pair of load points such as a contact point 2210 where the pipe 60 and the active outer roller 134 are in contact and a contact point 2220 where the actuator 750 and the active pivot arm assembly 140 are in contact.

Figure 23A:
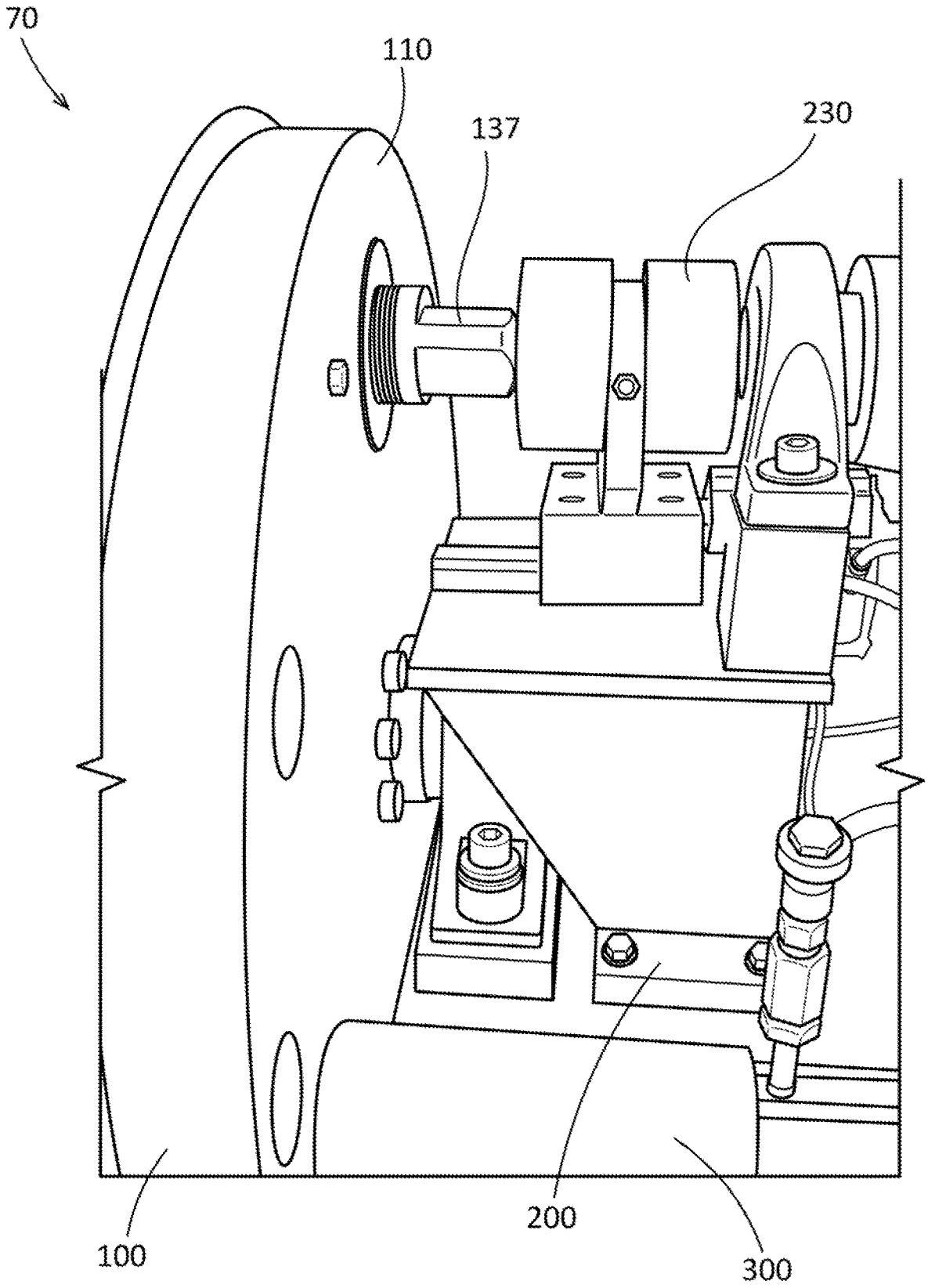
FIG. 23A is a right rear perspective view of the spindle assembly of FIG. 10 in an unlocked condition showing a slide coupling of the yoke assembly of FIG. 2 disengaged from a roller shaft of the spindle assembly and a rod of the spindle lock assembly of FIG. 3 disengaged from the spindle plate of FIGS. 1E and 1F.

FIG. 23A is a right side perspective view of a rear of the spindle assembly 100 of FIG. 10 in an unlocked condition showing a slide coupling 230 of the yoke assembly 200 of FIG. 2 disengaged from a roller shaft 137 of the spindle assembly 100 and the rod 314 (shown in FIG. 19B) of the spindle lock assembly 300 of FIG. 3 disengaged from the spindle plate 110 of FIGS. 1E and 1F. Such disengagement can facilitate rotation of the spindle assembly 100 between roller assemblies 130 (shown in FIG. 10) so that different pipes 60 (shown in FIG. 1A) can be grooved, such as by simply making a selection on the controller (shown in FIG. 12) instead of physically removing and installing a new roller assembly 130 for each such change.

Figure 23B:
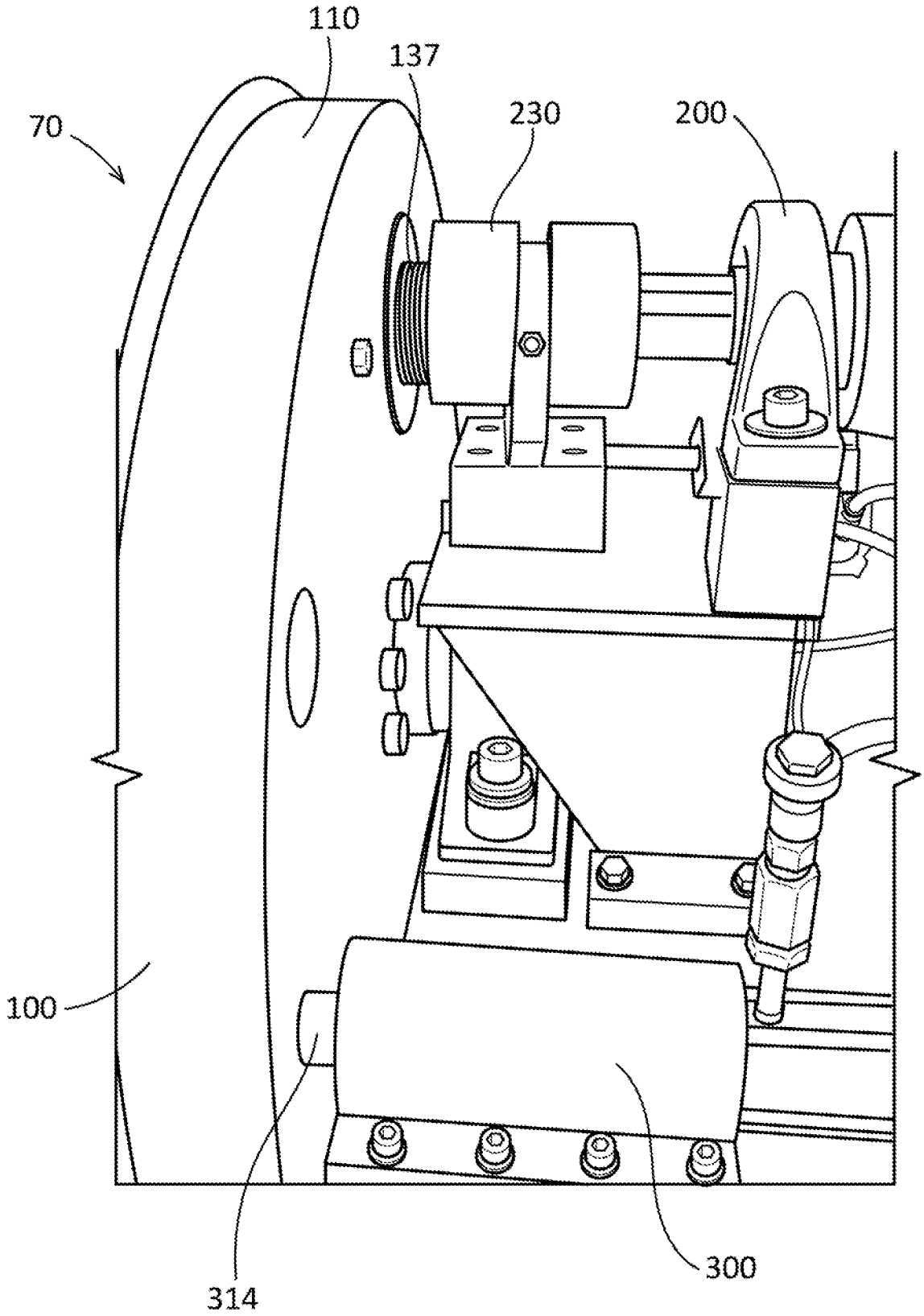
FIG. 23B is a right rear perspective view of the spindle assembly of FIG. 10 in a locked condition showing the slide coupling of the yoke assembly of FIG. 2 engaged with the roller shaft of the spindle assembly and a rod of the spindle lock assembly of FIG. 3 engaged from the spindle plate of FIGS. 1E and 1F.

FIG. 23B is a right side perspective view of a rear of the spindle assembly 100 of FIG. 10 in a locked condition showing the slide coupling 230 of the yoke assembly 200 of FIG. 2 engaged with a roller shaft 137 of the spindle assembly 100 and the rod 314 of the spindle lock assembly 300 of FIG. 3 engaged with the spindle plate 110 of FIGS. 1E and 1F. Such engagement can facilitate a tight and stable connection between the roller motor assembly 74 and the roller assembly 130 during the pipe grooving operation.

Figure 24:
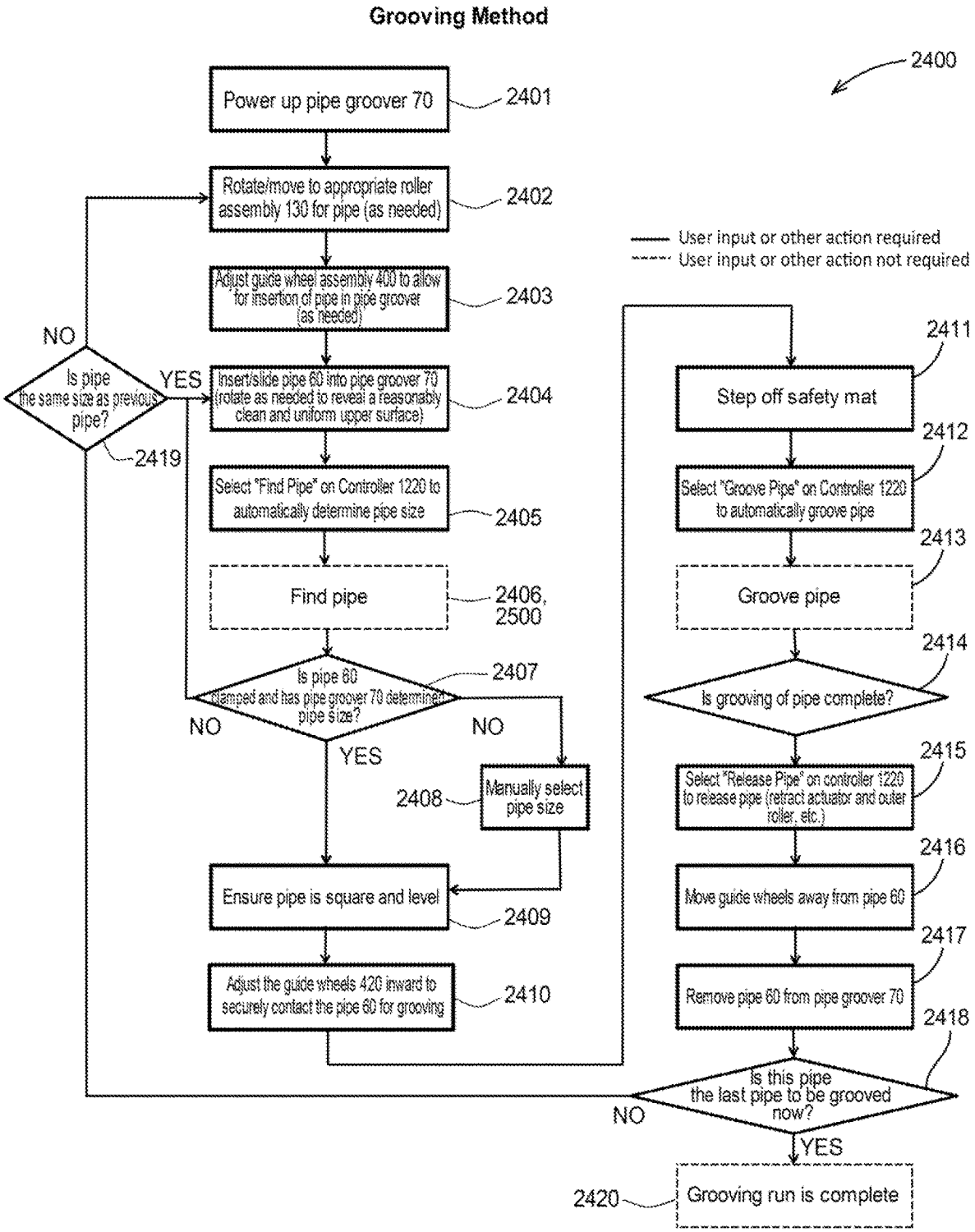
FIG. 24 is a flowchart showing a method for grooving the pipe using the pipe groover of FIG. 1B.

FIG. 24 is a flowchart 2400 showing a method for grooving the pipe 60 using the pipe groover 70 of FIG. 1B. The method can comprise steps 2401-2420. A step 2401 can comprise an operator powering up the pipe groover 70. A step 2402 can comprise the operator selecting, as needed, an appropriate roller assembly 130 for the pipe 60 to be grooved and the pipe groover 70 moving the selected roller assembly 130 to an active position of the spindle assembly 100. A step 2403 can comprise the operator adjusting, as needed, the guide wheel assembly 400 and, more specifically, the wheels 420 to allow the pipe 60 to be inserted into the pipe groover 70. A step 2404 can comprise the operator inserting or sliding the pipe 60 into the pipe groover 70. A step 2405 can comprise the operator selecting "Find Pipe" on the controller 1220 to initiate a routine in which the pipe groover 70 automatically determines the size of the pipe 60 based upon measurements by the sensor 950 (shown in FIG. 9A), which can lead to a calculated diameter and wall thickness. The size of the pipe 60 can be determined with a reasonable degree of certainty because the dimensions of fabricated pipes generally fall within predictable tolerance ranges, at least if the pipes are fabricated according to industry specifications. A step 2406 described below with respect to the flowchart 2500 can comprise, through measurement and calculation and drawing of data from a database, the pipe groover 70 automatically (i.e., without operator intervention) determining the size of the pipe 60 so that the pipe 60 can be properly grooved, also automatically. A step 2407 can comprise the operator determining whether the pipe 60 is still clamped and whether the pipe groover 70 has determined the size of the pipe 60.

If the answer is "NO" during step 2407, the operator can take one of at least two paths. In a first path, the operator can restart the process from step 2404 and, as needed, rotate the pipe 60 to reveal a clean top surface thereof. In some aspects, an unusually uneven outer surface 62 (shown in FIG. 15A) or an unusually dull, reflective, or contaminated surface can cause the pipe groover 70 to occasionally obtain incorrect readings. In some aspects, rotating the pipe 60 to reveal a different portion of the pipe 60 can result in better readings, which can then be sufficiently clear to determine the size of the pipe 60. If the answer is "NO" during step 2407, a step 2408 can comprise the operator manually selecting or entering the pipe size via the controller 1220. Note that, for additional cost, the sensor 950 can be adjusted or replaced with a sensor of higher sensitivity in order to adjust for variations in the pipe 60 or measure the pipe 60 with greater sensitivity and/or accuracy and therefore also fewer or no errors.

If the answer is "YES" during step 2407, the operator can continue with a step 2409, in which the operator can ensure that the pipe 60 is square with respect to the pipe groover 70 (substantially perpendicular to a front of the pipe groover 70 and level (i.e., in a horizontal orientation). The operator can facilitate square and level orientation of the pipe 60 by supporting a free end of the pipe or a significant portion of the pipe 60, including ideally a center of gravity thereof, in a pipe cradle. For example, the pipe 60 can be supported by a lift-and-turn device such as Model FIG NAP LT such as available from ASC Engineered Solutions.

A step 2410 can comprise the operator adjusting, as needed, the guide wheel assembly 400 and, more specifically, the wheels 420 inward to securely contact the pipe 60 for grooving. A step 2411 can comprise the operator stepping off the safety mat (not shown) positioned directly in front of the machine where the grooving takes place. The safety mat can, when stepped on, be the stop switch 73 and can be configured to work like the aforementioned emergency stop and can be tied directly into the safety circuits 1720,1740. A step 2412 can comprise the operating selecting "Groove Pipe" on the controller 1220 to automatically groove the pipe 60. A step 2413 can comprise, through the previous identification of the pipe 60 and information about the proper settings for grooving the pipe 60, the pipe groover 70 automatically forming the groove 68 in the pipe 60. A step 2414 can comprise the operator determining if the step 2413 of grooving of the pipe 60 is complete. In some aspects, it will be clear to the operator due to audible or other indications by the pipe groover 70 that the work is complete. A step 2415 can comprise selecting "Release Pipe" on the controller 1220 to release the pipe 60 from engagement with the active roller assembly 130. A step 2416 can comprise, as needed, the operator moving the wheels 420 away from the pipe 60 to facilitate removal of the pipe 60. A step 2417 can comprise removing the pipe 60 from the pipe groover 70. A step 2418 can comprise the operator determining whether the pipe 60 just grooved is the last pipe to be grooved in the grooving run.

If the answer is "NO," a step 2419 can comprise repeating the grooving process from one of the early steps. A step 2419 can comprise the operating determining whether the next pipe 60 is the same size as the previous pipe. If the answer is "NO," the operator can restart the grooving process from the step 2402. If the answer is "YES," the operator can restart the grooving process from the step 2404, in which case the pipe groover 70 has already been set up and is ready for the next pipe 60, which is the same size as the previous pipe 60.

If the answer is "YES" during the step 2418, a step 2420 can comprise immediate completion of the grooving run.

Figure 25:
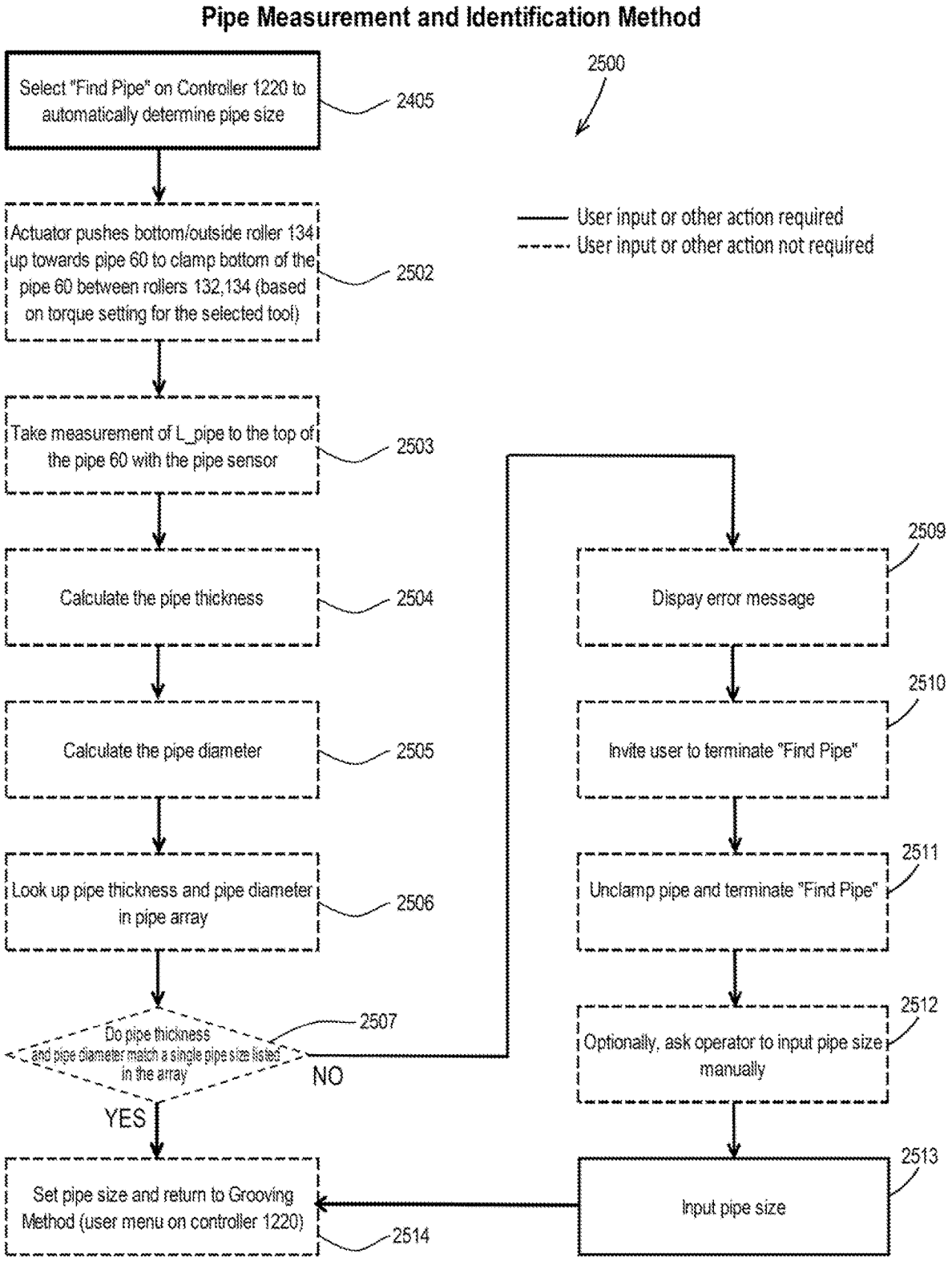
FIG. 25 is a flowchart showing a portion of the method of FIG. 24, specifically comprising a method for determining the size of the pipe using the pipe groover of FIG. 1B and, more specifically, the pipe sensor assembly of FIG. 9A.

FIG. 25 is a flowchart 2500 showing a portion of the method of FIG. 24, specifically comprising a method for measuring and identifying the size of the pipe 60 using the pipe groover 70 of FIG. 1B and, more specifically, the pipe sensor assembly 900 of FIG. 9A. The method can comprise the previously discussed step 2005, at least as the initiating step, and new steps 2502-2514. Again, the step 2405 can comprise the operating selling "Find Pipe" on the controller 1220. The step 2502 can comprise the pipe groover 70 pushing the outer roller 134 towards the pipe 60 to clamp the bottom of the pipe 60 between the rollers 132,134. The pipe 60 can be sufficiently clamped in place when the internal torque applied by the actuator 750 reaches a predetermined setting that has been found appropriate for the material and approximate size of the pipe 60, and when at the predetermined torque setting a position of the actuator/ram can stop changing. The pipe groover 70 can use a torque setting based on information for a large variety of pipe sizes saved in an array of values, for example. Such an exemplary array, titled "Tool Array Data," can be found in FIG. 28 and can list torque as a percentage (for example, 10% or 12%) of the total or maximum available torque for a particular actuator 750. A step 2503 can comprise the pipe groover taking a measuring a variable named "L-pipe," which is a distance between the top of the pipe 60 and an exit of the sensor 950. As will be described separately, a step 2504 can comprise calculating the pipe thickness and a step 2505 can comprise calculating the pipe diameter. A step 2506 can comprise the pipe groover 70 and, more specifically, the controller 1220 looking up the pipe thickness and pipe diameter saved in a "pipe array," i.e., in an array of values representing the possible pipes 60 that might possibly be grooved by the pipe groover 70. Such exemplary array, titled "Pipe Array Data," can be found in FIGS. 29A-29D. A step 2507 can comprise the pipe groover 70 determining whether the calculated pipe thickness and the calculated pipe diameter match a pipe size listed in the array.

If the answer is "NO," a step 2509 can comprise the pipe groover 70 displaying an error message, which can communicate to the user that a match has not been made. A step 2510 can comprise the pipe groover 70 inviting the operator to terminate the "Find Pipe" routine. A step 2511 can comprise the pipe groover 70 unclamping the pipe 60 and terminating the "Find Pipe" routine. A step 2512 can comprise, optionally, asking the operator to manually enter the pipe size. A step 2513 can comprise the operator manually inputting the pipe size. As an alternative, the method can comprise the operator repeating the process from steps 2402 to 2404 of the flowchart 2400 but with a new portion of the outer surface 62 of the pipe 60 visible to the sensor 950. In some aspects, for example, a reflectivity of the pipe outer surface and a size of the pipe and proximity of the pipe surface to the sensor can impact the ease at which the pipe 60 can be identified. A step 2514 can comprise the pipe groover 70 setting the pipe size manually and returning to the flowchart 2400 at step 2407 or step 2409, as appropriate, based on whether the pipe groover 70 has successfully determined the size of the pipe 60. While it may be rare for the pipe groover 70 not to identify the pipe size, neither of the flowcharts 2400,2500 takes for granted that the "Find Pipe" routine has been successful completed.

If the answer is "YES" during the step 2507, the step 2514 to complete the "Find Pipe" routine can be immediately initiated. In some aspects, the "Find Pipe" routine can take only a few seconds to perform. In some aspects, for example, the "Find Pipe" routine can take about five seconds or less.

In some aspects, as shown, various steps in the flowcharts 2400,2500 capturing exemplary methods can require user input or other action or not require user input or other action. In some aspects, one or more of these same steps can be rendered optional or may be unnecessary given the circumstances.

Using FIGS. 26A-29C, the detailed measurements and calculations embedded in the "Find Pipe" method of the pipe groover 70 automatically determining the size of the pipe 60 will be described in further detail below.

Figure 26A:
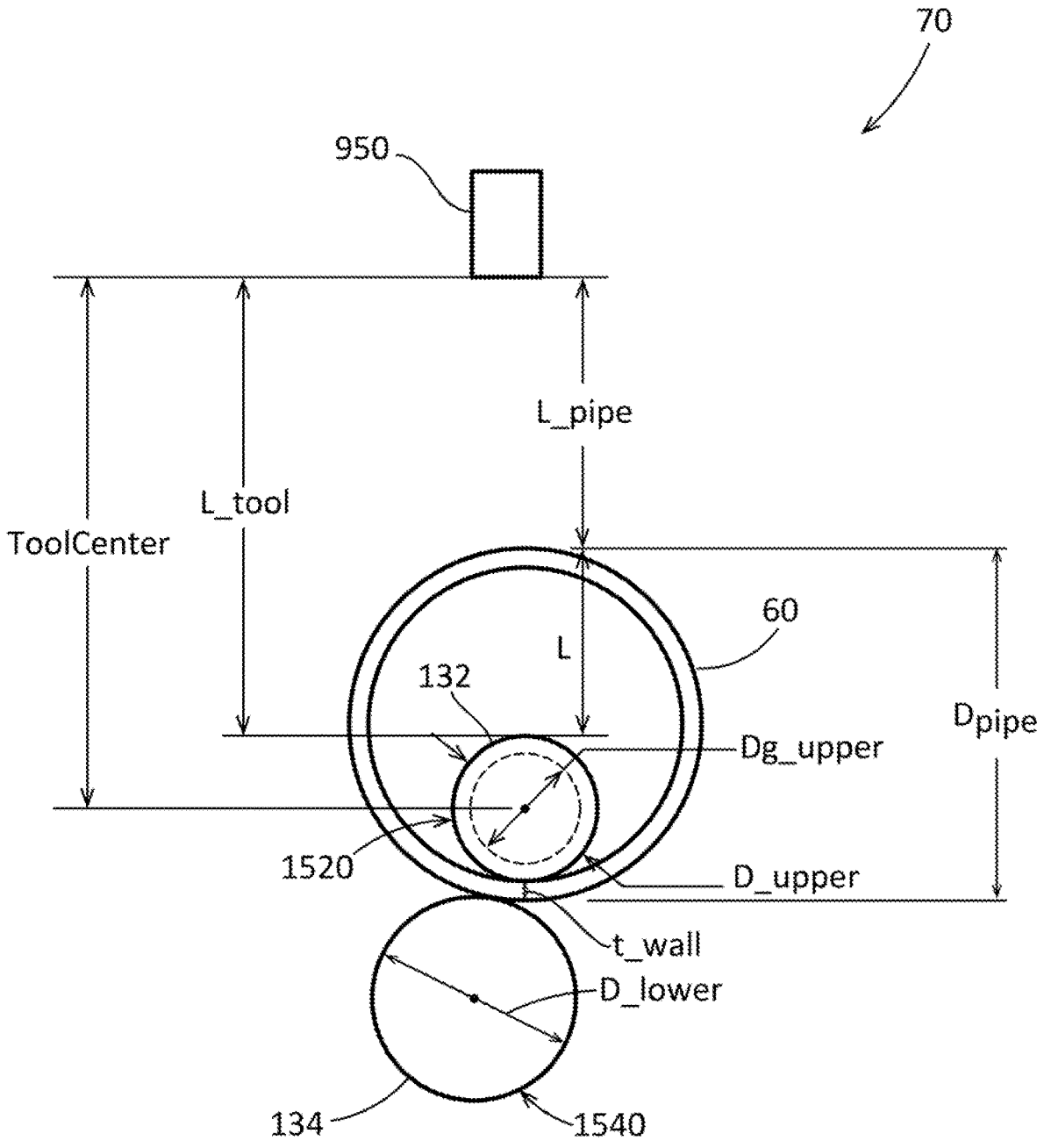
FIG. 26A is a sectional view of the pipe groover showing the pipe of FIG. 1A, an inner roller and an outer roller of the plurality of rollers of FIG. 1F, and a sensor of the pipe sensor assembly of FIG. 9A.

FIG. 26A is a sectional view of the pipe groover 70 showing the pipe 60, the inner roller 132, the outer roller 134, and the sensor 950 (which can be the "measure sensor" identified in one or more of the electrical schematics of FIGS. 16-20B) of the sensor assembly 900 (shown in FIG. 9A). A method for setting up the pipe groover 70 can comprise taking and gathering measurements and calculations and building an array or table of such measurements and calculations for various roller assemblies 130 (shown in FIG. 10) and pipes 60 (shown in FIG. 1A). A variety of variables can relate to the method of measuring and identifying the size of the pipe 60 with the pipe groover 70. The first set of variables below, defined also below, can be used in setting up the pipe groover 70:

- ToolCenter—Distance from an exit of the pipe sensor 950, which again can be the aforementioned "measure sensor" for purposes of the explanation of the method, to a center of the upper or inner roller 132.
- L_tool—Distance from measure sensor to top of upper roller.
- MeasureSensorAvg—An average of the L_tool measurements.
- MeasureSensorInches—Real-time distance reading of the measure sensor without correction.
- MeasureSensorCorrected—Real-time distance reading of the measure sensor with correction to adjust for linearity.

The variable ToolCenter can be derived once through measurement and calculation for each tool position (e.g., positions 1, 2, or 3 in a three-head spindle assembly) during setup of the pipe groover 70. The ToolCenter figure is found for the first tool position by measuring the distance L_tool, which is a distance from the sensor to the top of the upper or inner roller 132, and determining MeasurSensorAvg by averaging the L_tool measurements over a period of time such as, for example and without limitation, 5 seconds while rotating the inner roller 132. Note that when the sensor 950 is a laser sensor, the technician can easily confirm what portion of the roller assembly 130 is being measured by the sensor 950 by where the light from the laser is reflecting off the roller assembly 130 and can adjust as needed. Moreover, the motor 941 can automatically move to a predetermined position, dependent on the tool size, so that it always measures to an outer diameter of a rolling surface (which can be a knurled surface) of the inner roller 132. The predetermined position can be one of the Tool Array parameters (SensorPosition). In any case, the following equation can be used to determine ToolCenter for a particular tool position.

$$ToolCenter = MeasureSensorAvg(\text{as } a \text{ function of } L_{tool}) + \left(\frac{D_{upper}}{2}\right)$$

This process can be repeated for the remaining tool positions, and the same size roller assembly 130 can be used for each tool position. Moreover, once ToolCenter is derived, it can and typically does remain constant. When actual measurements with the sensor 950 of objects at known distances from the sensor 950 across a full range of the sensor 950 reveal deviation between the measurements and the known distances, MeasureSensorCorrected values can be gathered by adjusting the MeasureSensorInches values for linearity. In other words, the measured values can be made to align with the actual known values by applying an adjustment at each point along the full range of the sensor. This can essentially result in calibration of the sensor 950 and more accurate results. While ToolCenter is helpful, by itself it does not directly provide the size of the pipe 60, and further input can be helpful in this regard, naturally including measurements of the pipe 60 itself.

Figure 26B:
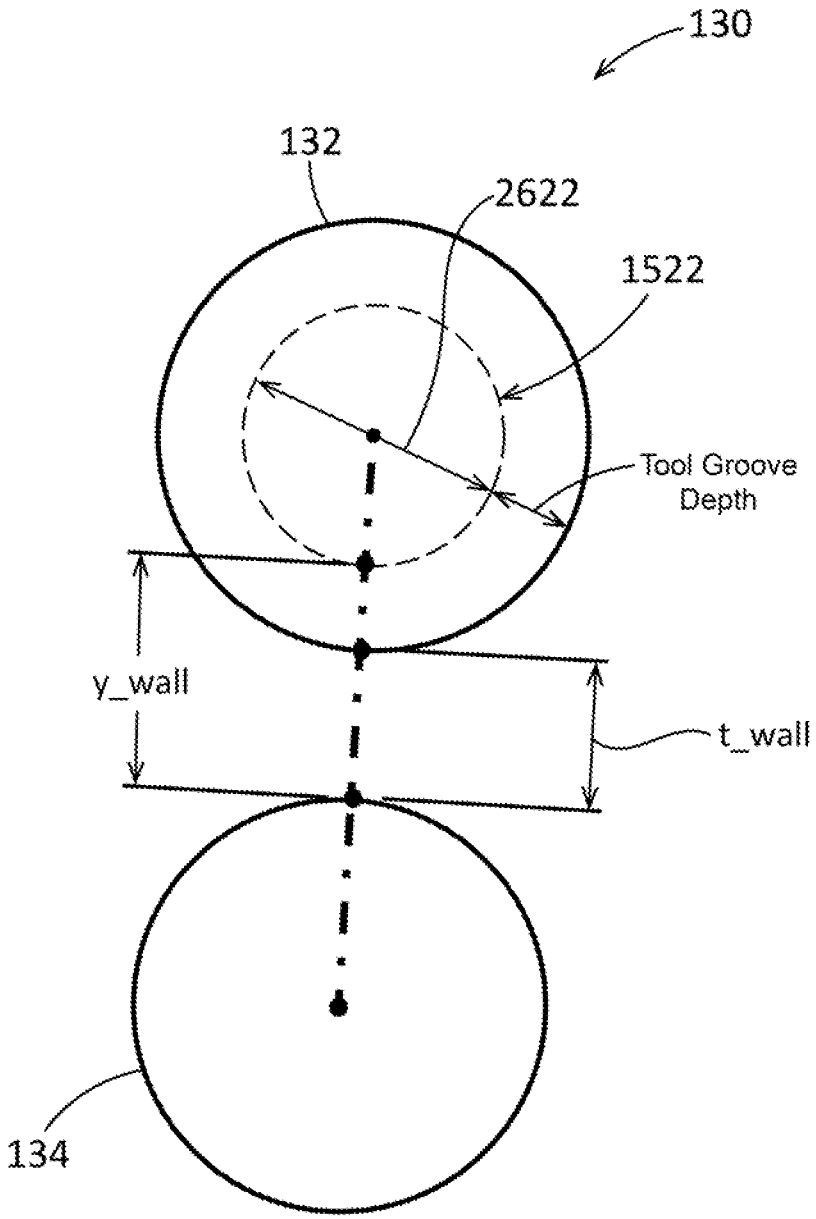
FIG. 26B is a sectional view of the roller assembly of the pipe groover showing just the inner roller and the outer roller.

FIG. 26B is a sectional view of the roller assembly 130 of the pipe groover 70 (shown in FIG. 1A) showing just the inner roller 132 and the outer roller 134. Referring now to both FIG. 26A and FIG. 26B and also FIGS. 27A and 27B, the following additional variables, defined also below, can be gathered:

- L_pipe ($L_{pipe}$)—Distance from measure sensor to top of the pipe 60. If L_pipe equals L_tool, the pipe groover 70 can thereby determine that no pipe 60 has been inserted and can lock out some functionality until the pipe 60 has been inserted.
- t_wall ($t_{wall}$) Calculated wall thickness. Distance between the outer surface 1540 (shown in FIG. 15B) of the outside (bottom) roller 134 to the outer surface 1520 (shown in FIG. 15B) of the inner (upper) roller 132 (see FIG. 26B).
- D_pipe ($D_{pipe}$)—Calculated pipe diameter.
- Dg_upper ($Dg_{upper}$)—Diameter of the groove of the upper roller 132
- D_upper ($D_{upper}$)—Outer diameter of the upper roller 132
- D_lower ($D_{lower}$)—Outer diameter of the lower roller 134

ToolGrooveDepth—Distance between the outer diameter of the upper roller 132 (D_upper) and the diameter of the groove of the upper roller 132 (Dg_upper).

y_wall ($y_{wall}$)—Distance between the outer diameter of the outside (bottom) roller 134 to a bottom or radially innermost portion of the groove-forming recess 1522 of the inner (upper) roller 132 (see FIG. 22B) forming a groove diameter 2622.

x—Actuator Position

Figure 27A:
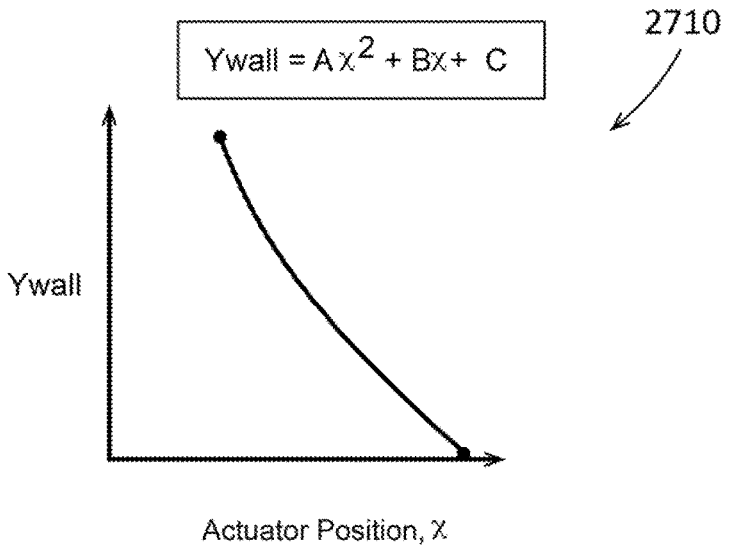
FIG. 27A is a graph showing a relationship between a distance y_wall between the inner roller and the outer roller and a position of the actuator relative to an axis of the actuator in accordance with one aspect of the current disclosure.

A— Constant determined by polynomial line fit of Actuator Position vs Roller Distance curve B— Constant determined by polynomial line fit of Actuator Position vs Roller Distance curve C— Constant determined by polynomial line fit of Actuator Position vs Roller Distance curve FIG. 27A is a graph 2710 showing a relationship between the distance y_wall between the inner roller 132 and the outer roller 134 and a position of the actuator 750 relative to an axis of the actuator 750 in accordance with one aspect of the current disclosure. In some aspects, this relationship can be derived from actual measurements. In some aspects, this relationship can be derived—perhaps more easily and accurately, from measurements made inside a three-dimensional model of the relevant portion of the pipe groover 70. FIG. 27A shows the theoretical relationship and generic formula.

Figure 27B:
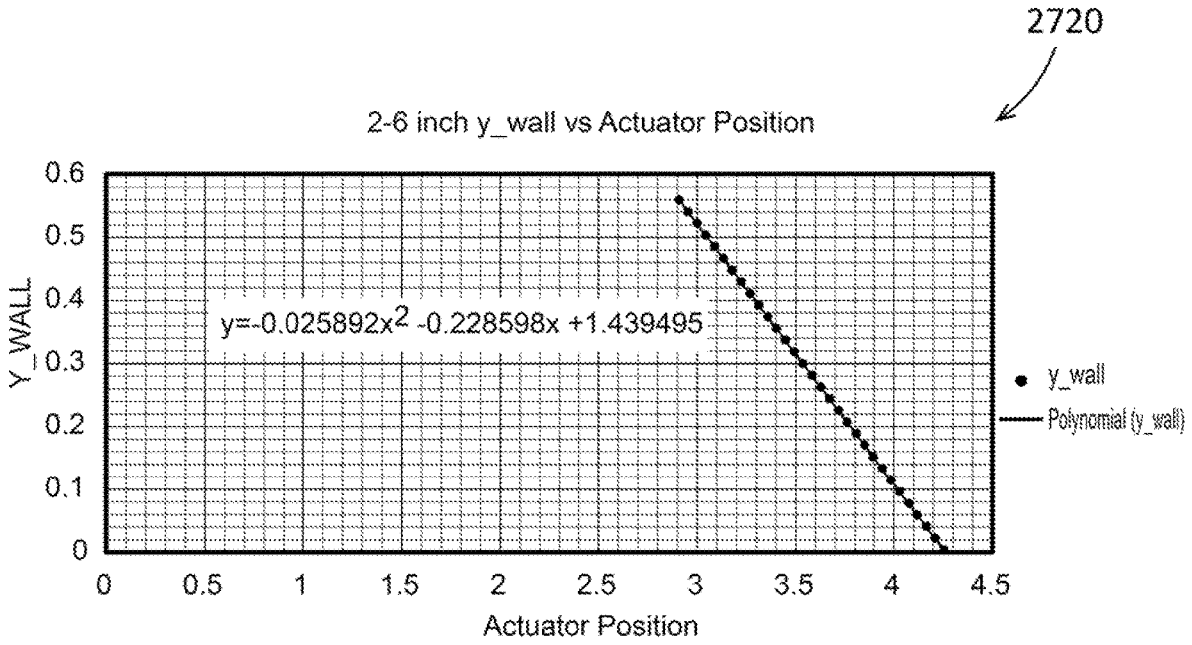
FIG. 27B is a graph showing the relationship of FIG. 27A in accordance with one aspect of the current disclosure and showing the relationship for a particular pipe size range.

FIG. 27B is a graph 2720 showing the relationship of FIG. 23A in accordance with one aspect of the current disclosure and showing the relationship for a particular pipe size range, namely 2" to 6" nominal diameter carbon steel of "standard" thickness (in contrast to Schedule 10 thickness, for example).

FIG. 28 is a table listing various parameters for an exemplary list of different tools for grooving pipe and, more specifically, the roller assemblies 130 for grooving the pipe 60. Relevant data used by the pipe groover 70 to identify the pipe size, including the values of A, B, and C useful in defining the relationship between the actuator position "x" and y_wall, can include the variables and exemplary values shown in either the table shown in FIG. 28 or in the tables shown in FIGS. 29A-29D. More specifically, for each roller set or roller assembly 130 represented, a three-dimensional model of the pipe groover 70 was used to plot y_wall versus the actuator position (x), which is a position of a rod of the actuator 750 along a longitudinal axis of the actuator 750, in order to determine the relationship between the actuator position and each roller set. In some aspects, such a method can similarly be used to prepare new data for different roller assembly 130 or combination of roller assemblies 130. In some aspects, a different method can be used such as accurate physical measurement to determine the relationship. A second order polynomial trendline was then fit to this plot in a spreadsheet program (specifically, Microsoft Excel). The constants in the equation of this trendline constitute the values for A, B, and C. This process was performed for each roller set. Again, an example of the plot for the 2"-6" carbon steel roller assembly 130 is shown in FIG. 27B.

Other data shown in the tool array table of FIG. 28 can include ToolNumber, which can represent a unique tool which can be installed and selected in the pipe groover 70; ToolHomePos, which can be the position that the actuator 750 and, more specifically, a ram thereof goes to when not grooving the pipe 60; D_upper, Dg_upper, D_lower, and L_tool, as described above; x_theoretical, which can represent a reference position of the actuator 750 based on the three-dimensional model of the pipe groover 70; PipeSizeLowerLimit and PipeSizeUpperLimit, which can represent a range of pipe dimensions for each tool (i.e., for each roller assembly 130); FindPipe Torque, which can represent the torque used to hold the pipe 60 during measurement; SensorPos, which can represent a position of the sensor 950 in the Y-axis direction relative to a reference or base value; Schedule, which can represent a standard thickness of the pipe 60; Material, which can represent a material forming the pipe 60; and Groove Cycles, which can represent the number of groove cycles experienced by that particular tool. The pipe groover 70 is not limited to use with only the exemplary variables and values shown for the pipes listed but can also be used with other data to produce pipe grooves having other specifications or to produce grooves 68 in pipes 60 not listed using the structures and methods disclosed herein.

The variables that vary by the tool assembly 130 and the variables that vary by the pipe 60, whether measured or calculated or both, can together be used to derive the pipe size using the following equations:

$$ToolGrooveDepth = \frac{D_{upper} - Dg_{upper}}{2}$$

$$t_{wall} = y_{wall} - ToolGrooveDepth = (Ax^2 + Bx + C) - ToolGrooveDepth$$

$$D_{pipe} = \left(ToolCenter + \frac{D_{upper}}{2} + t_{wall}\right) - L_{pipe}$$

As soon as the values of the variables in the above equations are known, the equations can be used to calculate the pipe wall thickness and the pipe diameter. As soon as the pipe thickness (t_wall) and diameter (D_pipe) are calculated, those values can be compared to maximum and minimum values of each pipe size in the Pipe Array (see FIGS. 29A-29D) until the below conditions are met. A material designation of the tool (in the examples provided, based on the following three material designations: carbon steel, stainless steel, and copper) can determine which pipe array to look at for comparison.

Conditions for Positive Identification of the Size of the Pipe 60:

a. MinOD≤D_pipe MaxOD b. WallMin≤t_wall WallMax

Identifying a candidate pipe defining a set of pipe specifications matching the pipe 60 can comprise confirming that two conditions are met. As a first condition, it can be confirmed that a calculated diameter of the pipe 60 (e.g., D_pipe) is greater than or equal to a low end of a tolerance range for the diameter of the candidate pipe in the database (e.g., MinOD) and less than or equal to a high end of the tolerance range (e.g., WallMax). As a second condition, it can be confirmed that a calculated wall thickness of the pipe (e.g., t_wall) is greater than or equal to a low end of a tolerance range for the wall thickness of the candidate pipe in the database (e.g., WallMin) and less than or equal to a high end of the tolerance range (e.g., WallMax).

FIGS. 29A-29D list "pipe array" data. FIG. 29A is a table listing various parameters for an exemplary list of different pipes formed from carbon steel; FIG. 29B is a table listing various parameters for an exemplary list of different pipes formed from stainless steel; and FIG. 29C is a table listing various parameters for an exemplary list of different pipes formed from copper. FIG. 29D is a table listing various parameters for an exemplary list of several other pipes including pipes formed from stainless steel and copper.

As shown, data shown in the pipe array data of FIGS. 29A-29C can include Pipe Name; Material Number; Pipe Number; MinOD; MaxOD; WallMin; WallMax; Schedule, RamGroovePos, GrooveTorque, Groove RPM, GrooveVelLimit, and FinishRevs. In addition to these data, data shown in the pipe array data of FIG. 29D and other variations of the pipe array data of FIGS. 29A-29C can include PipeHomePos and BankNumber, the latter of which is discussed below with respect to FIGS. 30-33.

Figure 30:
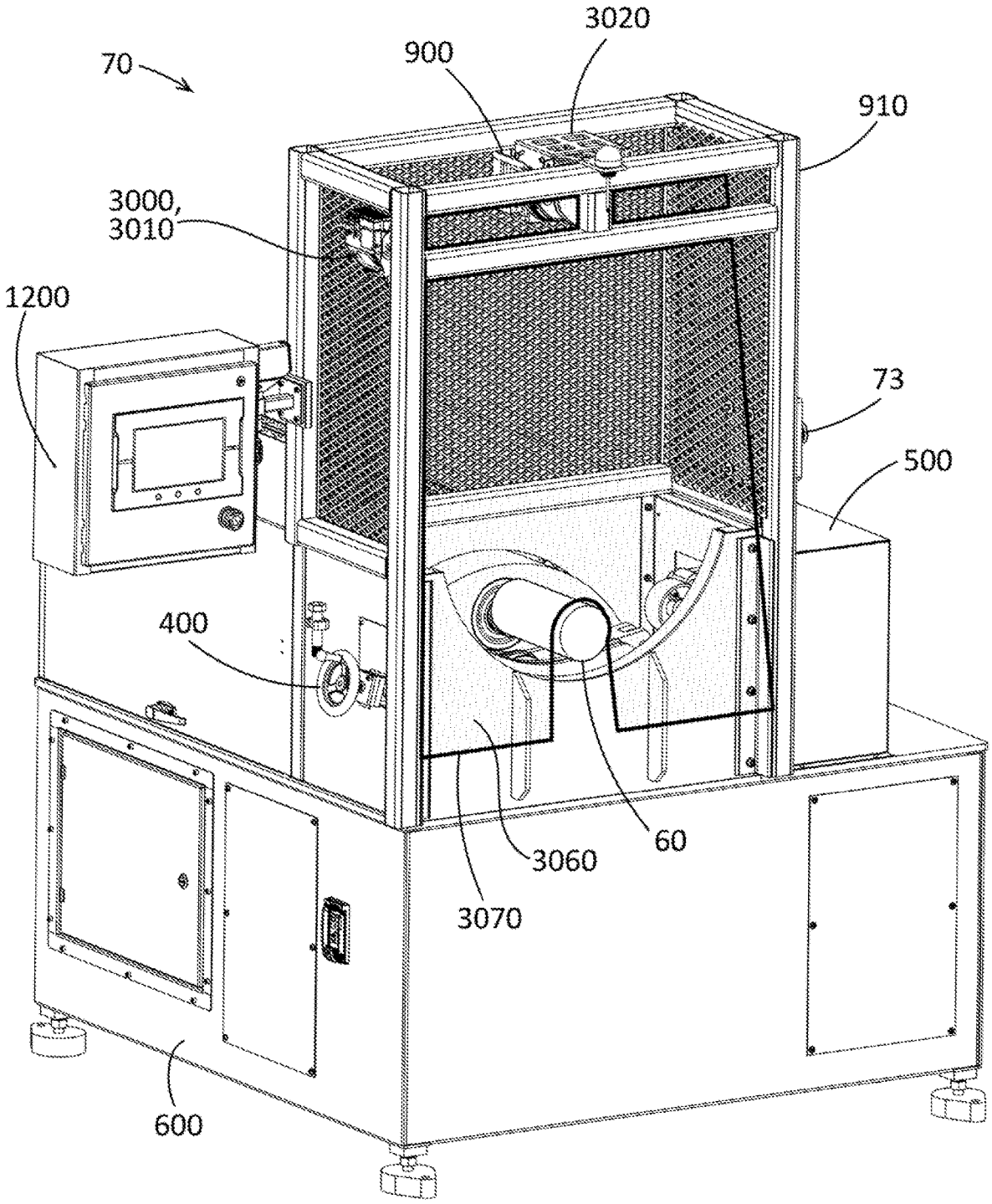
FIG. 30 is a front left perspective view of the pipe groover of FIG. 1B comprising a safety sensor system in accordance with another aspect of the current disclosure.

FIG. 30 is a front left perspective view of the pipe groover 70 of FIG. 1B comprising a safety sensor system 3000 in accordance with another aspect of the current disclosure. The safety sensor system 3000 can comprise a safety sensor scanner. For example and without limitation, the safety sensor system 3000 can comprise a safety sensor scanner model number SZ-V32NX from Keyence Corporation of American of Itasca, Illinois, U.S.A. More specifically, the safety sensor system 3000 can comprise a safety sensor controller or controller 3010 and a scanner unit 3020. In some aspects, as shown, the scanner unit 3020 can be secured to the pipe sensor enclosure 910 proximate to a top end thereof. More specifically, the scanner unit 3020 can point downward towards and extending across and, in some aspects, past a front opening of the pipe sensor enclosure 910. During the groove cycle, the safety sensor system 3000 can be active and can be set to immediately put the pipe groover 70 into a safe state (for example, turning off power to the active roller assembly 130) when a beam 3060 produced by the safety sensor system 3000 and, more specifically, the scanner unit 3020 is broken (e.g., by a hand of an operator of the pipe groover 70 that intersects the beam 3060). The profile of the beam 3060, which can be formed by a laser, can be dependent on the size of the pipe 60 that is being grooved such that the pipe 60 will not be considered to have broken the beam 3060, which can define a beam boundary 3070 such that also other structures sufficiently beyond the moving parts of the pipe groover 70 (e.g., the feet of a user, the pipe sensor enclosure 910, or other parts of the pipe groover 70) will also not be considered to have broken the beam 3060. Adjusting the beam 3060 and the beam boundary can maximize the space in front of the pipe groover 70 that is protected—as close to the pipe 60 and pipe groover 70 as desired—but without unnecessarily tripping the safety sensor system 3000. The safety sensor system 3000 can be pre-loaded or controlled with preconfigured profiles for a pipe of a wide range of sizes (e.g., one to 24 inches in diameter). During periods of inactivity (before and after grooving of the pipe 60, for example) the scanner unit 3020 can be made inactive so that the operator of the pipe groover 70 can load, level, clean, and/or unload the pipe 60 as needed without tripping the safety sensor system 3000.

The controller 3010 of the safety sensor system 3000 can facilitate operation of the scanner unit 3020 and can be mounted to a side of the pipe sensor enclosure 910 for greater visibility to an operator of the pipe groover 70. The controller 3010 can comprise a display 3110 (shown in FIG. 31) for displaying settings and/or other information to a user and/or receiving input from the user. In some aspects, the controller 3010 and the scanner unit 3020 can be coupled to each other and to the top end of the pipe sensor enclosure 910 or to another portion of the pipe groover 70, as desired, and the specifications of the beam 3060 and the beam boundary 3070 can be adjusted accordingly.

Figure 31:
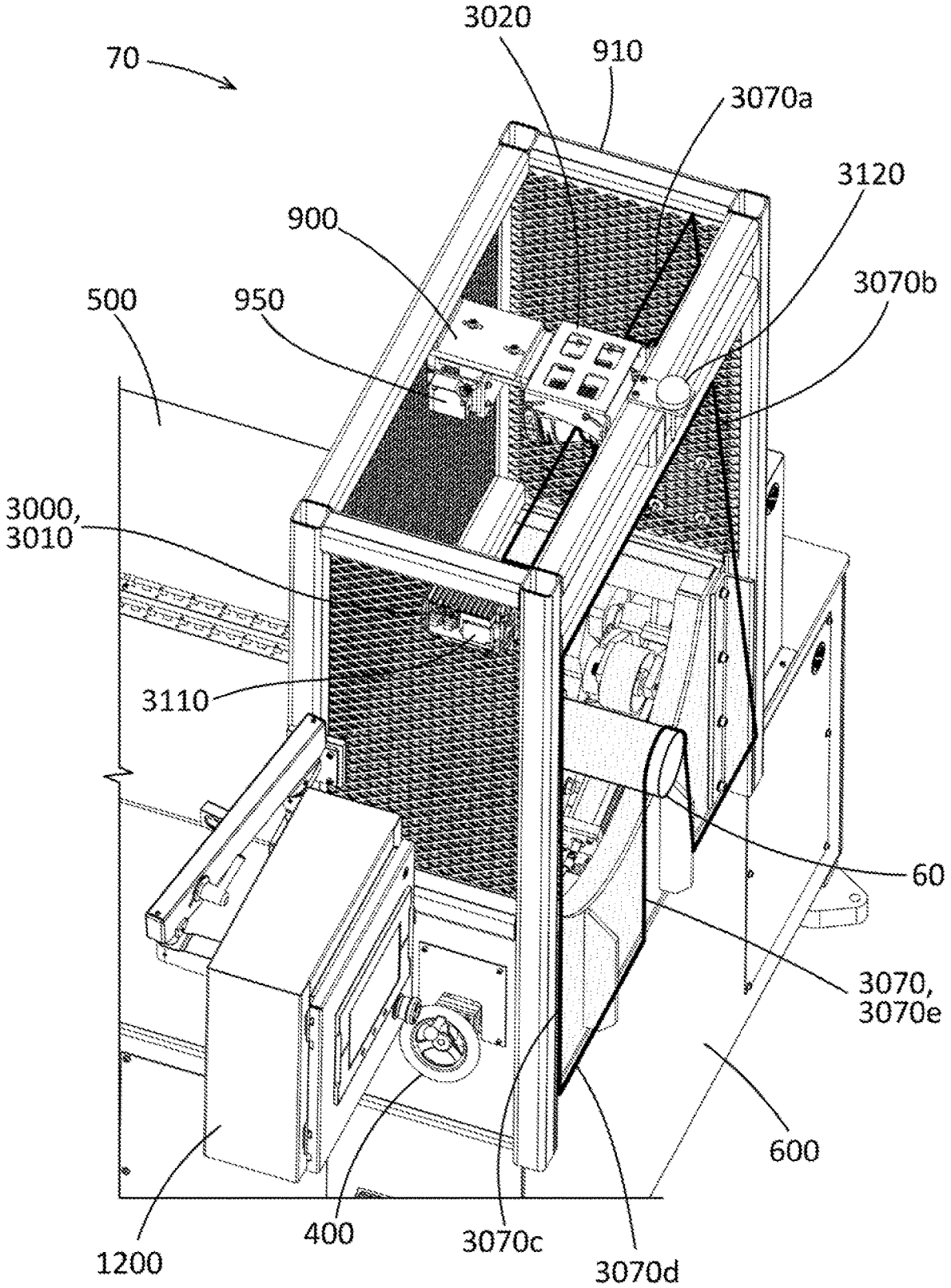
FIG. 31 is a front top left perspective detail view of the pipe groover and, more specifically, the safety sensor system of FIG. 30.

FIG. 31 is a front top left perspective detail view of the pipe groover 70 and, more specifically, the safety sensor system 3000 of FIG. 30. As shown, the beam boundary 3070 can comprise a first end or top end 3070*a*, one or more sides 3070*b,c*, a second end or bottom end 3070*d*, and one or more exception boundaries 3070*e* for avoiding a structure (e.g., the pipe 60). To be clear, the beam 3060 can extend physically past the beam boundary 3070, but reflections of the beam 3060 off objects outside the beam boundary 3070 will not cause the pipe groover 70 to enter a safe state. Again, the size and shape of the beam boundary 3070 can be adjusted as desired to match the structure of the pipe groover 70 (which can be preset based on the dimensions of the pipe groover 70, including especially those of the pipe sensor enclosure 910) as well as those of the pipe 60 being grooved (which can be adjusted automatically based on the specifications of the pipe 60 chosen automatically or through a manual process by the operator).

The safety sensor system 3000 can comprise an indicator 3120, which can indicate if the safety sensor system 3000 has been activated or tripped. In some aspects, the indicator 3120 can be or can comprise a visual indicator and can comprise a light or can be otherwise configured to produce light upon activation or tripping of the safety sensor system 3000 and, more specifically, the beam 3060 thereof. In some aspects, the indicator 3120 can be or can comprise an aural indicator and can comprise a sound-producing device (e.g., a buzzer) or can be otherwise configured to produce an audible sound upon activation or tripping of the safety sensor system 3000 and, more specifically, the beam 3060 thereof.

Figure 32:
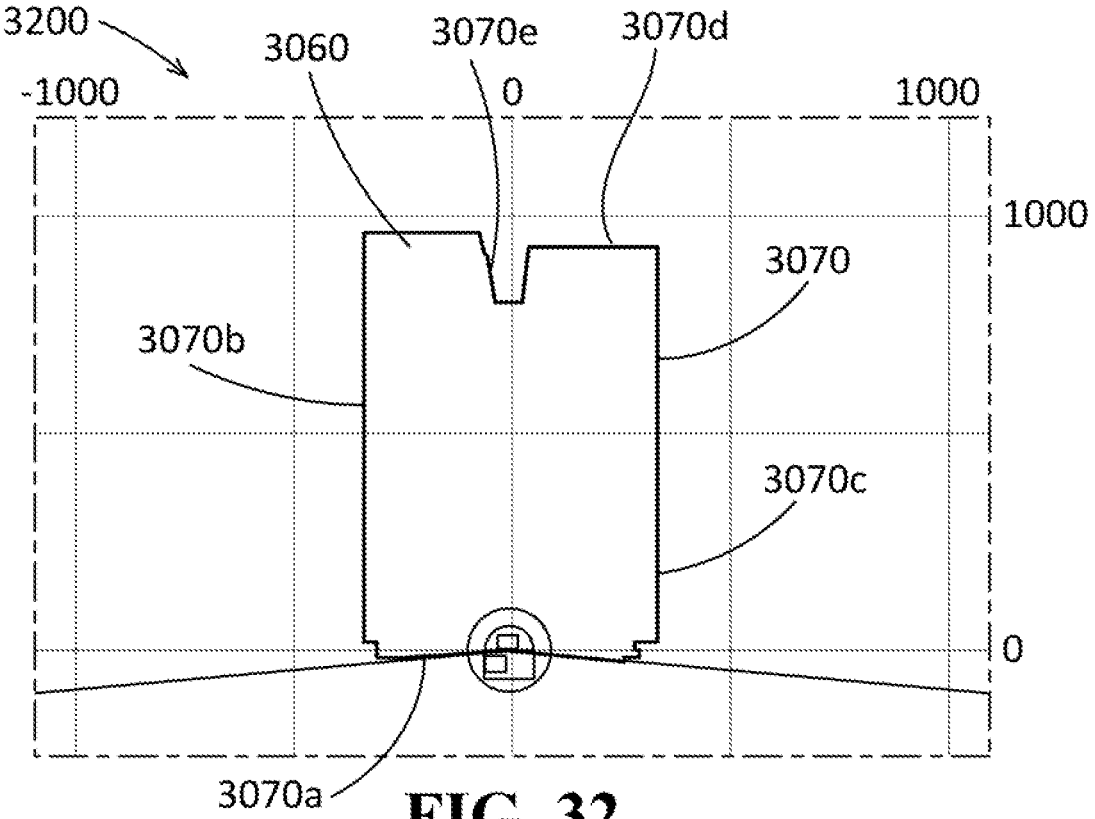
FIG. 32 is a pipe profile diagram of the safety sensor system of FIG. 30 corresponding to a first pipe.

FIG. 32 is a pipe profile diagram 3200 of the safety sensor system 3000 of FIG. 30 corresponding to a first pipe 60, which can define a smaller pipe with a diameter of around one inch. As shown, each portion of the beam boundary 3070 can be defined with respect to a source of the beam 3060 shown at coordinates 0,0 on the axes shown, which can roughly correspond to the X-axis and Z-axis directions shown in FIG. 1A. In some aspects, as shown in FIGS. 30 and 31, the beam 3060 can be angled with respect to the Z-axis. As such, the beam 3060 can be oriented in a non-vertical plane. The dimensions shown are millimeters but can be converted for use in another measurement system.

Figure 33:
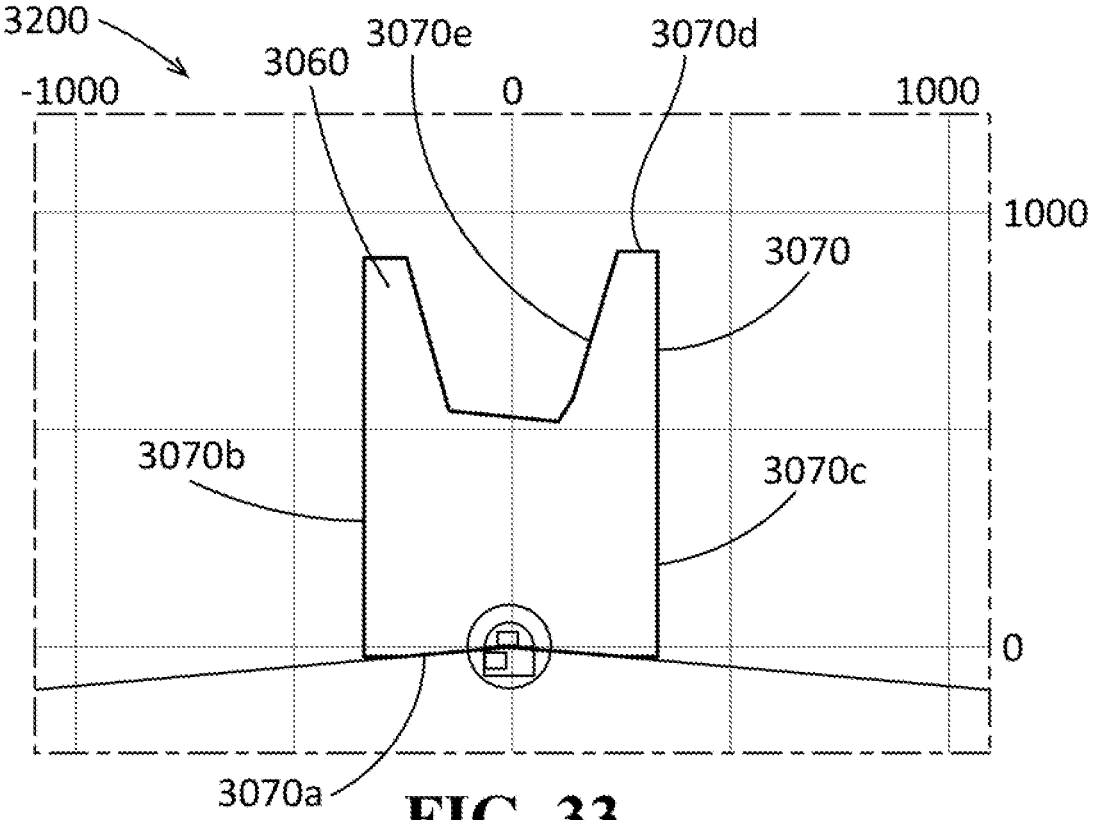
FIG. 33 is a pipe profile diagram of the safety sensor system of FIG. 30 corresponding to a second pipe in accordance with one aspect of the current disclosure.

FIG. 33 is a pipe profile diagram 3200 of the safety sensor system 3000 of FIG. 30 corresponding to a second pipe 60 in accordance with one aspect of the current disclosure. The second pipe can define a larger pipe with a diameter of around 12 inches. Any number of pipe profiles can be defined in the safety sensor system 3000 for whatever pipe 60 is to be grooved by the pipe groover 70. In some aspects, each pipe 60 can have a unique pipe profile defining a unique beam boundary 3070. In some aspects, multiple pipes 60 can share a pipe profile defining a common beam boundary 3070 based on the outer diameter of the multiple pipes 60 being sufficient similar.

A method of measuring the pipe 60 on the pipe groover 70 can comprise inserting a pipe in a spindle assembly 100 of the pipe groover 70. The method can comprise initiating a pipe measurement routine on the pipe groover 70. The method can comprise moving the bottom or outer roller 134 of the pipe groover 70 towards a bottom of an exterior surface of the pipe. The method can comprise clamping the pipe 60 between two rollers 132,134 of the spindle assembly 100. The method can comprise calculating a wall thickness of the pipe 60. The method can comprise calculating a diameter of the pipe 60 using data input from measurements taken from the sensor 950 and from a database of one or more other variables. The method can comprise each of the moving, clamping, first determining, and second determining steps is performed automatically by the pipe groover upon completion of the initiating step.

A method of using the pipe groover 70 can comprise forming a first groove 68 in a wall of the pipe 60 proximate to an end of the pipe 60 using a first roller assembly 130 of a plurality of roller assemblies 130. The method can comprise initiating a tool change by providing instructions for same to the pipe groover 70 via the controller 1220. The method can comprise rotating a spindle assembly 100 of the pipe groover 70 to activate a second roller assembly 130 of the plurality of roller assemblies 130, the second roller assembly 130 being configured to form a second groove 68 in a second pipe 60, at least one specification of the first groove 68 and the second groove 68 or the first pipe 60 and the second pipe 60 differing in a material aspect from each other.

A method of using the pipe groover 70 can comprise replacing one of the roller assemblies 130 by removing one of the roller assemblies 130 and installing a new roller assembly 130. The method can comprise removing one of the roller assemblies 130 without touching at least one other roller assembly 130 of a plurality of roller assemblies 130 installed in the spindle assembly 100.

A method of removing one of the roller assemblies 130 and installing a new roller assembly 130 can comprise turning off power to the pipe groover 70. The method can comprise removing the inner roller 132 and removing the outer roller 134. The method can comprise removing the individual elements with nothing more than a rotary tool (e.g., a screwdriver or drill) or pliers (e.g., retaining ring pliers). A method of removing the inner roller 132 can comprise removing the shaft collar 192 (shown in FIG. 15A) by removing any fasteners securing the shaft collar 192 to the roller shaft 137 of the inner roller 132. In some aspects, the shaft collar 192 can comprise two semicircular coupling halves, which can be joined at the ends with a screw or other fastener. In some aspects, the shaft collar 192 can be or can comprise a retaining ring, which can be installed and removed with at least a pair of retaining ring pliers. The method can comprise pulling the inner roller 132 in an axial direction from the spindle plate 110 and towards a front of the pipe groover 70 until the inner roller 132 clears the spindle plate 110.

A method of removing the outer roller 134 can comprise removing any retaining fasteners maintaining a position of the roller pin 145 in the pivot arm 141. The method can comprise slipping the outer roller 134 from between side walls of the pivot arm, which can be in a direction perpendicular to an axis of the roller pin 145. The method can comprise removing the outer roller 134 only after removing the inner roller 132. Installing a new roller assembly 130 can comprise installing a new inner roller 132 and a new outer roller 134 by reversing the above-outlined steps for removal of each.

Figure 34:
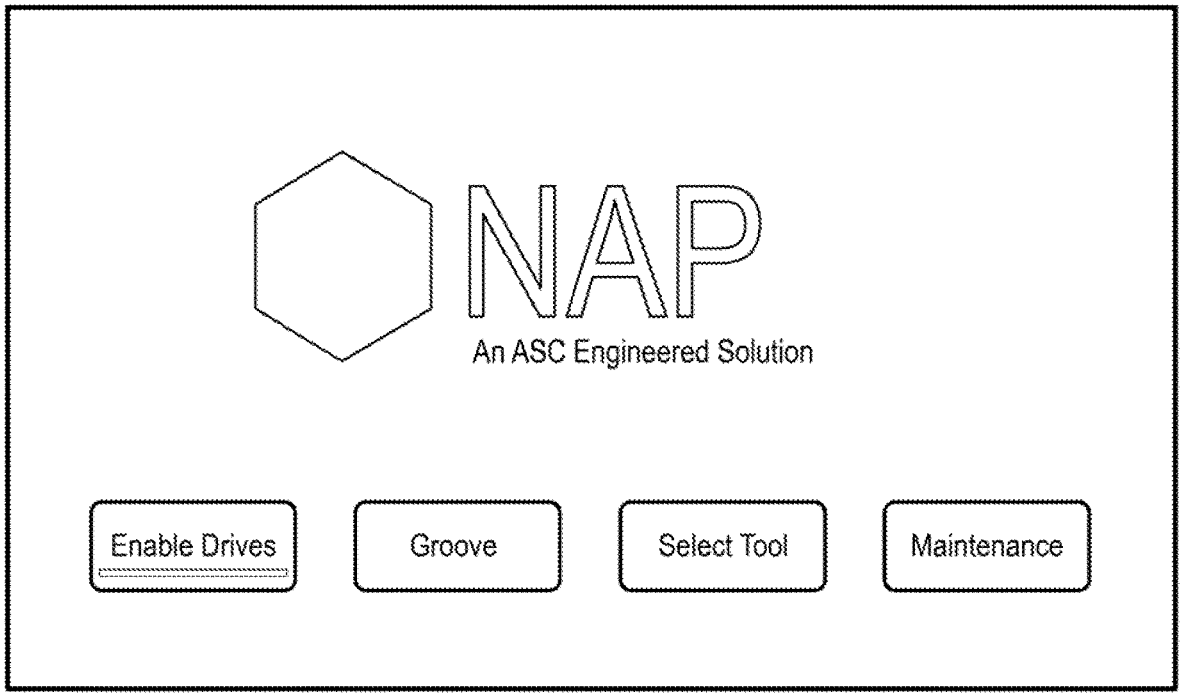
FIG. 34 is a screen view of a user interface of a controller of the pipe groover of FIG. 1B showing a main menu for controlling the pipe groover in accordance with one aspect of the current disclosure.

FIGS. 34-45 are various screen views of a user interface of the controller 1220 of the pipe groover 70 of FIG. 1B, each in accordance with one aspect of the current disclosure. The display 1224 (shown in FIG. 12) can comprise a touchscreen display surface or screen via with a user can view settings, provide inputs (e.g., instructions), and otherwise interact with and operate the pipe groover 70. FIG. 34 shows a main menu for controlling the pipe groover 70. In some aspects, the user of the pipe groover 70 can enable drives (i.e., the various motors, actuators, cylinders, and other motion-producing devices of the pipe groover 70), can enter a "groove" menu for grooving pipe, can enter a menu for selecting a pipe, or can enter a menu to perform specific maintenance activities. In some aspects, the user can select between the groove menu and a "rotate head" menu or option, a "settings" menu, and a "grease roller" option.

Figure 35:
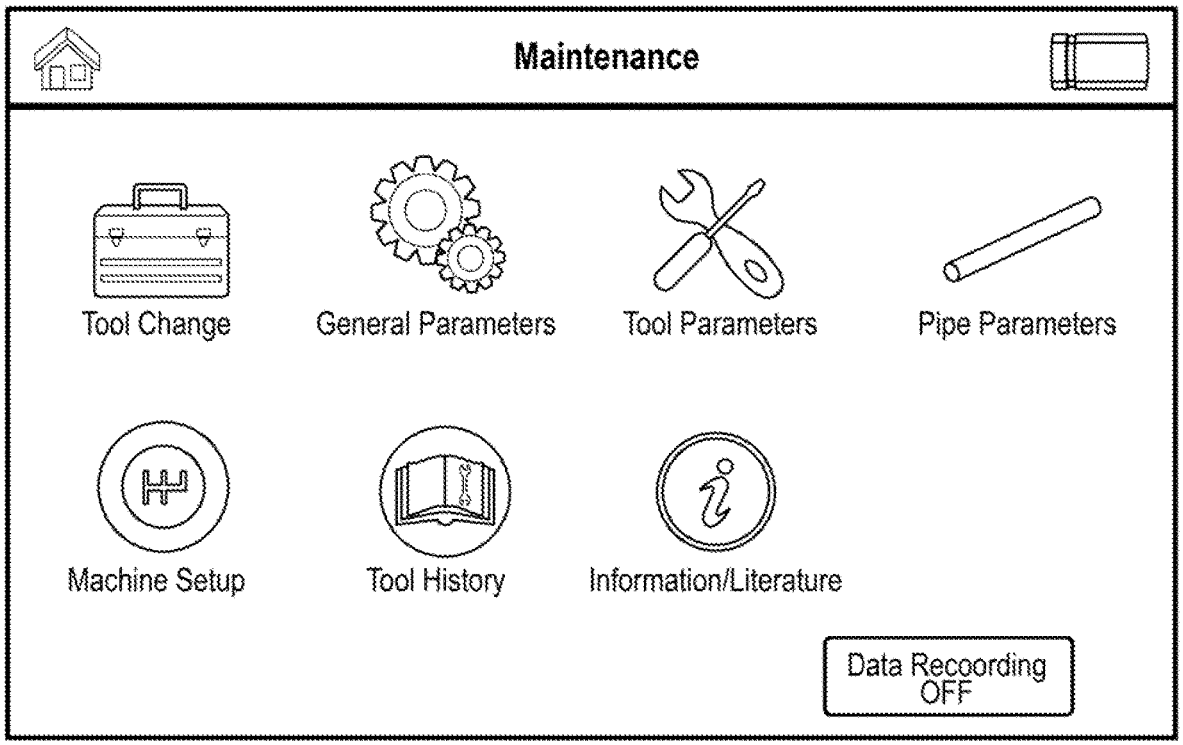
FIG. 35 is a screen view of a user interface of a controller of the pipe groover of FIG. 1B showing a main menu for maintenance-related and other options in accordance with one aspect of the current disclosure.

FIG. 35 shows a main menu for maintenance-related and other options. In some aspects, the user can choose between a "tool change" menu, a "general parameters" menu, a "tool parameters" menu, a "pipe parameters" menu, a "machine setup" menu, a "tool history" menu, and an "information/literature" menu, at least some of which is described in further detail below. In some aspects, the user can be given an option to log into to a network to access certain features—or to be able to operate the pipe groover 70 at all. In some aspects, the user can be given an option to record grooving data or take other action.

Figure 36A:
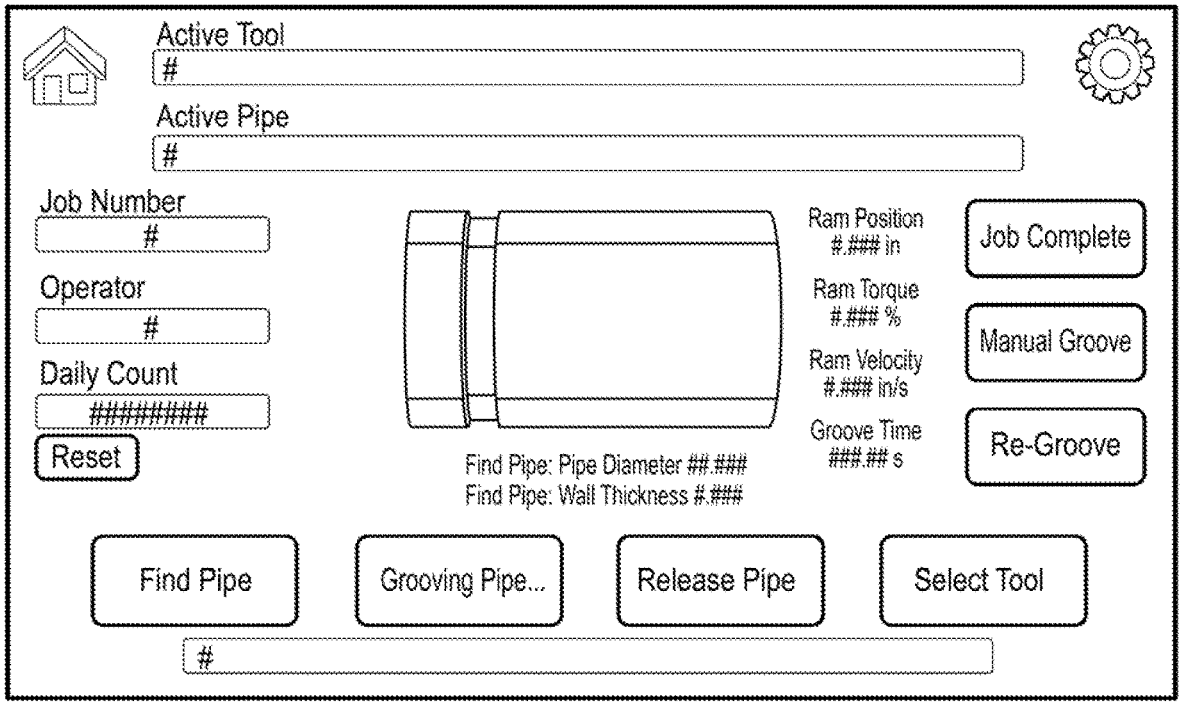
FIG. 36A is a screen view of a user interface of a controller of the pipe groover of FIG. 1B showing a main screen or main menu for grooving pipe in accordance with one aspect of the current disclosure.

FIG. 36A shows a main screen or main menu for grooving the pipe 60. The user can be provided with information on the active tool and active pipe and certain details on the job in process or to be commenced or the pipe groover 70 itself. In some aspects, as shown, the user can be invited to reset one or more settings of the pipe groover 70. After engaging the pipe 60 with the pipe groover 70, the user can perform one or more actions such as, for example and without limitation, initiating a "Find Pipe" activity in which the pipe groover 70 will automatically determine the size of the pipe 60; initiating a "Groove Pipe" activity in which grooving can be performed on an already identified pipe 60 (and, during this process, the option can display a "Grooving Pipe . . . " message to the user); choosing to "Release Pipe" in which pipe 60 can be disengaged from the roller assembly 130 of the pipe groover 70; or entering a "Select Tool" menu in which the user can select the appropriate roller assembly 130 for the pipe 60 to be grooved. Other options can include the user indicating that the current job is complete (via the "Job Complete" option), the user choosing to manually identify the pipe (via the "Manual Groove" option), and the user entering a re-groove menu for re-grooving of a pipe that has already been grooved, at least in part. As shown, one or more specifications of the pipe 60 and/or operation of the pipe groover 70 can be displayed where known by the pipe groover 70 through the "Find Pipe" step or from the most recent grooving operation. For example, the pipe diameter and wall thickness derived from the "Find Pipe" step can be shown, and the ram position, ram torque, ram velocity, and/or groove time from the most recent grooving operation can be shown.

Figure 36B:
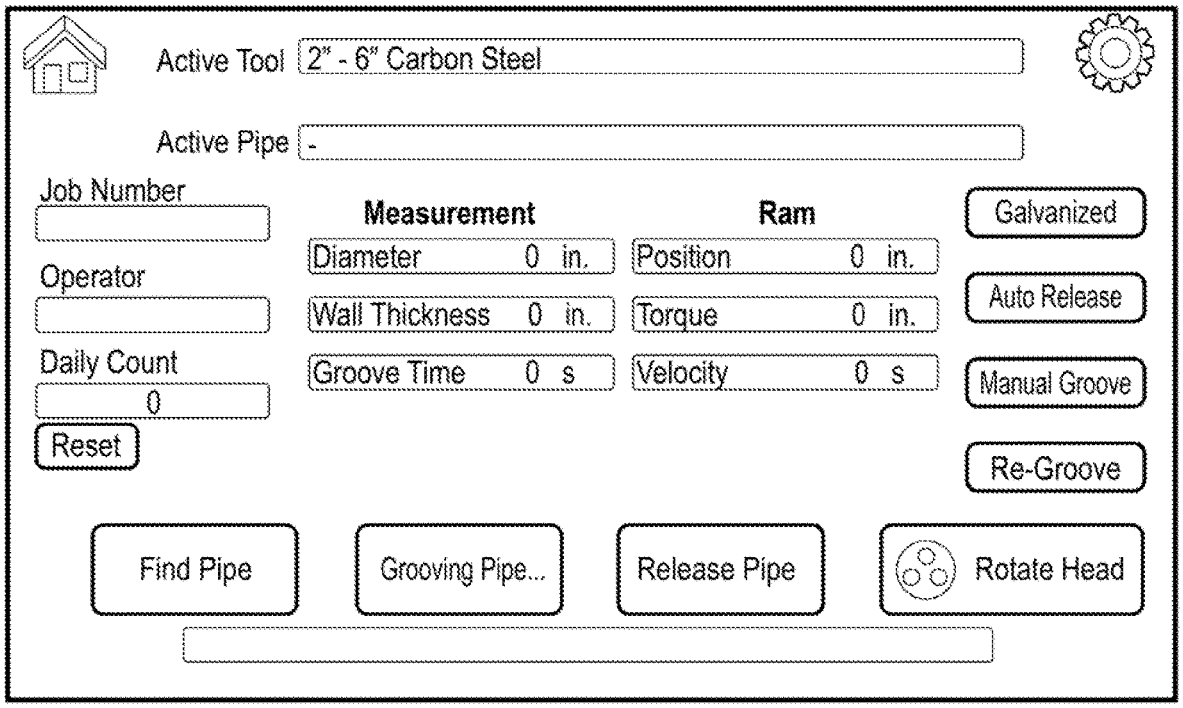
FIG. 36B is a screen view of a user interface of a controller of the pipe groover of FIG. 1B showing a main screen or main menu for grooving pipe in accordance with another aspect of the current disclosure.

FIG. 36B shows a main screen or main menu for grooving the pipe 60 in accordance with another aspect of the current disclosure. In some aspects, as shown, the user can choose an "Auto Release" option in which manual selection of the "Release Pipe" option is not required after each pipe 60 is grooved.

Figure 37A:
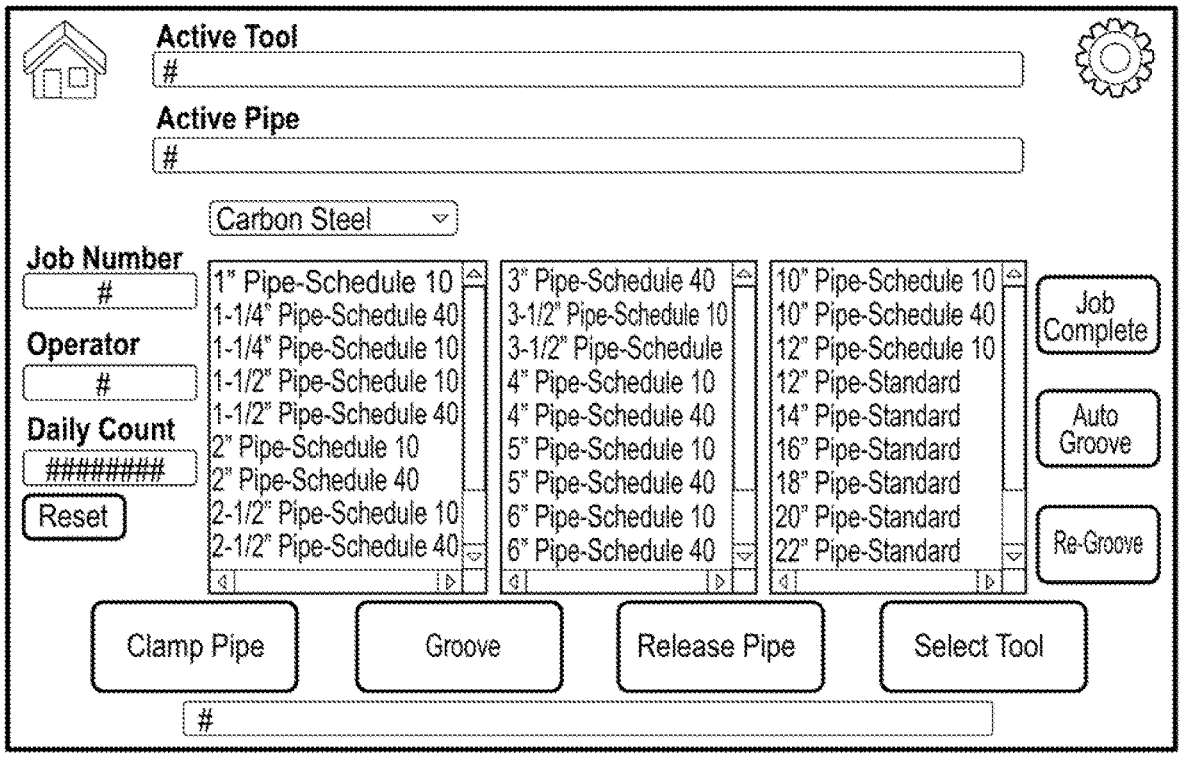
FIG. 37A is a screen view of a user interface of a controller of the pipe groover of FIG. 1B showing a main menu for manually grooving pipe using the pipe groover in accordance with one aspect of the current disclosure.

FIG. 37A shows a main menu for manually grooving the pipe 60 using the pipe groover 70. The user can select a pipe material (e.g., carbon steel, as shown) and in addition to settings shown in the main menu (e.g., active tool and active pipe) can be presented one or more columns of pipe sizes available in that material and in the database. The user can scroll up or down through the list(s) and can select various other options (e.g., one or more of the "Clamp Pipe," "Groove," "Release Pipe," or "Select Tool" options).

Figure 37B:
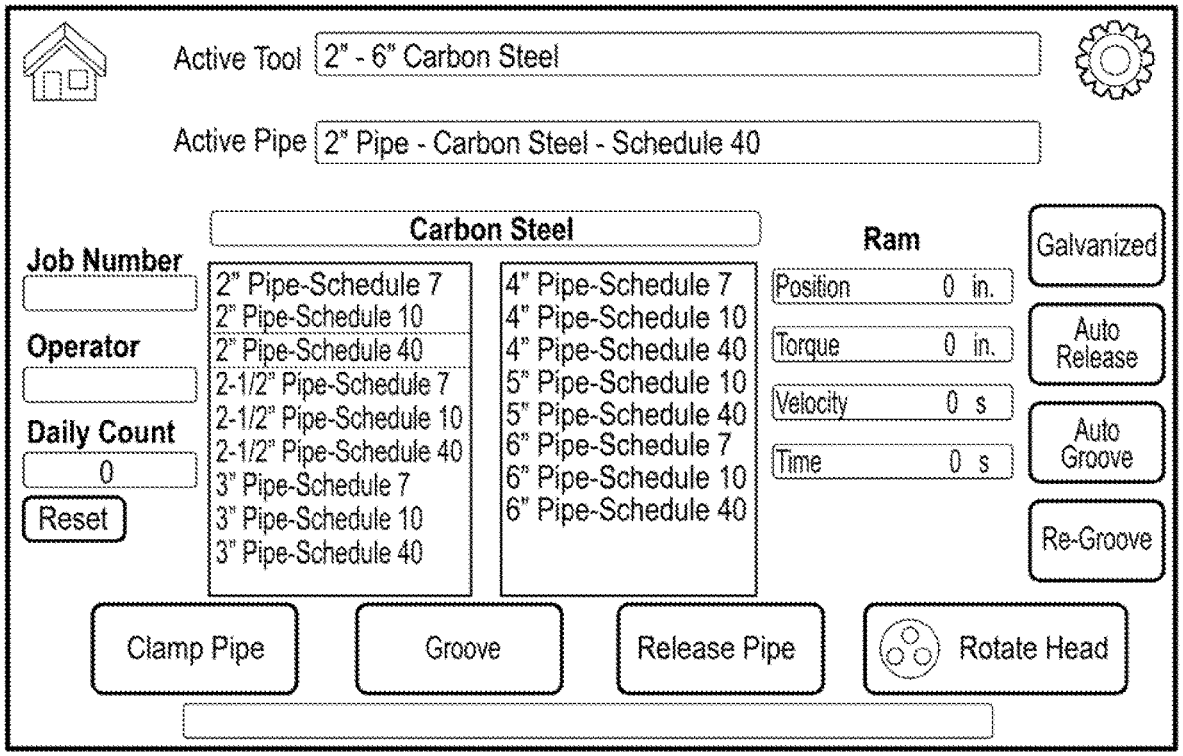
FIG. 37B is a screen view of a user interface of a controller of the pipe groover of FIG. 1B showing a main menu for manually grooving pipe using the pipe groover in accordance with another aspect of the current disclosure.

FIG. 37B shows a main menu for manually grooving the pipe 60 using the pipe groover 70 in accordance with another aspect of the current disclosure. As shown, the user can be presented with only the pipe sizes that are available for grooving with the active tool already selected. Such narrowing of the list can simplify or shorten the manual selection of pipe size and help prevent errors based on selection of a pipe size that is not possible with the active tool. The user can be presented a number of other options, including the "Auto Release" option and also a "Galvanized" pipe option for selecting galvanized pipe.

Figure 38:
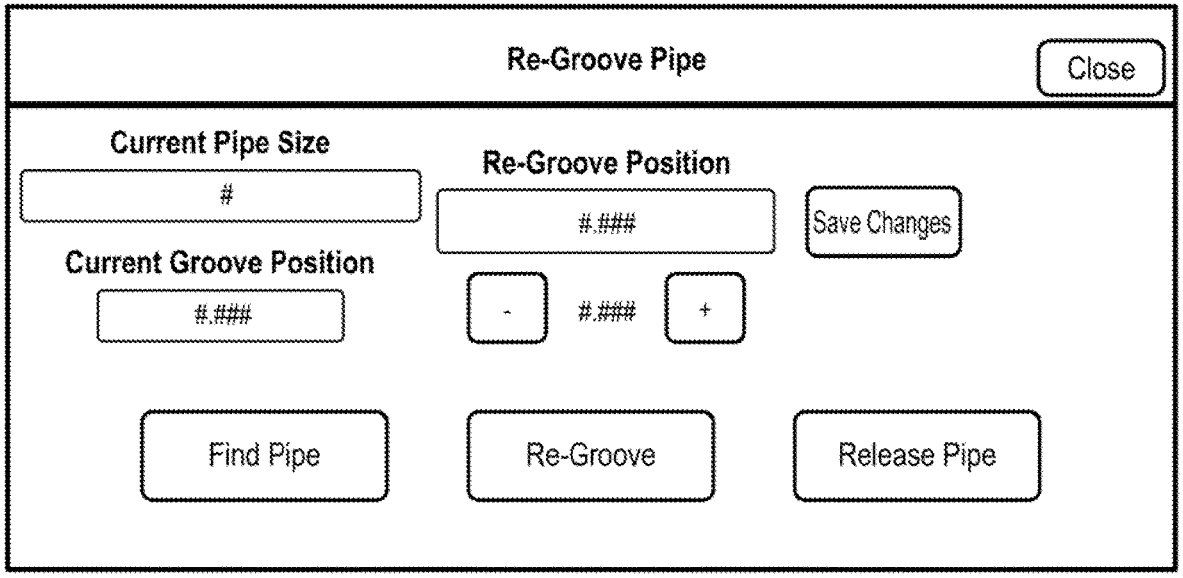
FIG. 38 is a screen view of a user interface of a controller of the pipe groover of FIG. 1B showing a main menu for re-grooving pipe using the pipe groover in accordance with one aspect of the current disclosure.

FIG. 38 shows a main menu for re-grooving the pipe 60 using the pipe groover 70. As shown, the user can provide or confirm information about the pipe 60 (e.g., current pipe size and current groove position) to be re-grooved and can enter or confirm details of the desired re-grooving (e.g., the re-groove position). In some aspects, as shown, the user can select various other options (e.g., one or more of the "Find Pipe," "Re-Groove," and "Release Pipe" options). In some aspects, either the prospective, calculated, or measured statistics on the ram position, ram torque, ram velocity, and/or groove time can be shown.

Figure 39:
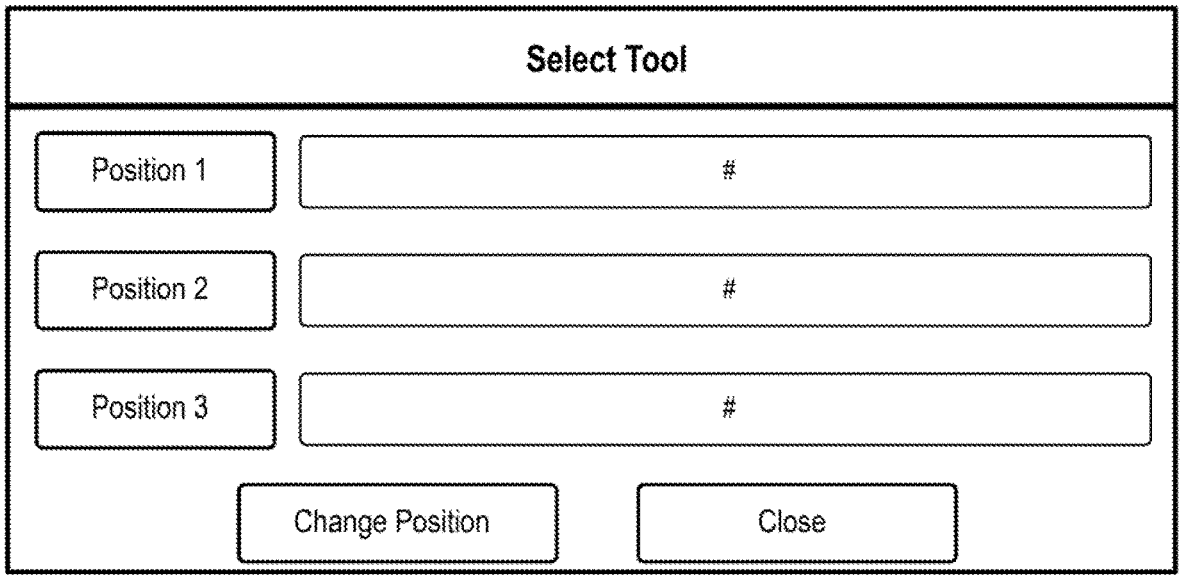
FIG. 39 is a screen view of a user interface of a controller of the pipe groover of FIG. 1B showing a menu screen for selecting a tool, i.e., a particular roller assembly 130, in accordance with one aspect of the current disclosure.

FIG. 39 shows a menu screen for selecting a tool, i.e., a single, matching combination of rollers 132,134. The user can be presented with information on each tool— for example, Position 1 can be identified as having a previously installed tool (e.g., one of the roller assemblies 130) for "2"-6" Carbon Steel—Schedule 10," and the user can select that tool as appropriate, select another tool, or go to "Change Tool" on a higher-level menu to swap out one or more of the tools.

Figure 40:
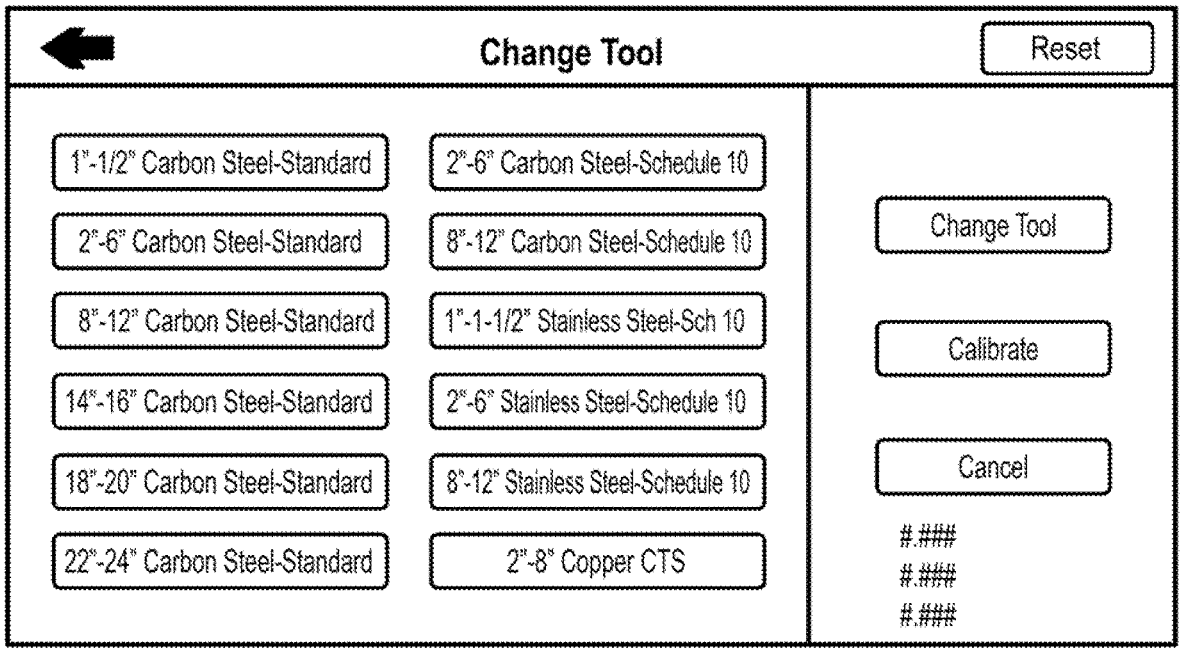
FIG. 40 is a screen view of a user interface of a controller of the pipe groover of FIG. 1B showing a main menu for changing a tool of the pipe groover in accordance with one aspect of the current disclosure.

FIG. 40 shows a main menu for changing a tool (e.g., one of the roller assemblies 130) of the pipe groover 70. The user can select the option corresponding to the desired tool, physically install the new tool (as described above), and calibrate the tool as needed.

Figure 41:
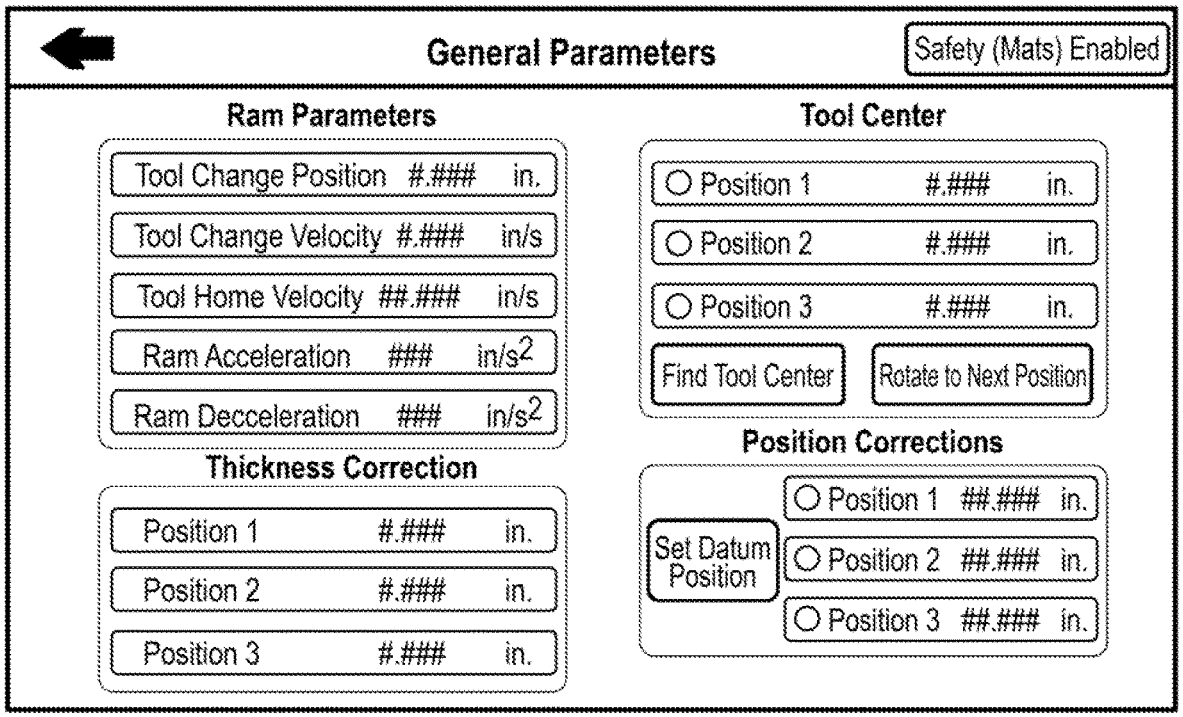
FIG. 41 is a screen view of a user interface of a controller of the pipe groover of FIG. 1B showing a main menu for viewing and/or setting general parameters of the pipe groover in accordance with one aspect of the current disclosure.

FIG. 41 shows a main menu for setting general parameters of the pipe groover 70. The user can select a parameter, and when the parameter is adjustable the user can be given an opportunity to view and adjust the current setting of the parameter. The user can view and adjust ram parameters. The user can view and adjust tool center parameters and can rotate between tool positions or stations to do the same for each of the tool positions or stations. The user can view and adjust thickness corrections. The user can view and adjust position corrections. As shown, the display 1224 can indicate whether a safety switch such as safety mats are currently enabled.

Figure 42:
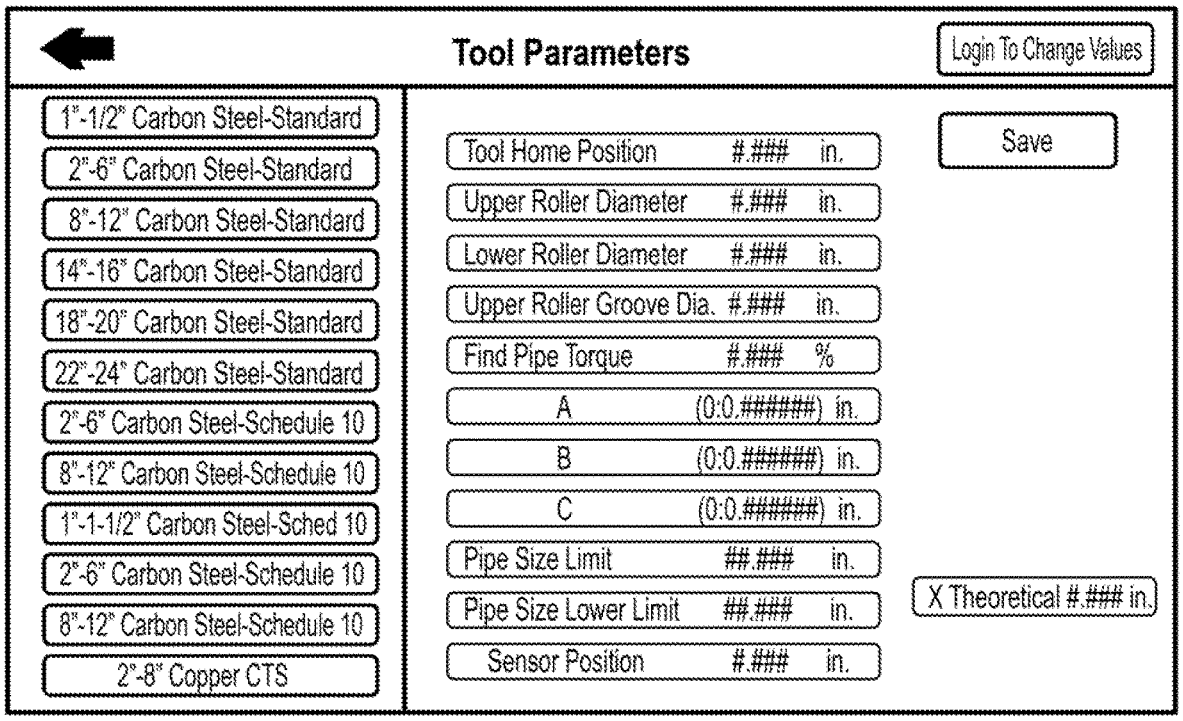
FIG. 42 is a screen view of a user interface of a controller of the pipe groover of FIG. 1B showing a main menu for viewing and/or setting tool parameters of the pipe groover in accordance with one aspect of the current disclosure.

FIG. 42 shows a main menu for setting tool parameters of the pipe groover 70. The user can select a particular tool and can view any one or more parameters for the selected tool. When the parameter is adjustable, the user can be given an opportunity to view and adjust the current setting of the parameter. The user can view and adjust one or more of the same parameters presented in the Tool Array of FIG. 28.

Figure 43:
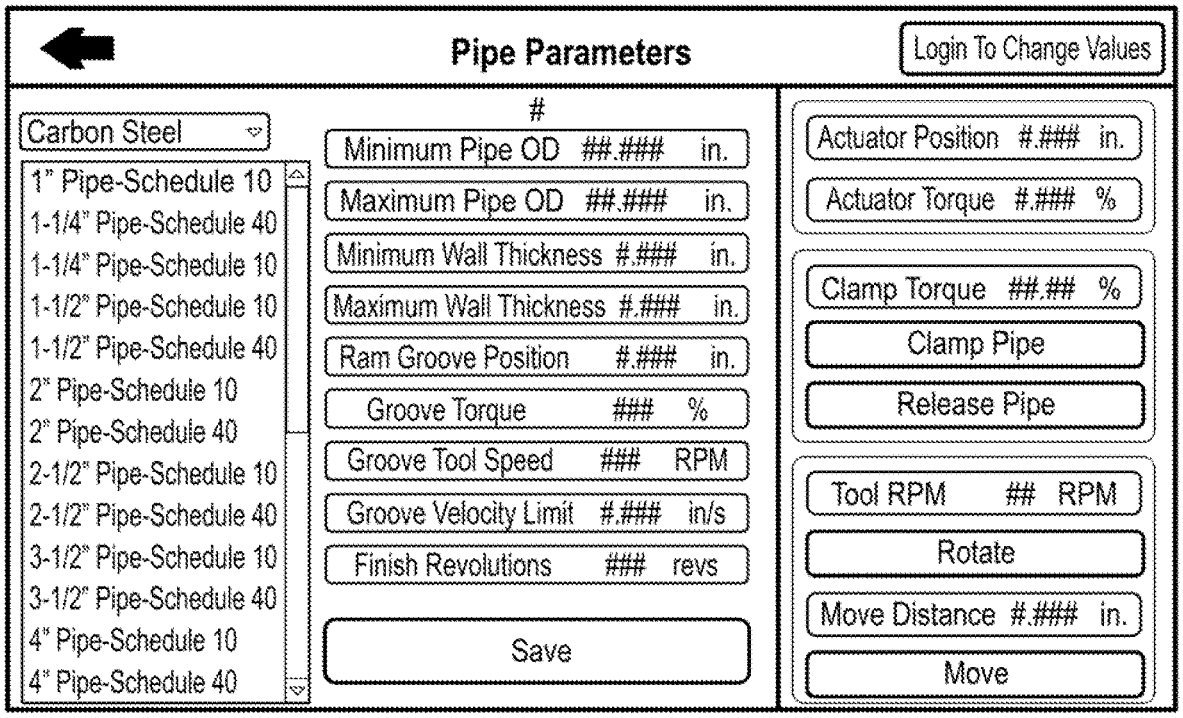
FIG. 43 is a screen view of a user interface of a controller of the pipe groover of FIG. 1B showing a main menu for viewing and/or setting pipe parameters of the pipe groover in accordance with one aspect of the current disclosure.

FIG. 43 shows a main menu for setting pipe parameters of the pipe groover 70. The user can select a particular material, can select a particular pipe size and thickness (e.g., "schedule"), and can view any one or more parameters for the selected pipe. When the parameter is adjustable, the user can be given an opportunity to view and adjust the current setting of the parameter. The user can view and adjust one or more of the same parameters presented in the Pipe Arrays of FIGS. 29A-29D.

Figure 44:
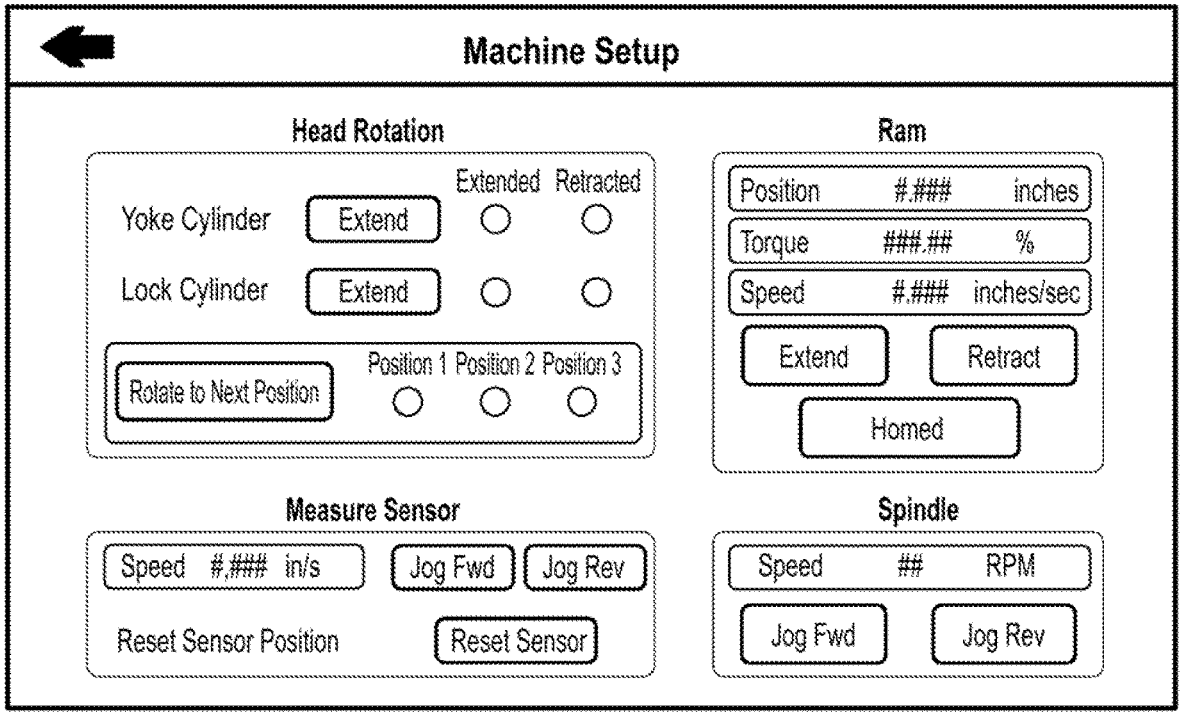
FIG. 44 is a screen view of a user interface of a controller of the pipe groover of FIG. 1B showing a main menu for basic setup of the pipe groover in accordance with one aspect of the current disclosure.

FIG. 44 shows a main menu for basic setup of the pipe groover 70. The user can select a particular setting (e.g., a position of one cylinder or another, a position of the ram, and positions of the pipe sensor 950 and the spindle assembly 100). When changeable, the user can be given an opportunity to adjust the current setting of the parameter and/or manipulate the component of interest to the user.

Figure 45:
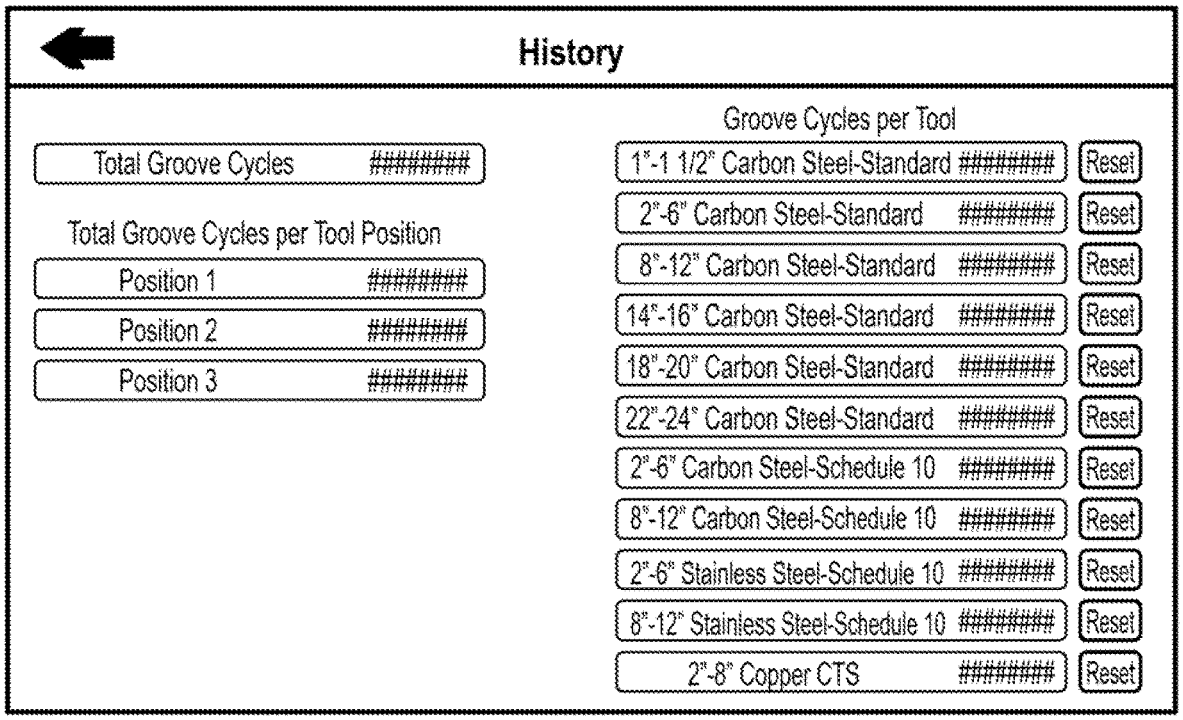
FIG. 45 is a screen view of a user interface of a controller of the pipe groover of FIG. 1B showing historical use of the pipe groover in accordance with one aspect of the current disclosure.

FIG. 45 shows historical use of the pipe groover 70. The user can view the characteristics of operation of the pipe groover including especially total groove cycles, groove cycles per tool position, and groove cycles per tool. Such information can help the user or a member of their support staff identify opportunities to perform preventive maintenance before a portion of the pipe groover 70 fails and interrupts use of the pipe groover 70 at an inopportune moment.

Any of the screenshots displayed by the pipe groover 70 on the display 1224, including any of the screenshots explicitly described above, can be displayed in any of a variety of ways. In some aspects, a submenu can be displayed as a completely new image. In some aspects, the submenu can be displayed as a smaller image over a higher-level menu that is a grayed-out until user action closes the submenu and returns the user to the higher-level menu.

In summary, the pipe groover 70 disclosed herein can be associated with one or more benefits to a user. In one aspect, the pipe groover 70 can comprise a pipe measurement system for automatically identifying the pipe 60 engaged with the pipe groover 70. As needed during a maintenance period on the sensor 950 or when desired for some other reason, however, an operator of the pipe groover 70 can manually enter the pipe size and adjust parameters (e.g., pipe size ranges for a particular roller assembly 130) under which a certain roller assembly can be used. Moreover, if the pipe is outside of the allowed range of pipes for the selected tool station, the controller 1220 can know and can notify the operator and lock out some functionality (including, for example, not grooving the pipe 60).

In one aspect, the pipe groover 70 can comprise a plurality of spindle heads, i.e., roller assemblies 130, each of which can be configured to form the groove 68 in a different range of pipe sizes by simply rotating to a tool station with the desired roller assembly 130. An operator can quickly form the groove 68 in pipes 60 of varying sizes and specifications without setting up the tool with new grooving dies and making other adjustments, especially manual adjustments. Avoiding such tool changes and simply rotating to a new roller assembly 130 can save as much as 80-90% of the time that might otherwise be required to change out the whole tool.

In one aspect, the pipe groover can comprise an electric actuator, which can be a ball screw linear actuator. By avoiding the mechanical stop that is typical with other pipe groovers, the time and frustration saved by not needing to use, much less regularly set or adjust, the position of the mechanical stop, can further prevent trial and error, reduce expensive scrap costs, reduce training requirements and improve morale among operators.

In one aspect, the pipe groover can form a groove in a bottom end of a pipe.

In one aspect, the pipe groover can comprise a support roller and can support a bottom end of the pipe with the support roller during a grooving operation and, optionally, with a plurality of support rollers. While on a typical pipe groover the groove is formed at the top of the pipe, it is easier for a pipe that drops out of the spindle assembly to drop completely out of the machine.

Any of the fasteners disclosed or contemplated herein, including the fasteners 90, 190, 290, 390, 490, 590, 690, 790, 990, 1090, 1190, 1290, can vary in their detailed specifications and can include one or more of connecting elements such as, for example and without limitation, bolts, washers, and nuts. In some aspects, the fastener can be a weldment, adhesive, or any other connecting element.

A variety of materials can be used to form the load-carrying components of the pipe groover 70 including, for example and without limitation, carbon steel and an aluminum alloy. Parts that routinely see significant wear such as the rollers 132,134 can, for example, be formed from hardened steel, and the spindle plate can be formed from aluminum alloy. Specifications for various other components are disclosed herein or can be determined by one of ordinary skill in the art.

One should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily comprise logic for deciding, with or without user input or prompting, whether these features, elements and/or steps are included or are to be performed in any particular aspect.

It should be emphasized that the above-described aspects are merely possible examples of implementations, merely set forth for a clear understanding of the principles of the present disclosure. Any process descriptions or blocks in flow diagrams should be understood as representing modules, segments, or portions of code which comprise one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described aspect(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A pipe groover comprising:

a base assembly;

a spindle plate secured to the base assembly but configured to rotate about an axis with respect to the base assembly;

a plurality of roller assemblies secured to the spindle plate, each of the roller assemblies comprising a pair of rollers configured to form a groove in a pipe proximate to an end of the pipe; and a yoke assembly comprising a slide coupling and a cylinder configured to selectively engage and disengage the slide coupling with a roller assembly of the plurality of roller assemblies.

2. The pipe groover of claim 1, wherein each of the plurality of roller assemblies is removably secured to the spindle plate.

3. The pipe groover of claim 2, wherein each of the plurality of roller assemblies is removable without tools except for a rotary tool or pliers or both.

4. The pipe groover of claim 1, wherein each of the plurality of roller assemblies differs in specification from the other roller assemblies of the plurality of roller assemblies, each of the plurality of roller assemblies configured to form a groove in a different size or size range of pipes.

5. The pipe groover of claim 1, wherein a single motor is configured to drive a selected roller assembly of the plurality of roller assemblies.

6. The pipe groover of claim 1, further comprising a sensor facing an area of an active roller assembly of the plurality of roller assemblies configured to receive the pipe to be grooved.

7. The pipe groover of claim 1, further comprising a motor coupled to the spindle plate and configured to rotate the spindle plate.

8. The pipe groover of claim 1, further comprising a proximity sensor, a portion of the spindle plate at a rotational position of each roller assembly of the plurality of roller assemblies configured to activate the proximity sensor, the proximity sensor configured to thereby sense a rotational position of the spindle plate.

9. The pipe groover of claim 1, further comprising a spindle lock, the spindle lock comprising a cylinder configured to selectively engage and disengage the spindle lock with the spindle plate to fix a rotation position of the spindle plate.

10. A pipe groover comprising:

a base assembly;

a spindle plate secured to the base assembly but configured to rotate about an axis with respect to the base assembly;

a plurality of roller assemblies secured to the spindle plate, each of the roller assemblies comprising a pair of rollers configured to form a groove in a pipe proximate to an end of the pipe; and a sensor facing an area of an active roller assembly of the plurality of roller assemblies configured to receive the pipe to be grooved.

11. The pipe groover of claim 10, wherein each of the plurality of roller assemblies is removably secured to the spindle plate.

12. The pipe groover of claim 11, wherein each of the plurality of roller assemblies is removable without tools except for a rotary tool or pliers or both.

13. The pipe groover of claim 10, wherein each of the plurality of roller assemblies differs in specification from the other roller assemblies of the plurality of roller assemblies, each of the plurality of roller assemblies configured to form a groove in a different size or size range of pipes.

14. The pipe groover of claim 10, wherein a single motor is configured to drive a selected roller assembly of the plurality of roller assemblies.

15. The pipe groover of claim 10, further comprising a motor coupled to the spindle plate and configured to rotate the spindle plate.

16. The pipe groover of claim 10, further comprising a proximity sensor, a portion of the spindle plate at a rotational position of each roller assembly of the plurality of roller assemblies configured to activate the proximity sensor, the proximity sensor configured to thereby sense a rotational position of the spindle plate.

17. The pipe groover of claim 10, further comprising a spindle lock, the spindle lock comprising a cylinder configured to selectively engage and disengage the spindle lock with the spindle plate to fix a rotation position of the spindle plate.

18. A pipe groover comprising:

a base assembly;

a spindle plate secured to the base assembly but configured to rotate about an axis with respect to the base assembly;

a plurality of roller assemblies secured to the spindle plate, each of the roller assemblies comprising a pair of rollers configured to form a groove in a pipe proximate to an end of the pipe; and a spindle lock, the spindle lock comprising a cylinder configured to selectively engage and disengage the spindle lock with the spindle plate to fix a rotation position of the spindle plate.

19. The pipe groover of claim 18, wherein each of the plurality of roller assemblies is removably secured to the spindle plate.

20. The pipe groover of claim 19, wherein each of the plurality of roller assemblies is removable without tools except for a rotary tool or pliers or both.

21. The pipe groover of claim 18, wherein each of the plurality of roller assemblies differs in specification from the other roller assemblies of the plurality of roller assemblies, each of the plurality of roller assemblies configured to form a groove in a different size or size range of pipes.

22. The pipe groover of claim 18, wherein a single motor is configured to drive a selected roller assembly of the plurality of roller assemblies.

23. The pipe groover of claim 18, further comprising a motor coupled to the spindle plate and configured to rotate the spindle plate.

24. The pipe groover of claim 18, further comprising a proximity sensor, a portion of the spindle plate at a rotational position of each roller assembly of the plurality of roller assemblies configured to activate the proximity sensor, the proximity sensor configured to thereby sense a rotational position of the spindle plate.

* * * * *